US010138725B2

(12) United States Patent
George et al.

(10) Patent No.: US 10,138,725 B2
(45) Date of Patent: Nov. 27, 2018

(54) HYDRAULIC DELAY TOE VALVE SYSTEM AND METHOD

(71) Applicant: GEODynamics, Inc., Millsap, TX (US)

(72) Inventors: Kevin R. George, Cleburne, TX (US); Philip M. Snider, Tomball, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 396 days.

(21) Appl. No.: 14/841,025

(22) Filed: Aug. 31, 2015

(65) Prior Publication Data

US 2015/0369040 A1 Dec. 24, 2015

Related U.S. Application Data

(63) Continuation-in-part of application No. 14/012,089, filed on Aug. 28, 2013, now Pat. No. 9,121,252, which is a continuation-in-part of application No. 13/788,068, filed on Mar. 7, 2013, now Pat. No. 9,121,247.

(51) Int. Cl.

| | |
|---|---|
| ***E21B 47/10*** | (2012.01) |
| ***E21B 43/116*** | (2006.01) |
| ***E21B 34/10*** | (2006.01) |
| ***E21B 34/06*** | (2006.01) |
| *E21B 34/00* | (2006.01) |

(52) U.S. Cl.

CPC ..... *E21B 47/1025* (2013.01); *E21B 34/063* (2013.01); *E21B 34/108* (2013.01); *E21B 43/116* (2013.01); *E21B 2034/007* (2013.01)

(58) Field of Classification Search

CPC .. E21B 47/1025; E21B 34/063; E21B 34/108; E21B 43/116; E21B 2034/007

See application file for complete search history.

(56) References Cited

U.S. PATENT DOCUMENTS

| | | | |
|---|---|---|---|
| 3,581,819 | A | 6/1971 | Tamplen |
| 4,614,156 | A | 9/1986 | Colle et al. |

(Continued)

FOREIGN PATENT DOCUMENTS

| | | | |
|---|---|---|---|
| CA | 2892128 | A1 | 7/2015 |
| GB | 2289488 | A | 11/1995 |

(Continued)

OTHER PUBLICATIONS

European Patent Office, European Search Report for EP 16185315, dated Mar. 1, 2017.

(Continued)

*Primary Examiner* — Yong-Suk Ro

(74) *Attorney, Agent, or Firm* — Patent Portfolio Builders PLLC

(57) ABSTRACT

An apparatus and method for providing a time delay in injection of pressured fluid into a geologic formation. In one aspect the invention is a toe valve activated by fluid pressure that opens ports after a predetermined time interval to allow fluid to pass from a well casing to a formation. The controlled time delay enables casing integrity testing before fluid is passed through the ports. This time delay also allows multiple valves to be used in the same well casing and provide a focused jetting action to better penetrate a concrete casing lining.

9 Claims, 37 Drawing Sheets

(56) References Cited

U.S. PATENT DOCUMENTS

| | | | | |
|---|---|---|---|---|
| 5,062,485 | A | 11/1991 | Wesson et al. | |
| 5,078,210 | A | 1/1992 | George | |
| 5,209,303 | A | 5/1993 | Barrington | |
| 5,305,833 | A | 4/1994 | Collins | |
| 6,763,892 | B2 | 7/2004 | Kaszuba | |
| 7,195,067 | B2 | 3/2007 | Manke et al. | |
| 7,849,925 | B2 | 12/2010 | Patel | |
| 7,909,095 | B2 | 3/2011 | Richards et al. | |
| 7,913,603 | B2 | 3/2011 | LaGrange et al. | |
| 8,079,296 | B2 | 12/2011 | Barton et al. | |
| 8,245,788 | B2 | 8/2012 | Garcia et al. | |
| 8,267,178 | B1 | 9/2012 | Sommers et al. | |
| 8,459,365 | B1 | 6/2013 | Schultz et al. | |
| 9,016,388 | B2 | 4/2015 | Kellner et al. | |
| 9,121,247 | B2 | 9/2015 | George et al. | |
| 9,121,252 | B2 | 9/2015 | George et al. | |
| 9,187,994 | B2 | 11/2015 | Themig | |
| 2003/0221837 | A1 | 12/2003 | Giroux et al. | |
| 2009/0107686 | A1* | 4/2009 | Watson | E21B 43/105 166/381 |
| 2010/0031456 | A1 | 12/2010 | Bisset | |
| 2011/0036594 | A1 | 2/2011 | Yokley et al. | |
| 2011/0168410 | A1 | 7/2011 | Deboer | |
| 2011/0253383 | A1 | 10/2011 | Porter et al. | |
| 2012/0279723 | A1 | 11/2012 | Hoffman et al. | |
| 2013/0025872 | A1 | 1/2013 | Mailand et al. | |
| 2013/0292133 | A1 | 11/2013 | Thompson | |
| 2014/0000909 | A1 | 1/2014 | Neer | |
| 2014/0083689 | A1 | 3/2014 | Streich et al. | |
| 2014/0251619 | A1 | 9/2014 | George et al. | |
| 2014/0251620 | A1 | 9/2014 | George et al. | |

FOREIGN PATENT DOCUMENTS

| | | | |
|---|---|---|---|
| WO | 2012037646 | | 3/2012 |
| WO | 20140094137 | A1 | 6/2014 |
| WO | 20150123299 | A1 | 8/2015 |

OTHER PUBLICATIONS

European Office Action, dated Sep. 14, 2018, from corresponding European Application No. 16 185 314.8—1002 (All references previously cited on Sep. 25, 2017).

European Office Action, dated Sep. 18, 2018, from corresponding European Application No. 16 185 315.5—1002 (All references previously cited on Mar. 15, 2017).

* cited by examiner

1010

1020

1030

HYDRAULIC DELAY TOE VALVE SYSTEM AND METHOD

CROSS REFERENCE TO RELATED APPLICATIONS

This application is a continuation-in-part application of, and claims priority to, non-provisional patent application Ser. No. 14/012,089 filed Aug. 28, 2013 which is a continuation-part-part application of, and claims priority to non-provisional patent application Ser. No. 13/788,068, filed Mar. 7, 2013.

FIELD OF THE INVENTION

An apparatus and method for providing a time delay in injection of pressured fluid into a geologic formation. More specifically, it is a toe valve apparatus activated by fluid pressure that opens ports after a predetermined time interval to allow fluid to pass from a well casing to a formation.

PRIOR ART AND BACKGROUND OF THE INVENTION

Prior Art Background

It has become a common practice to install a pressure responsive opening device at the bottom or toe of a casing string within horizontal well bores and in some vertical bores. These devices make up and run as an integral part of the casing string. After the casing has been cemented and allowed to solidify, the applied surface pressure is combined with the hydrostatic pressure and a pressure responsive valve is opened. The combination of hydrostatic and applied pressure is customarily used to overcome a number of shear pins or to overcome a precision rupture disc. Once communication with the well bore [i.e., area outside of the casing] is achieved, the well can be hydraulically fractured or the valve can be used as an injection port to pump down additional wire line perforating guns, plugs or other conveyance means such as well tractors. Other known methods of establishing communication with the cemented and cased well include tubing conveyed or coil tubing conveyed perforators. These are all common methods to achieve an injection point but require increased time and money.

The present invention provides an improved apparatus and method that provides a time delay in fluid injection through the casing.

Current time delay tools that open instantly do such in an uncontrolled manner wherein a piston slams in an uncontrolled manner. Therefore, there is a need for a time delay tool that may be opened instantly in a controlled manner. Current time delay tools are not capable of opening multiple downhole tools. For example, when there are two tools that need to open to a formation, one tool may be opened to the formation due to the variation in actuation pressure of the rupture disks, however the pump pressure cannot reach the second tool to actuate due to the first tool that is already connected to a formation. Therefore, there is a need for opening multiple tools within a short period of time without the need for deploying each tool separately.

Prior art tools also do not provide for a repeatable and reproducible time delays due to the uncontrolled manner of the tool opening. Therefore there is a need for a reliable, repeatable and reproducible time delay tool for opening connection to a formation in a controlled manner.

U.S. Pat. No. 6,763,892 patent entitled, "Sliding sleeve valve and method for assembly," discloses the following:

"A sliding sleeve valve and method for assembly is disclosed. The valve comprises a segmented main body that is assembled from a top, middle and bottom segments. The middle segment has flow apertures. A closing sleeve is co-axially mounted in the assembled main body. The closing sleeve has flow apertures that are intended to communicate with the flow apertures of the middle section when the valve is open. The closing sleeve is sealed by seal means within the main body to prevent undesired fluid flow across the valve. The seal means comprise primary, secondary and tertiary seals acting in cooperative combinations. The seals comprise O-Ring and Vee-stack seals located within the body of the valve. The sliding sleeve valve has a fluid pressure equalization means to permit equalization of fluid pressure across the valve before it is fully opened or fully closed in order to reduce wear on the seals. The equalization means comprises a plurality of pressure equalization ports in the sliding sleeve that are intended to communicate with the main body apertures prior to the sliding sleeve apertures when opening and subsequent to the sliding sleeve apertures when closing."

Prior art assembly and manufacturing of the valve as aforementioned comprises a number of individual components threadedly connected together with suitable seals. The components of the tubular body may include top, middle and bottom segments, end couplings and coupling adapters that are connected together and integrated into a well casing. However, due to the number of connections the valve cannot withstand the torque specifications of a typical wellbore casing. In addition, more number of segments and connections increases the propensity of leaks through the valve and therefore rendering the valve unreliable. Therefore, there is a need for a single piece mandrel or tubular body to withstand the torsional and torque specifications of the wellbore casing when the valve is threaded into the wellbore casing. There is a need for a valve manufactured from a single piece mandrel provides for more reliability and reduces the propensity of leaks.

Deficiencies in the Prior Art

The prior art as detailed above suffers from the following deficiencies:

Prior art systems do not provide for economical time delay tools with simple construction and less expensive time delay elements.

Prior art systems do not provide for reliable time delay tools that open at high pressure for connection to a geologic formation.

Prior art systems do not provide for opening time delay tools with reverse acting rupture disks that resist plugging from wellbore debris and fluids.

Prior art systems do not provide for opening multiple time delay tools in a staged manner.

Prior art systems do not provide for a short-delay controlled tool that appears to open immediately to an operator.

Prior art systems do not provide a time delay tool with a larger inner diameter.

Prior art systems do not provide for a short time delay tool that is controlled within a range of 0.5 seconds to 3 minutes.

Prior art systems do not provide for a long time delay tool that is controlled within a range of 60 minutes to 2 weeks.

Prior art systems do not provide for a long time delay tool that is controlled with a large pressure reservoir.

Prior art systems do not provide for a long time delay tool that is controlled with an extremely high viscosity fluid.

Prior art systems do not provide for a long time delay tool that is controlled with plugging agent.

Prior art systems do not provide for a long time delay tool that is controlled stacked delay agents connected in series or parallel.

Prior art systems do not provide for a dual actuated controlled time delay valves.

Prior art systems do not provide for a single-actuated controlled time delay valves.

Prior art systems do not provide for a dual actuated controlled time delay valves manufacture from a single mandrel.

Prior art systems do not provide for a single actuated controlled time delay valves manufacture from a single mandrel.

Prior art systems do not provide for fracturing through a controlled time delay valves.

Prior art systems do not provide for detecting a wet shoe with a toe valve.

Prior art systems do not provide for removing debris from well with a multi injection apparatus.

Prior art systems do not provide for manufacturing a controlled time delay apparatus from a single mandrel that can carry all of the tensile, compressional and torsional loads of the well casing.

Prior art systems do not provide for a valve manufactured from a single piece mandrel for more reliability and reduces the propensity of leaks.

While some of the prior art may teach some solutions to several of these problems, the core issue of a controlled time delay apparatus for establishing injection into a subterranean formation has not been addressed by prior art.

OBJECTIVES OF THE INVENTION

Accordingly, the objectives of the present invention are (among others) to circumvent the deficiencies in the prior art and affect the following objectives:

Provide for economical time delay tools with simple construction and less expensive time delay elements.

Provide for reliable time delay tools that open at high pressure for connection to a geologic formation.

Provide for opening time delay tools with reverse acting rupture disks that resist plugging from wellbore debris and fluids.

Provide for opening multiple time delay tools in a staged manner.

Provide for a short delay controlled tool that appears to open immediately to an operator.

Provide a time delay tool with a larger inner diameter.

Provide for a short time delay tool that is controlled within a range of 0.5 seconds to 3 minutes.

Provide for a long time delay tool that is controlled within a range of 60 minutes to 2 weeks.

Provide for a long time delay tool that is controlled with a large pressure reservoir.

Provide for a long time delay tool that is controlled with an extremely high viscosity fluid.

Provide for a long time delay tool that is controlled with plugging agent.

Provide for a long time delay tool that is controlled stacked delay agents connected in series or parallel.

Prior art systems do not provide for a dual actuated controlled time delay valves.

Prior art systems do not provide for a single-actuated controlled time delay valves.

Provide for a dual actuated controlled time delay valves manufacture from a single mandrel.

Provide for a single actuated controlled time delay valves manufacture from a single mandrel.

Provide for fracturing through a controlled time delay valves.

Provide for detecting a wet shoe with a toe valve.

Provide for removing debris from well with a multi injection apparatus.

Provide for manufacturing a controlled time delay apparatus from a single mandrel that can carry all of the tensile, compressional and torsional loads of the well casing.

Provide for a valve manufactured from a single piece mandrel for more reliability and reduces the propensity of leaks.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention in various embodiments addresses one or more of the above objectives in the following manner. The present invention includes an apparatus integrated into a well casing for injection of pressurized fluid into a subterranean formation. The apparatus comprises a housing with openings, a piston, a stacked delay restrictor, an actuating device and a high pressure chamber with a hydraulic fluid. The stacked delay restrictor is configured to be in pressure communication with the high pressure chamber and a rate of travel of the piston is restrained by a passage of the hydraulic fluid from the high pressure chamber into a low pressure chamber through the stacked delay restrictor. Upon actuation by the actuating device, the piston travels for an actuation time period, after elapse of the actuation time period, the piston travel allows opening of the openings so that the pressurized fluid flows through the openings for a port opening time interval.

Method Overview

The present invention system may be utilized in the context of a controlled time delay method, wherein the system as described previously is controlled by a method having the following steps:

(1) installing a wellbore casing in a wellbore along with the apparatus;

(2) injecting the fluid into the wellbore casing so as to increase pressure to a maximum;

(3) actuating the actuating device when the maximum pressure exceeds a rated pressure of the actuating device;

(4) allowing the piston to travel for the actuation time period;

(5) enabling the piston to travel to open said openings for the port opening time interval so that the pressurized fluid flows into the subterranean formation.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1A:
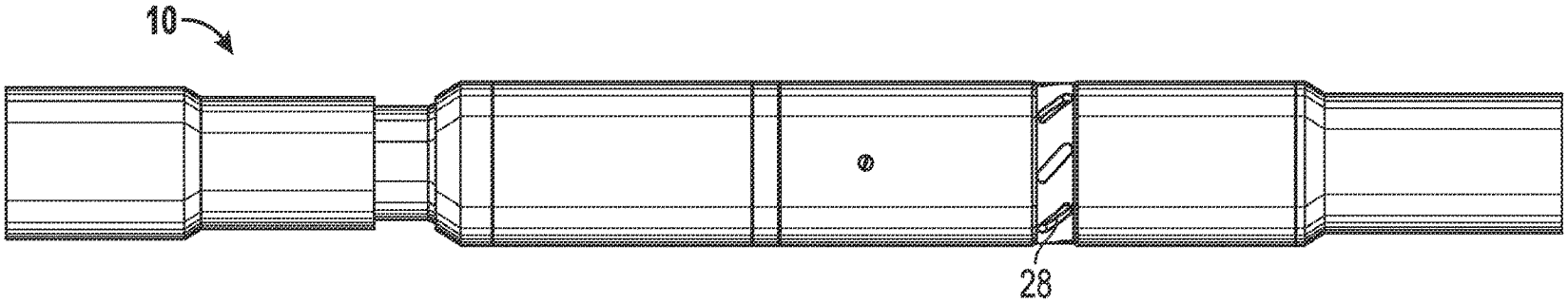
FIG. 1*a* is a plan view of an apparatus of an embodiment of the invention.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a establishing injection to a hydrocarbon formation system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

The present invention is an improved "toe valve" apparatus and method to allow fluid to be injected through ports in an oil or gas well casing wall section (and casing cement) into a geologic formation in a time delayed manner.

The apparatus, in broad aspect, provides time-delayed injection of pressurized fluid through openings in a well casing section to a geological formation comprising:

- a housing with openings that can communicate through ports in the walls of the apparatus housing to a formation;
- a movable piston or pistons capable of moving into position to provide covering and sealing the port(s) and to a position where the ports are uncovered;
- means for moving the piston to a final position leaving the port(s) uncovered; and means for activation the movement of the piston.

The present invention represents several improvements over conventional pressure responsive devices improvements that will be appreciated by those of ordinary skills in the art of well completions. The greatest limitation of current devices is that the sleeve or power piston of the device that allows fluid to flow from the casing to a formation (through openings or ports in the apparatus wall) opens immediately after the actuation pressure is reached. This limits the test time at pressure and in many situations precludes the operator from ever reaching the desired casing test pressure. The present invention overcomes that limitation by providing a hydraulic delay to afford adequate time to test the casing at the required pressure and duration before allowing fluid communication with the well bore and geologic formation. This is accomplished by slowly releasing a trapped volume of fluid through a hydraulic metering chamber that allows a piston covering the openings to move to a position where the openings are uncovered. This feature will become even more advantageous as federal and state regulators mandate the duration or dwell time of the casing test pressure. The metering time can be increased or tailored to a specific test requirement through manipulation of the fluid type, fluid volume, by altering the flow rate of the hydraulic liquid flow restrictor and by appropriate placement and setting of pressure valves on either or both sides of the flow restrictor.

A second advantage of this invention is that two or more valves can be installed (run) as part of the same casing installation. This optional configuration of running two or more valves is made possible by the delay time that allows all of the valves to start metering before any of the valves are opened. The feature and option to run two or more valves in a single casing string increases the likelihood that the first stage of the well can be fracture stimulated without any well intervention whatsoever. Other known devices do not allow more than a single valve to operate in the same well since no further actuation pressure can be applied or increased after the first valve is opened.

A third significant advantage is that in the operation of the valve, the ports are opened slowly so that as the ports are opened (uncovered) the liquid is injected to the cement on the outside of the casing in a high pressure jet (resulting from the initial small opening of the ports), thus establishing better connection to the formation. As the ports are uncovered the fluid first jets as a highly effective pinpoint cutting jet and enlarges as the ports are opened to produce an effect of a guide-hole that is then enlarged.

Figure 1B:
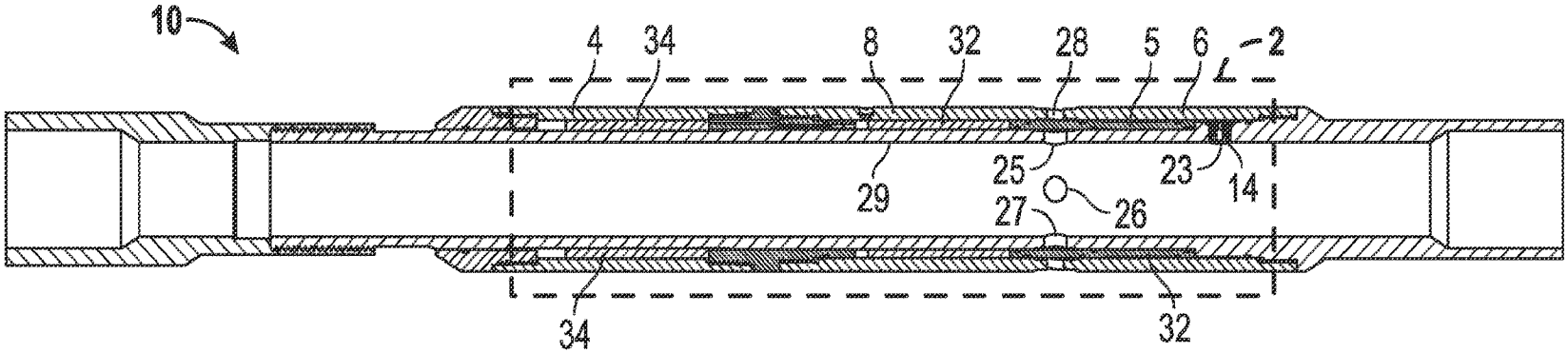
FIG. 1*b* is a plan view of a cross section of an apparatus of an embodiment of the invention.

Referring to the Figures, FIG. 1A represents a controlled time delay tool comprising an inner mandrel, 29, that is inserted directly into the casing string and shows an overall external view of an embodiment of the apparatus of the invention. Slotted ports 28 through which fluid will be transported into the geologic formation surrounding the casing. FIG. 1B shows a cross section view of the apparatus of FIG. 1A. The integral one-piece design of the mandrel carries all of the tensile, compressional and torsional loads encountered by the apparatus. The entire toe valve apparatus is piped into the casing string as an integral part of the string and positioned where perforation of the formation and fluid injection into a formation is desired. The apparatus may be installed in either direction with no change in its function.

Figure 2:
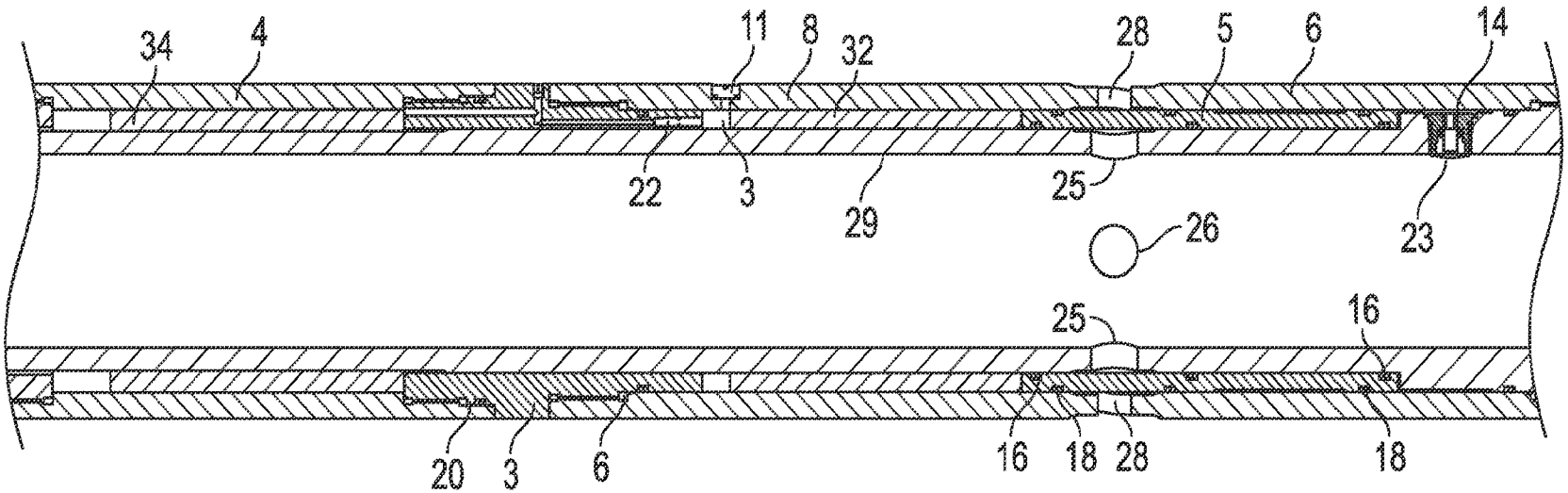
FIG. 2 is an exploded section view of the apparatus displayed in FIGS. 1*a* and 1*b* in which the ports are closed.

FIG. 2 (a section of FIG. 1B) shows details of the apparatus of an embodiment of the invention. A pressure activated opening device 23 preferably a Reverse Acting Disc but conventional rupture discs may be used for initiating a piston. Since the rupture disc is in place in the casing string during cementing it is very advantageous to have a reverse acting rupture disc that will not be easily clogged and not require extra cleaning effort. The valve mandrel is machined to accept the opening device 23 (such as rupture discs) that ultimately controls actuation of the piston, 5. The opening piston, 5, is sealed by elastomeric seals (16, 18 and 20 in FIG. 2 and 45, 47 and 49 in FIG. 6) to cover the inner and outer ports, 25-27 and 28, in the apparatus.

Figure 3:
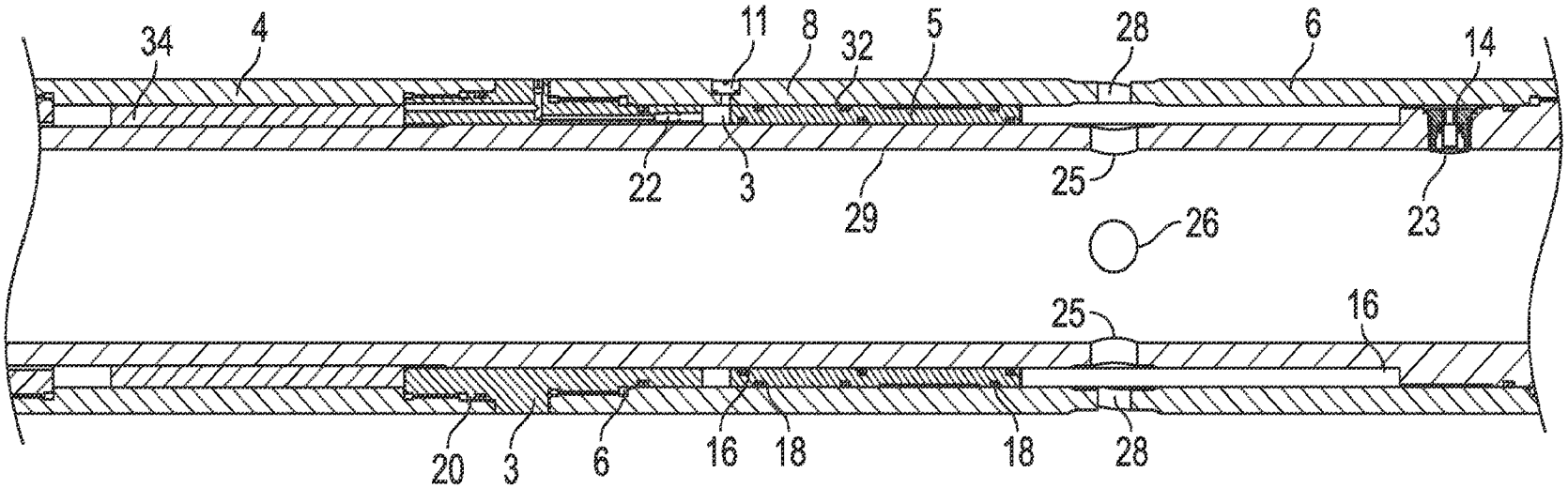
FIG. 3 is an exploded section view of the apparatus displayed in FIGS. 1*a* and 1*b* in which the ports are open.
Figure 4:
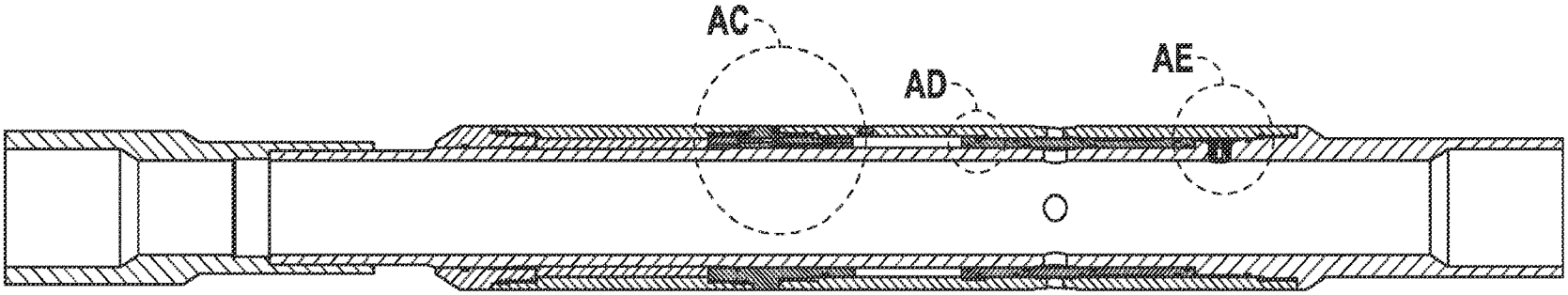
FIG. 4 is a plan view of an apparatus of an embodiment of the invention.
Figure 5:
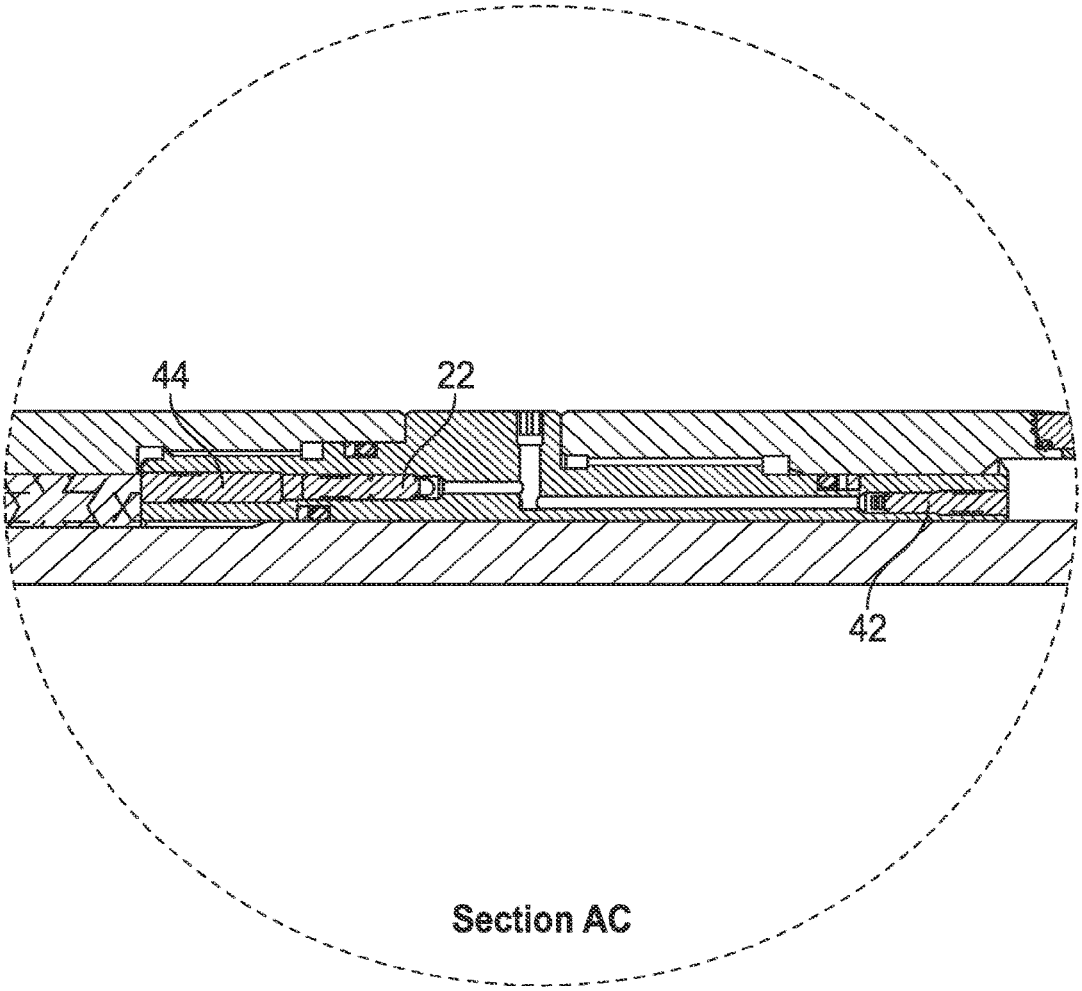
FIG. 5 is an exploded section view AE of a section of the apparatus of an embodiment of the invention displayed in FIG. 4.
Figure 7:
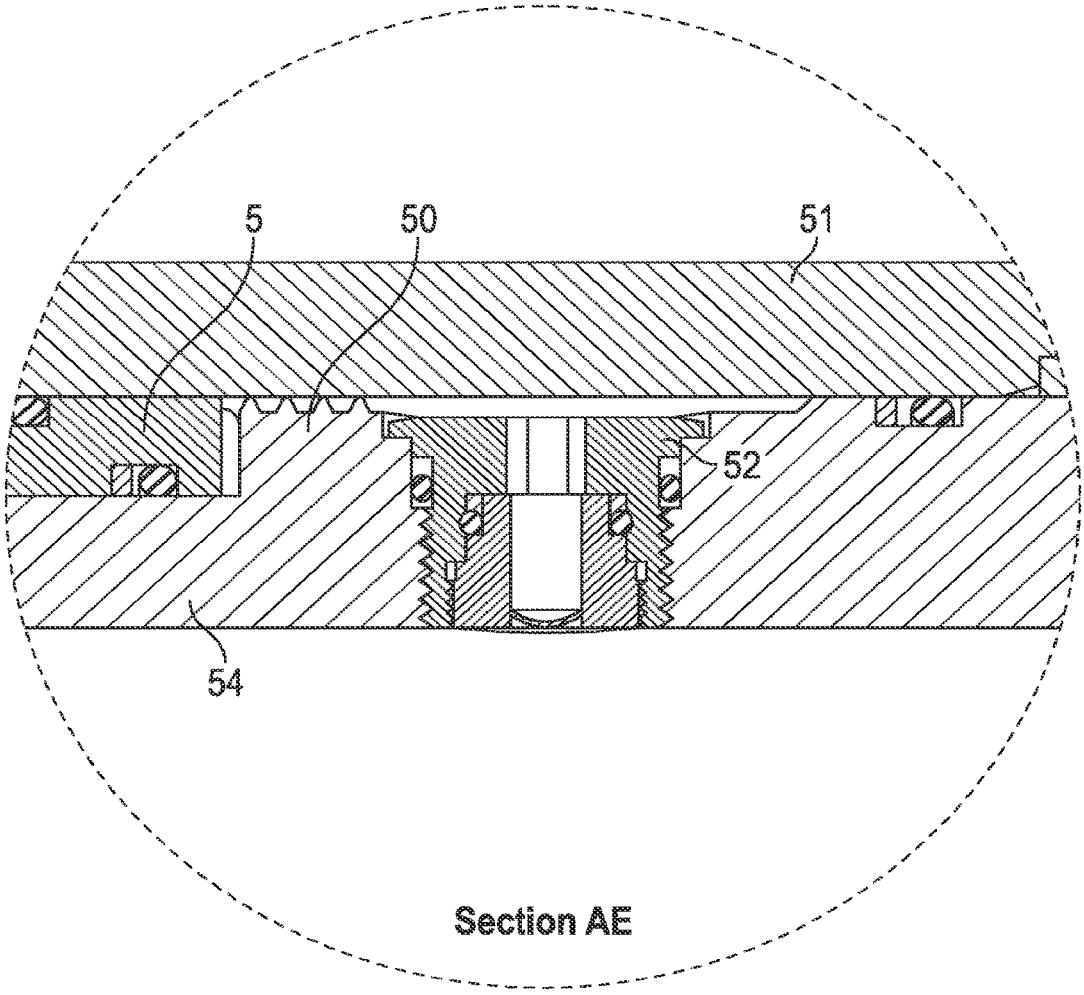
FIG. 7 is an exploded section view AD of a section of an embodiment of the invention the apparatus displayed in FIG. 4.

The openings 25-27 (and a fourth port not shown) shown in FIGS. 2 and 3 are open ports. In one embodiment the ports 25-27 (and other inside ports) will have means to restrict the rate of flow such as baffles (50 in FIG. 7) as, for example, with a baffle plate consisting of restrictive ports or a threaded and tortuous pathway, 50. This will impede rapid influx of well bore fluids through the rupture discs, 23 in FIG. 2 and 52 in FIG. 7 into the piston chamber 32. In FIG. 5, the mandrel housing 54 is similar to mandrel housing 5 in FIG. 2 and 52 is the rupture disc that corresponds to 23 in FIG. 2. The mandrel housing 51 which is same as mandrel housing 6.

Figure 6:
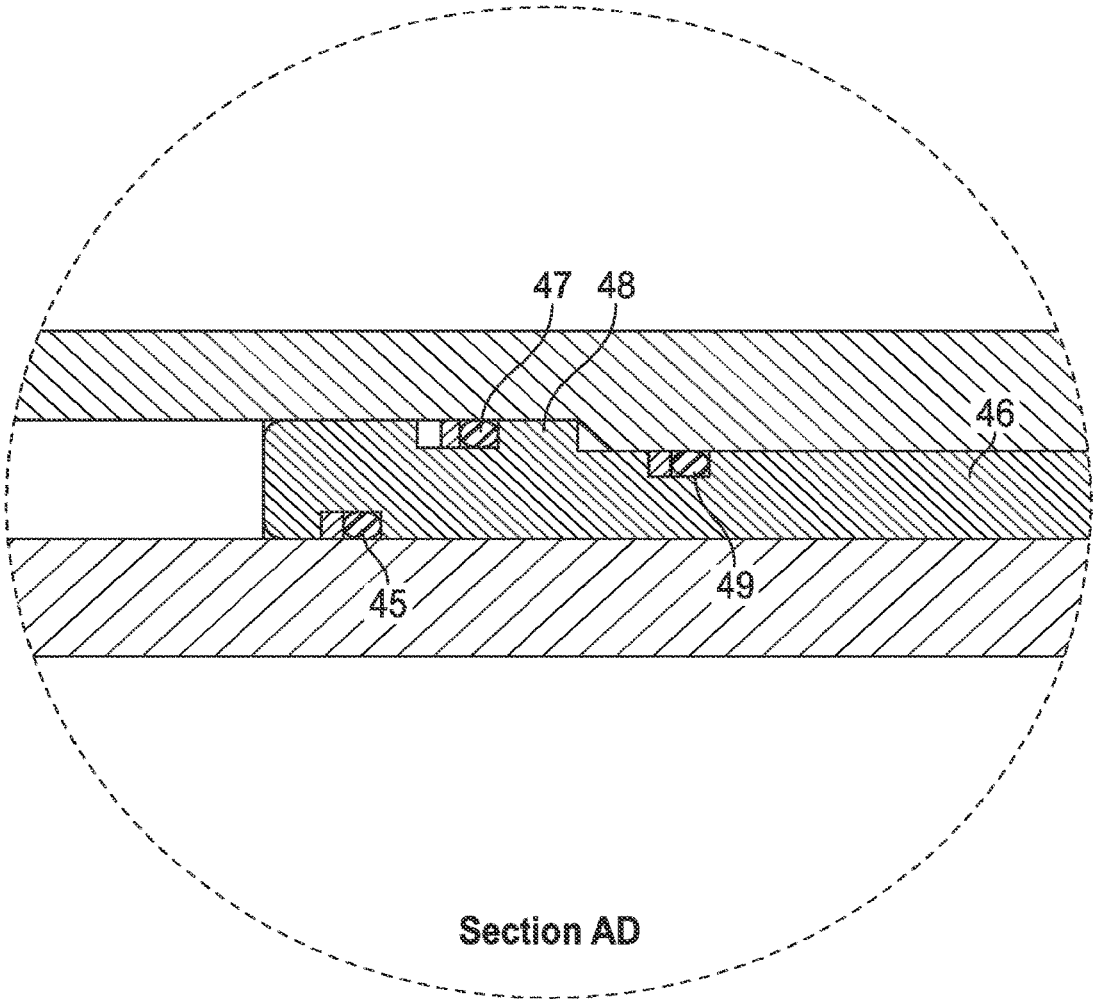
FIG. 6 is an exploded section view AC of a section of displayed in FIG. 4.

In one embodiment, the piston, 5, has dual diameters (FIG. 6 shows the piston, 5 (46 and 48), with one section, 46, having a smaller diameter at one end than at the other end, 48. This stepped diameter piston design will reduce the internal pressure required to balance out the pressure across the piston when the piston is subjected to casing pressure. This pressure reduction will increase the total delay time afforded by a specific restrictor. The resistance to flow of a particular restrictor is affected by the differential pressure across the component. By reducing the differential across the component, the rate of flow can be skillfully and predictably manipulated. This design provides increased delay and pressure test intervals without adding a larger fluid chamber to the apparatus. The dual diameter piston allows the pressure in the fluid chamber to be lowered. This has several advantages; in particular the delay time will be increased by virtue of the fact that the differential pressure across a given restrictor or metering device will be reduced. With a balanced piston area, the pressure in the fluid chamber will be at or near the well bore pressure. With the lower end of the piston 46 smaller and the piston area adjacent to the fluid chamber, 48, larger the forces will balance with a lower pressure in the fluid chamber. In this way it will be easy to reduce the fluid chamber pressure by 25% or more.

A series of outer sections 4, 6, and 8 illustrated in FIGS. 1A, 1B and 2 are threadedly connected to form the fluid and pressure chambers for the apparatus. The tandem, 3, not only couples outer section 4 and piston 5 but also houses a hydraulic restrictor 22. The area, 32, to the left of the piston, 5, is a fluid chamber and the area to the left of tandem 3 is the low pressure chamber that accommodates the fluid volume as it traverses across the hydraulic restrictor. The chambers are both capped by the upper cap 8.

The rupture disc 23 or 52 is the activation device that sets the valve opening operation into play. When ready to operate (i.e., open the piston), the casing pressure is increased to a test pressure condition. This increased pressure ruptures the rupture disc 23 or 52 and fluid at casing pressure (hydrostatic, applied or any combination) enters the chamber immediately below and adjacent to the piston 5 (in FIG. 2 this is shown at the right end of piston 5 and to the left of valve 14). This entry of fluid causes the piston 5 to begin moving (to the left in the drawings). This fluid movement allows the piston to move inexorably closer to an open position. In actual lab and field tests a piston movement of about 4.5 inches begins to uncover the inner openings 25-27 and the outer openings 28. These openings are initially closed or sealed off from the casing fluid by the piston 5. As piston 5 moves toward the open and final position, the slots, 28, are uncovered allowing fluid to flow through openings 25, 26 and 27 through slots 28. Thus, the restrained movement of the piston allows a time delay from the time the disc, 23 is ruptured until the slots uncovered for fluid to pass. This movement continues until the piston has moved to a position where the ports are fully opened. Piston 5 surrounds the inter wall of the apparatus 29. As fluid pressure increases through port 14 it moves piston 5 into the fluid chamber 32. Hydraulic fluid in the fluid chamber restrains the movement of the piston. There is a hydraulic flow restrictor 22 that allows fluid to pass from chamber 32 to lower pressure chamber 34. This flow restrictor controls the rate of flow of fluid from chamber 32 to chamber 34 and thereby controls the speed of the movement of the piston as it moves to the full open position. Slots 28 in the apparatus mandrel that will be the passageway for fluid from the casing to the formation. FIG. 3 shows the position of piston 5 when "opened" (moved into chamber 32). Initially, this movement increases pressure in the fluid chamber to a value that closely reflects the hydrostatic plus applied casing pressure. There is considerable predetermined control over the delay time by learned manipulation of the fluid type, fluid volume, initial charging pressure of the low pressure chamber and the variable flow rate through the hydraulic restrictor. The time delay can be set as desired but generally will be about 5 to 60 minutes. Any hydraulic fluid will be suitable if capable of withstanding the pressure and temperature conditions that exist in the well bore. Those skilled in the art will easily be able to select suitable fluids such as Skydrol 500B-4™.

In another embodiment there are added controls on the flow of fluid from the piston chamber 32 to the low pressure piston chamber 34 to more precisely regulate the speed at which the piston moves to open the ports. As illustrated in FIG. 5 (a sectional enlarged view of the section of the tool housing the flow restrictor that allows fluid to flow from the piston chamber 32 to the lower pressure chamber 34) there is a Back Pressure Valve or Pressure Relief Valve 42 placed downstream of the Flow Metering Section 22 to maintain a predetermined pressure in the Fluid Chamber. This improves tool reliability by reducing the differential pressure that exists between the Fluid Chamber 34 and the well bore pressure in the piston chamber 32. This Back Pressure Valve or Pressure Relief Valve 42 may be selected based on the anticipated hydrostatic pressure. Back pressure valve(s) may also be placed in series to increase the trapped pressure. Another Back Pressure Valve or Pressure Relief Valve 44 may be placed downstream of the Fluid Metering Section 22 to ensure that only a minimum fluid volume can migrate from the Fluid Metering Section 22 to the Low Pressure Chamber 34 during transport, when deployed in a horizontal well bore or when inverted for an extended period of time. By selecting the appropriate pressure setting of these back pressure valves "slamming" (forceful opening by sudden onrush of pressurized fluid) of the flow control valve is reduced.

In operation an apparatus of the invention will be piped into a casing string at a location that will allow fluid injection into the formation where desired. The apparatus may be inserted into the string an either direction. An advantage of the present invention is that two or more of the valves of the invention may be used in the string. They will, as explained above, open to allow injection of fluid at multiple locations in the formation. It can also be appreciated by those skilled in the art how two or more of valves of the invention may be used and programmed at different time delays to open during different stages of well operations as desired (e.g. one or more at 5 minute delay and one or more at 20 minutes delay). For example, the apparatus may be configured so that an operator may open one or more valves (activating the sliding closure) after a five minute delay, fracture the zone at the point of the open valves, then have one or more valves and continue to fractures the zone.

In general the apparatus will be constructed of steel having properties similar to the well casing.

A prototype apparatus had the general dimensions of about 60 inches in length, with a nominal outside diameter of 6.5 inches and an inside diameter of 3.75 inches. Other dimensions as appropriate for the well and operation in which the apparatus is intended to be used are intended to be included in the invention and may easily be determined by those of ordinary skill in the art.

Figure 8:
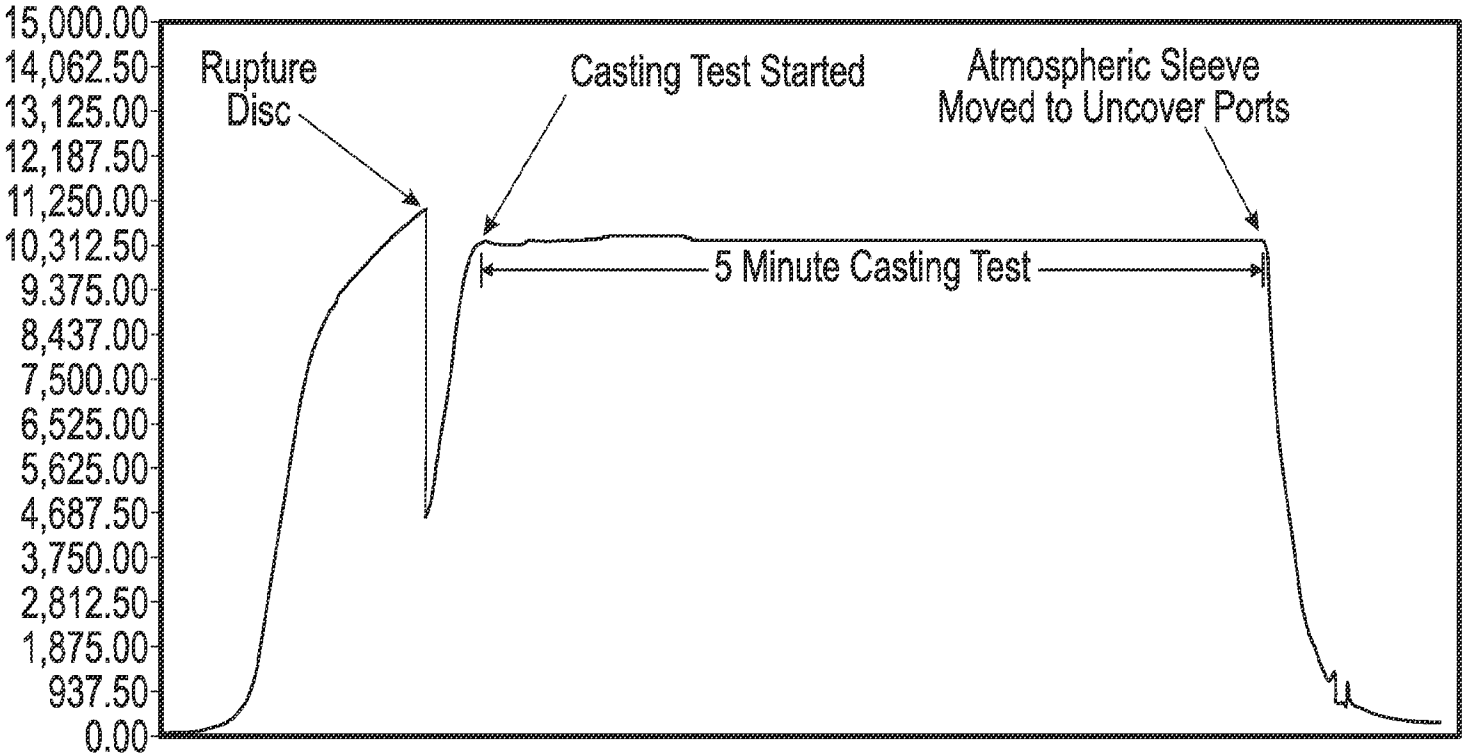
FIG. 8 is a graphic representation of results of a test of the operation of an apparatus of an embodiment of the invention.

FIG. 8 represents the results of a test of a prototype of the apparatus. As shown, a 5-minute test shows constant pressure for 5 minutes while the piston movement uncovered openings in the apparatus.

In the foregoing specification, the invention has been described with reference to specific embodiments thereof. It will, however, be evident that various modifications and changes can be made thereto without departing from the broader spirit and scope of the invention as set forth in the appended claims. The specification is, accordingly, to be regarded in an illustrative rather than a restrictive sense. Therefore, the scope of the invention should be limited only by the appended claims.

Preferred Exemplary Controlled Time Delay Apparatus with Stacked Delay Restrictor (0900-0940)

Figures 9A, 9B:
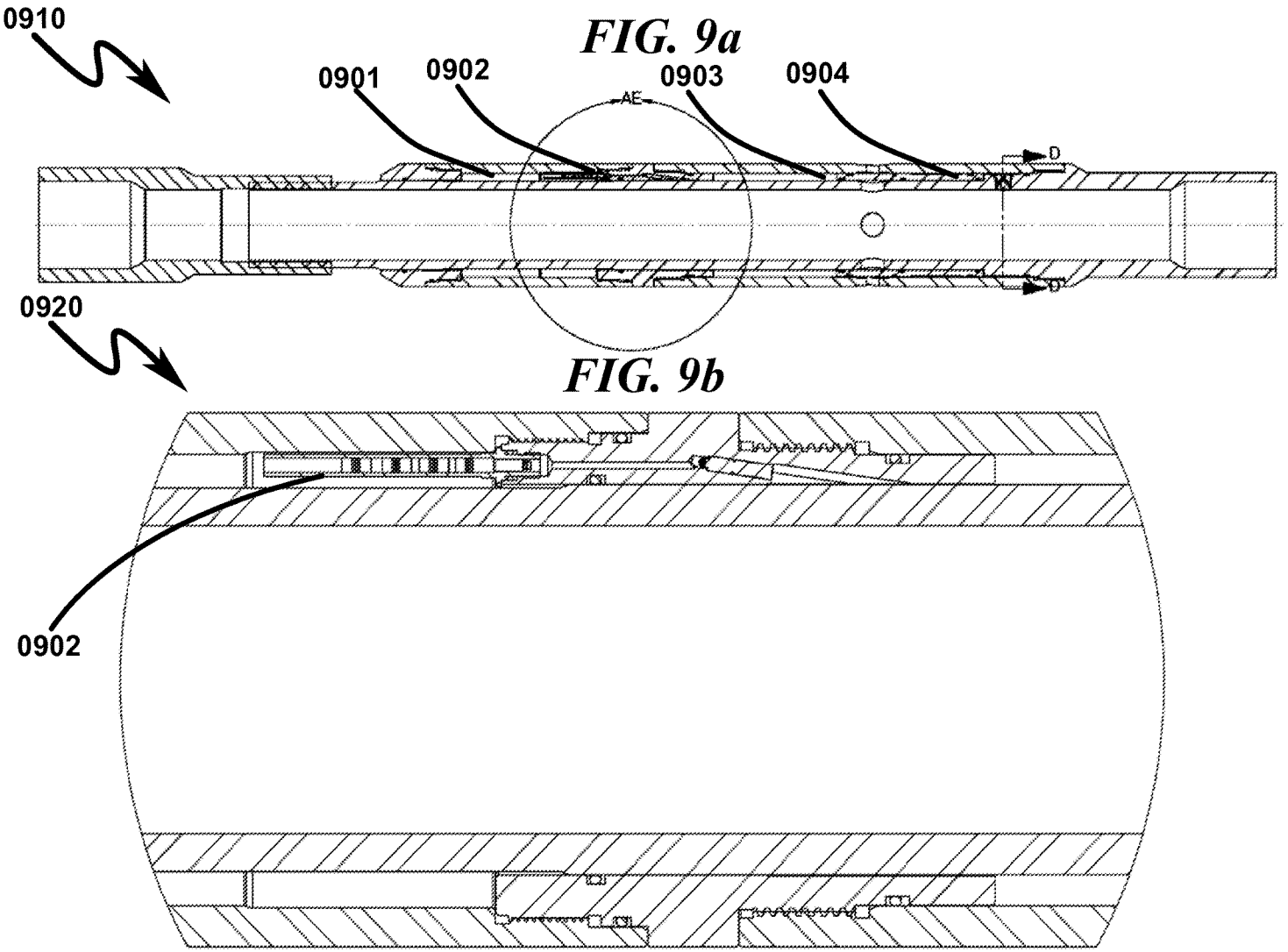
FIG. 9*a* and FIG. 9*b* illustrate an exemplary controlled time delay apparatus with stacked delay elements arranged in series in a restrictor according to a preferred embodiment of the present invention.
Figure 9C:
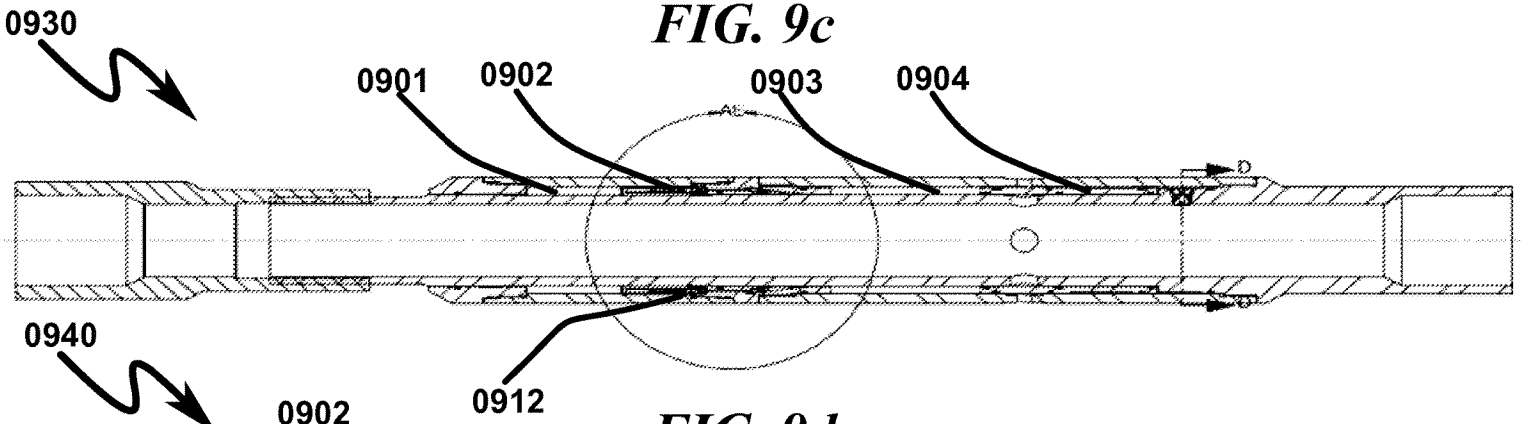
FIG. 9*c* and FIG. 9*d* illustrate an exemplary controlled time delay apparatus with stacked delay elements arranged in series and parallel combination in a restrictor according to a preferred embodiment of the present invention.
Figure 9D:
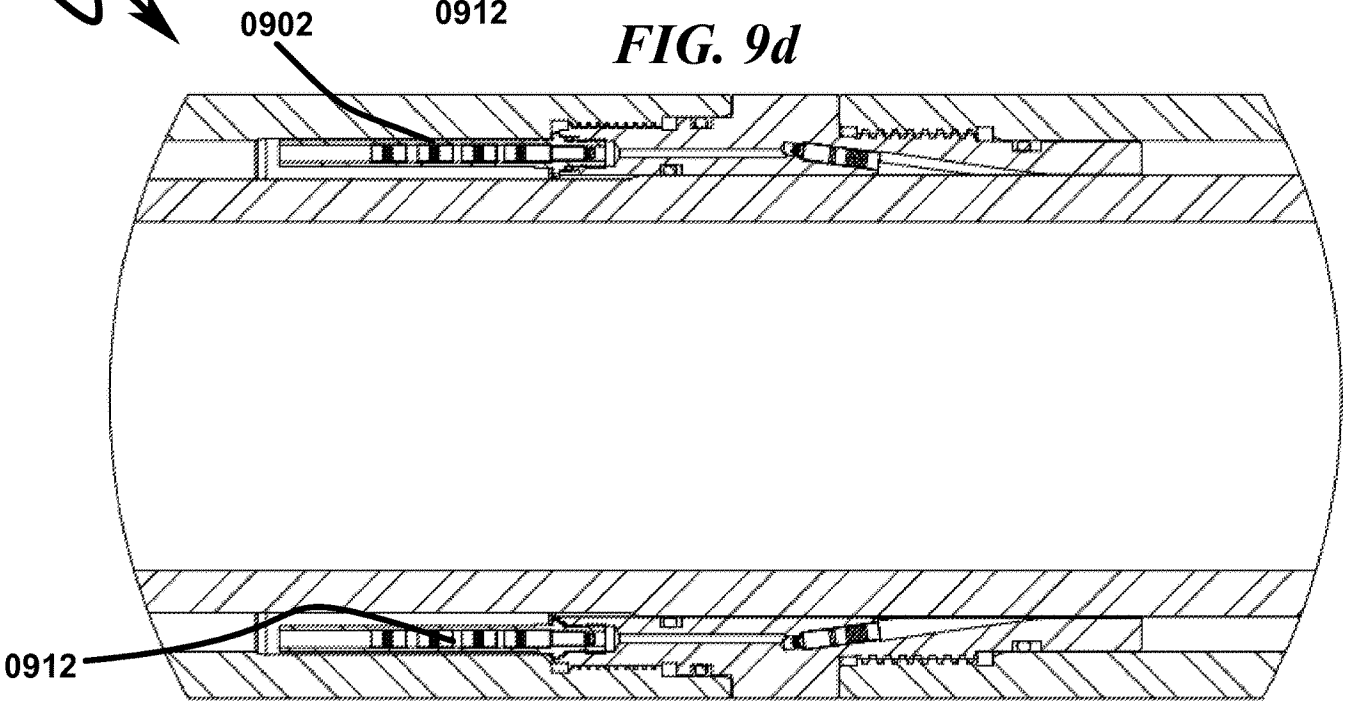

The present invention is generally illustrated in more detail in FIG. 9*a* (0910) wherein a controlled time delay apparatus with a stacked delay restrictor is integrated and conveyed with a wellbore casing. An expanded view of the stacked delay restrictor is further illustrated in FIG. 9*b* (0920). The apparatus may comprise a piston that moves from a high pressure chamber to a low pressure chamber, when actuated. The stacked delay restrictor (0902) is in communication with a high pressure chamber (0903), may comprise multiple stacked delay elements connected in a series, parallel or combination thereof. The delay element may be a conventional hydraulic restrictor such as a Visco-Jet™. The stacked delay restrictor allows fluid to pass from a high pressure chamber (0903) to lower pressure chamber (0901). This flow restrictor controls the rate of flow of fluid from the high pressure chamber (0903) to the low chamber (0901) and thereby controls the speed of the movement of the piston (0904) as it moves to the full open position. The number of delay elements may be customized to achieve a desired time delay for the piston to travel from a closed position to open an opening in housing of the apparatus. According to another preferred exemplary embodiment, the delay elements are connected in a parallel fashion as illustrated in FIG. 9*c* (0930). An expanded view of the stacked delay restrictor with parallel delay elements (0902, 0912) is further illustrated in FIG. 9*d* (0940). According to yet another preferred exemplary embodiment, the delay elements are connected in a series and parallel combination. According to a preferred exemplary embodiment, a time delay is greater than 60 minutes and less than 2 weeks. The time delay may be controlled by manipulating the fluid type fluid volume in the delay elements, initial charging pressure of the low pressure chamber and the variable flow rate through the hydraulic restrictor. According to yet another exemplary embodiment, the hydraulic fluid is solid at the surface that changes phase to liquid when in operation as a toe valve in the wellbore casing. Any hydraulic fluid will be suitable if capable of withstanding the pressure and temperature conditions that exist in the well bore. The viscosity of the hydraulic fluid may range from 3 centistokes to 10,000 centistokes. According to a further exemplary embodiment, the time delay in the restrictor may be increased by addition of plugging agents. The size and shape of the plugging agents may be designed to effect a longer or shorter time delay. For example, larger particle size plugging agents may delay the rate of travel of a piston as compared to smaller size plugging agents.

According to yet another preferred exemplary embodiment, the delay elements may be designed as a cartridge that may be slide in and out of the restrictor. The cartridge may have a form factor that is compatible with the restrictor. According to a preferred exemplary embodiment, the cartridge may be positioned and customized to achieve a desired time delay.

Preferred Exemplary ID/OD Controlled Time Delay Ratio

Table 1.0 illustrates an exemplary ratio of inner diameter (ID) to outer diameter (OD) in an exemplary controlled time delay apparatus. According to a preferred exemplary embodiment the ratio of ID/OD ranges from 0.4 to 0.99. According to a preferred exemplary embodiment, a full bore version wherein the inner diameter of the apparatus is almost equal to the inner diameter of the wellbore casing enables substantially more fluid flow during production. Table 2.0 illustrate the inner casing ID and outer casing ID corresponding to the Name column of Table 1.0. For example, a name of 4½ refers to a casing OD of 4.5 in table 2.0.

TABLE 1.0

| Name | Outer Diameter (in) | Inner Diameter (in) |
|---|---|---|
| 4½ | 5.65 | 3.34 |
| 5 | 5.65 | 3.34 |
| 5½ | 6.88 | 3.75 |
| 4½ Full Bore | x | x |
| 5½ Full Bore | 7.38 | 4.6 |

TABLE 2.0

| Casing OD (in) | Casing Weight (lb/ft) | Casing ID (in) |
|---|---|---|
| 4.5 | 13.50 | 3.03 |
| 4.5 | 11.60 | 3.11 |
| 5.5 | 23.00 | 3.78 |
| 5.5 | 20.00 | 3.90 |
| 5.5 | 17.00 | 4.03 |

According to a preferred exemplary embodiment, an inner tool diameter and an inner casing diameter ratio ranges from 0.4 to 1.1.

Preferred Exemplary Section of a Controlled Toe Valve Apparatus Illustrating Port Closed Time, Actuation Time Period and Port Open Time Interval (1000-1030)

Figure 10A:
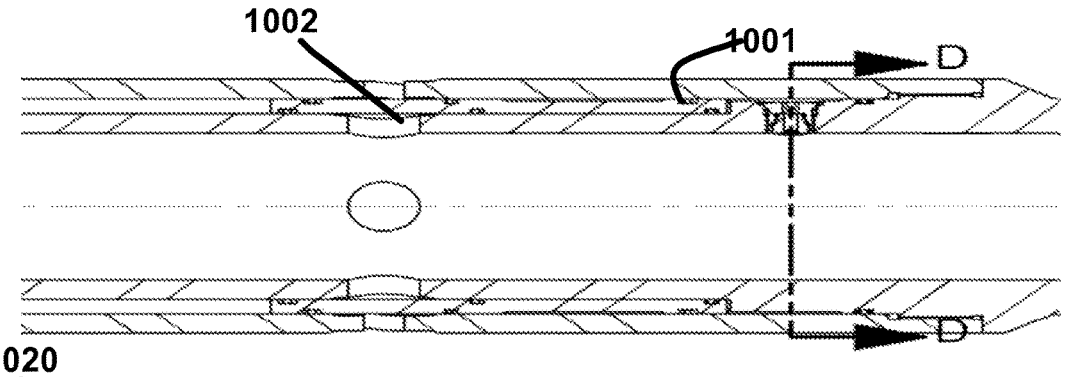
FIG. 10*a*, FIG. 10*b*, FIG. 10*c* are exemplary cross sections of a controlled time delay apparatus illustrating closed time, actuation time and port open time according to a preferred embodiment of the present invention.

Port Closed Time (1010):

As generally illustrated in FIG. 10*a* (1010), when ready to operate, the casing pressure is increased to a test pressure condition. The piston (1001) is held in its place while the piston covers the openings (1002) in the housing of the controlled time delay apparatus. The piston (1001) remains in place until an actuation event takes place. The time the piston remains in a static position between a pressure ramp-up event to just before an actuation event may be considered a port closed time.

Figure 10B:
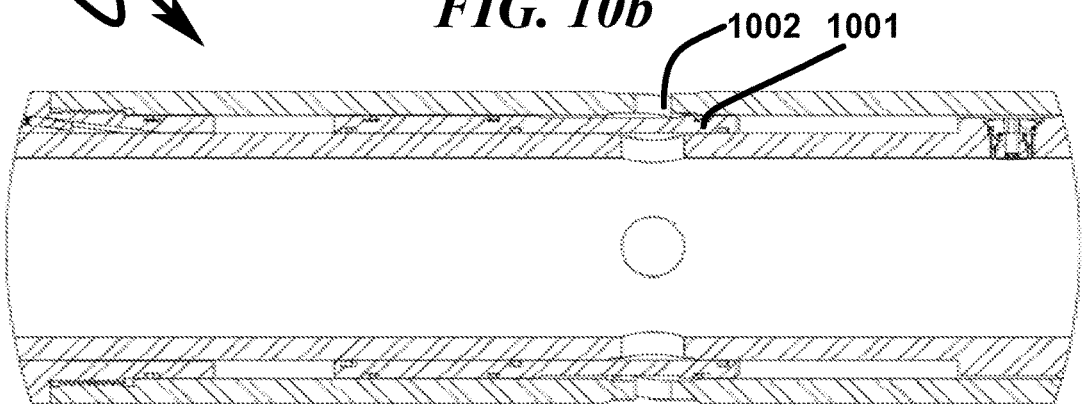

Port Actuation Time Period (1020):

As generally illustrated in FIG. 10*b* (1020), when ready to operate, the casing pressure is increased to a test pressure condition which is generally the maximum pressure that a well casing is designed to operate. When the casing pressure increases beyond an actuation pressure of a pressure actuation device, the increased pressure ruptures a pressure actuation device such as a rupture disc and fluid at casing pressure enters the chamber immediately below and adjacent to the piston (1001) into a high pressure chamber. This fluid movement allows the piston to move inexorably closer to an open position. The piston moves toward the openings in the housing of the apparatus. The time the piston travels after an actuation event to just before uncovering a port may be considered actuation time period. The restrained movement of the piston (1001) allows a time delay from the time the pressure actuation device is ruptured until the openings ("slots") (1002) uncovered for fluid to pass. This movement continues until the piston has moved to a position where the ports are almost open to fully open. Hydraulic fluid in the fluid chamber restrains the movement of the piston. A stacked delay restrictor or a restriction element such as a ViscoJet™ may control the rate of flow of fluid from a high pressure chamber to a low pressure chamber and thereby control the speed of the movement of the piston as it moves to a full open position.

Figure 10C:
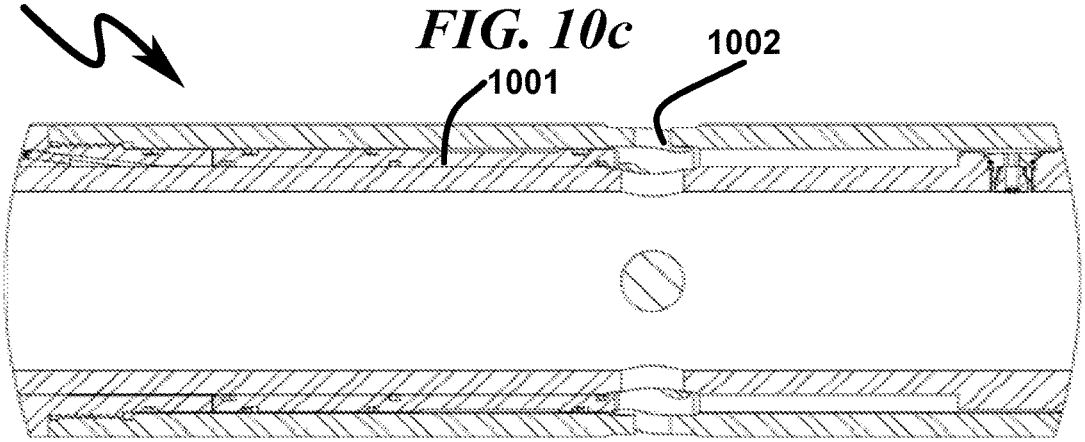

Port Open Time Interval (1030):

As generally illustrated in FIG. 10*c* (1030), as the piston (1001) moves toward the fully open and final position, the openings (1002) in the housing are uncovered allowing fluid to flow through the ports in the mandrel. This movement continues until the piston has moved to a position where the openings are fully uncovered. The time the piston travels from a position (1001) just before uncovering the openings (1002) to fully uncovering the openings (1002) may be considered port opening time interval.

Preferred Exemplary Chart of a Pressure Casing Test with a Controlled Time Delay Toe Valve Apparatus (1100-1190)

Figure 11A:
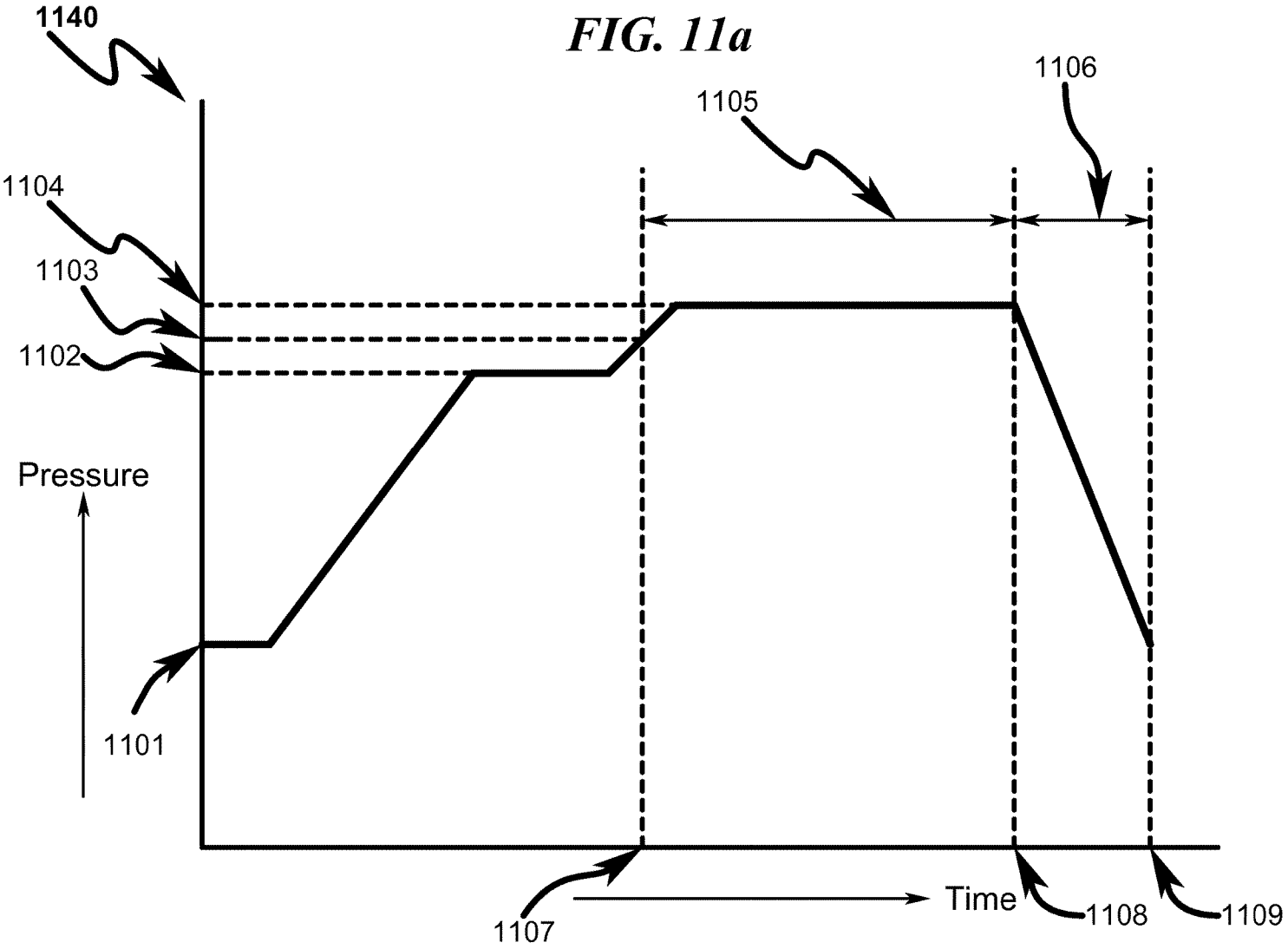
FIG. 11*a* is an exemplary chart for a casing pressure test with a controlled toe valve apparatus illustrating delayed actuation time and port open time according to a preferred embodiment of the present invention.

FIG. 11*a* (1140) illustrates an exemplary pressure test with a controlled time delay toe valve apparatus. The chart shows the pressure in the casing on the Y-axis plotted against time on the X-axis. The pressure in the casing may be increased from an initial pressure (1101) to 80% of the maximum test pressure (1102). A pressure actuating device such as a reverse acting rupture disk may rupture at 80-90% of the test pressure (1103) at time (1107). The piston may be actuated then and begin to move as the pressure is further increased to max casing pressure (1104). The actuation time period may be defined as the time taken by the piston to travel when the piston is actuated to the time the piston starts uncovering the housing openings. For example, as illustrated in FIG. 11*a* (1140), the time of travel of the piston from time (1107) to time (1108) is the actuation time (1105). When the piston starts to uncover the openings of the housing, the ports in the mandrel align with the openings as the piston moves slowly in a controlled manner. The port opening time interval may be defined as the time taken by the piston to start opening the openings to completely open the openings. For example, as illustrated in FIG. 11*a* (1140), the time of travel of the piston from time (1108) to time (1109) is the port opening time (1106). During the port opening time, the pressure in the casing may drop to the hydrocarbon formation pressure as the connection to the formation is complete. According to a preferred exemplary embodiment, the piston moves past the housing openings slowly in a controlled manner resulting in a jetting action for connection of the pressurized fluid to the formation. The port opening time and the actuation time may be controlled by various factors including size of the high pressure chamber, hydraulic restrictor fluid, length of the hydraulic restrictor, plugging agents and design of the hydraulic restrictor. The diameter of the plugging agent may range from 1 micron to 50 microns.

According to a preferred exemplary embodiment, the port opening time interval may range from 1 second to 1 hour. According to a more preferred exemplary embodiment the port opening time interval may range from 0.5 second to 20 minutes. According to another preferred exemplary embodiment, the port opening time interval is almost 0 seconds.

Figure 11B:
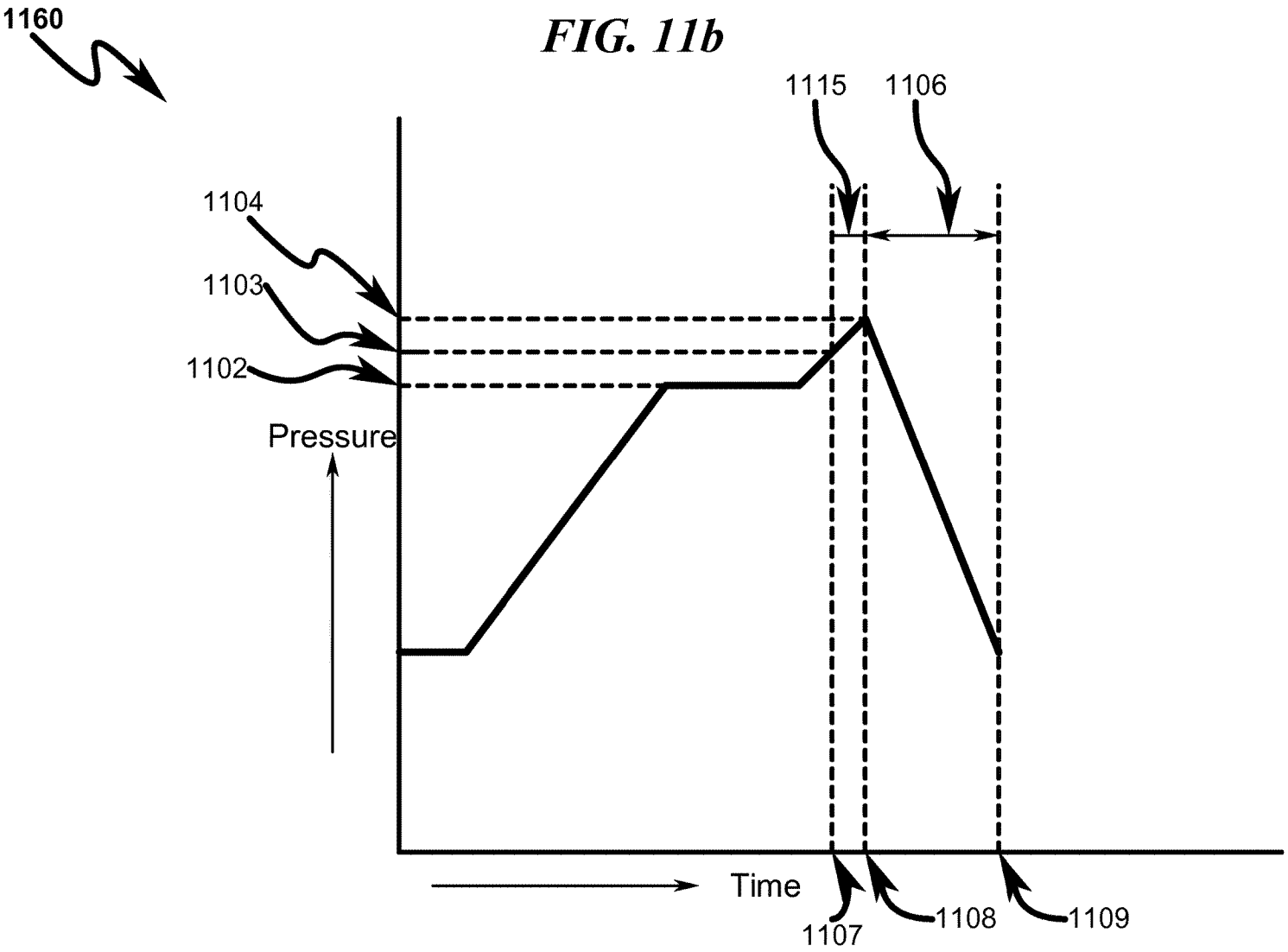
FIG. 11*b* is an exemplary chart for a casing pressure test with a controlled toe valve apparatus illustrating instant actuation time and port open time according to a preferred embodiment of the present invention.

Similar to the chart in FIG. 11*a* (1140), a chart illustrating an instant open is generally illustrated in FIG. 11*b* (1160) wherein the piston make a connection to the formation instantaneously in a controlled manner. The port actuation time period (1115) is relatively short and controlled as compared to the port actuation time period (1105) in FIG. 11*a* (1140). According to a preferred exemplary embodiment, the port actuation time period ranges from 0.5 seconds to less than 5 minutes. According to a more preferred exemplary embodiment, the port actuation time period is almost zero or instantaneous. According to another preferred exemplary embodiment, the port actuation time period ranges from 60 minutes to less than 2 weeks. The time delay or the actuation time period may be controlled by factors such as shorter hydraulic restrictor length, lower viscosity hydraulic restrictor fluid, and shorter high pressure chamber. To an operator controlling the fluid pressure from the surface, it would appear that the connection to the formation occurred instantaneously as the pressure response is too quick to detect. In this case, the connection to the subterranean formation occurs instantaneously in a controlled manner as compared to prior art methods wherein the piston is slammed to open the ports to the formation. According to a preferred exemplary embodiment, the apparatus makes connection to the formation instantaneously in a controlled manner.

Preferred Exemplary Reverse Acting Rupture Disk (1200-1220)

Figure 12B:
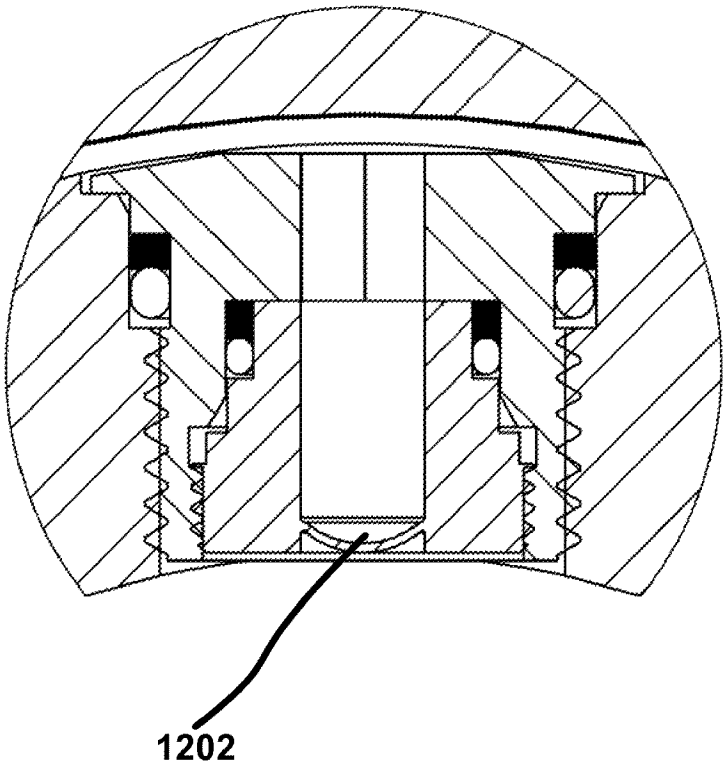
FIG. 12*b* illustrates an exemplary system cross section of a reverse acting rupture disk for use in a controlled time delay apparatus according to a preferred embodiment of the present invention.
Figure 12A:
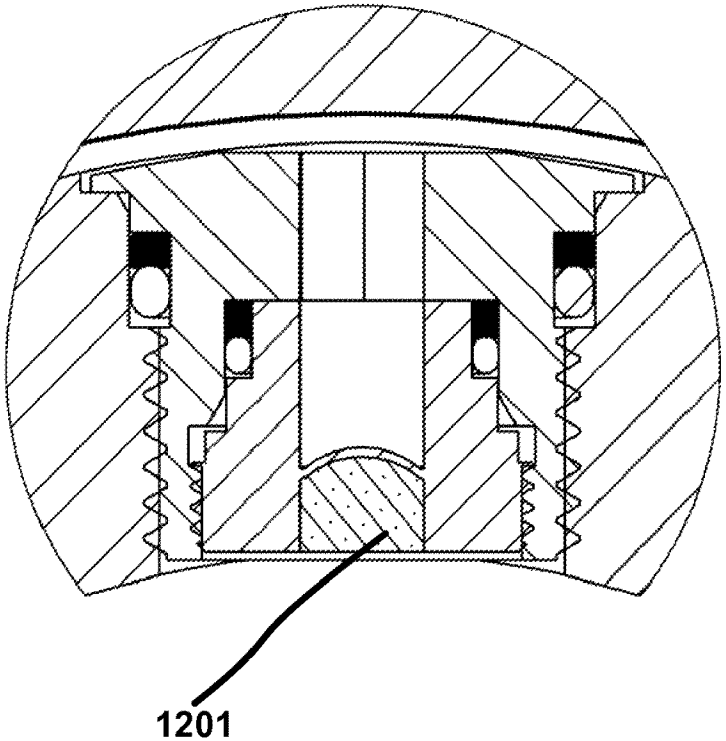
FIG. 12a Prior Art
FIG. 12*a* illustrates a prior art system cross section of a rupture disk.

As generally illustrated in FIG. 12*a* (1210) a prior art rupture disk is prone to plugging with cement and other debris (1201). The plugging of the rupture disk (1210) may fluctuate the actuation pressure at which the rupture disk ruptures and may prevent actuation of the device. Therefore, there is a need for a rupture disk that functions as rated without plugging. As generally illustrated in FIG. 12*b* (1220) an exemplary reverse acting rupture disk may be used in a controlled time delay apparatus as a pressure actuating device. The reverse acting rupture disk (1202) has the unique advantage of not getting plugged during cementing and other wellbore operations. This advantage results in the rupture disk to function as it is rated when compared to a conventional forward acting rupture disk which is susceptible to plugging.

Preferred Exemplary Controlled Time Delay Apparatus with Mandrel Ports and Housing Opening Shapes (1300-1500)

Figure 13:
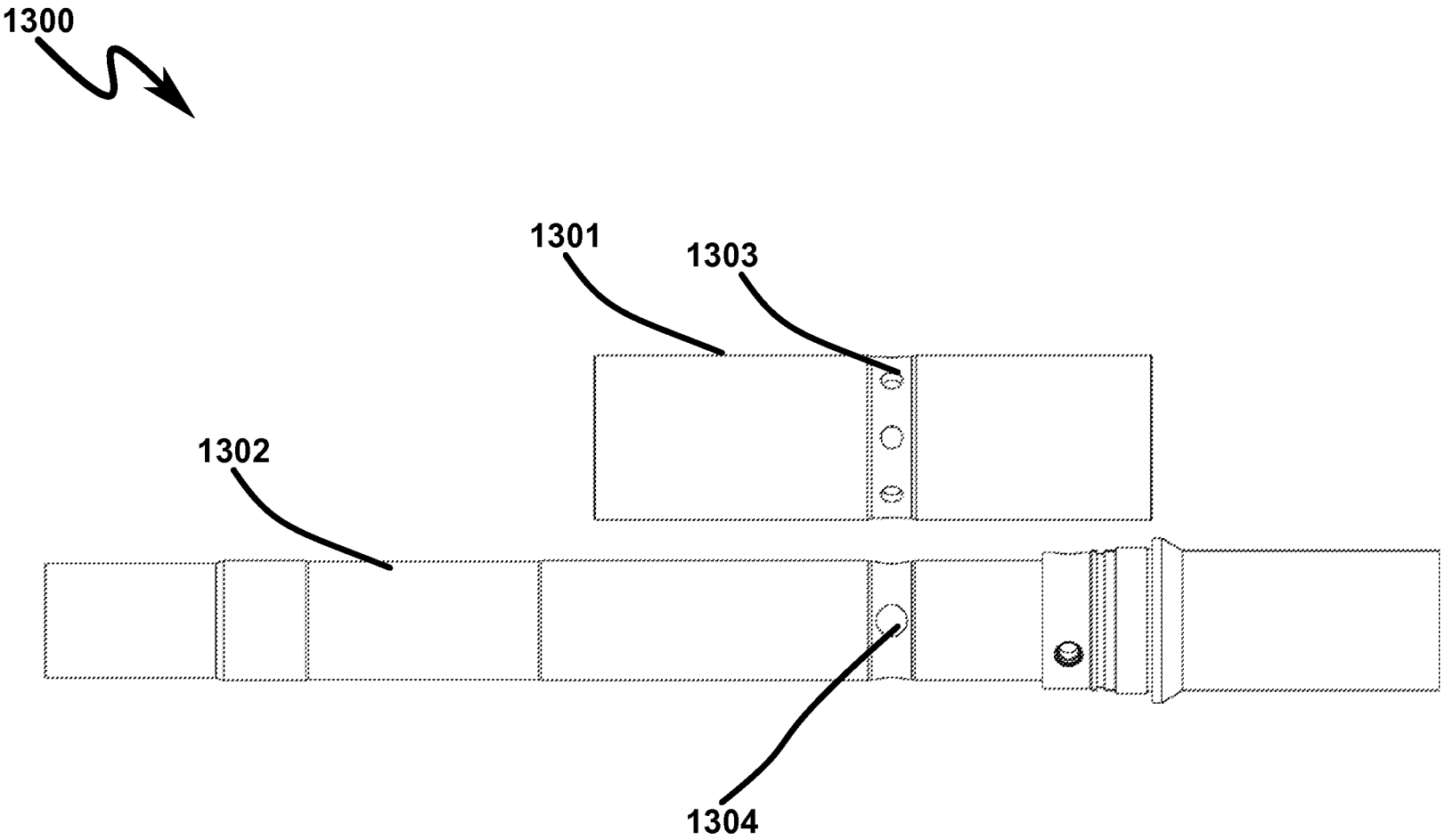
FIG. 13 illustrates an exemplary system cross section of a circular shaped housing opening and a circular shaped mandrel port in a toe valve to produce a jetting action according to a preferred embodiment of the present invention.
Figure 14:
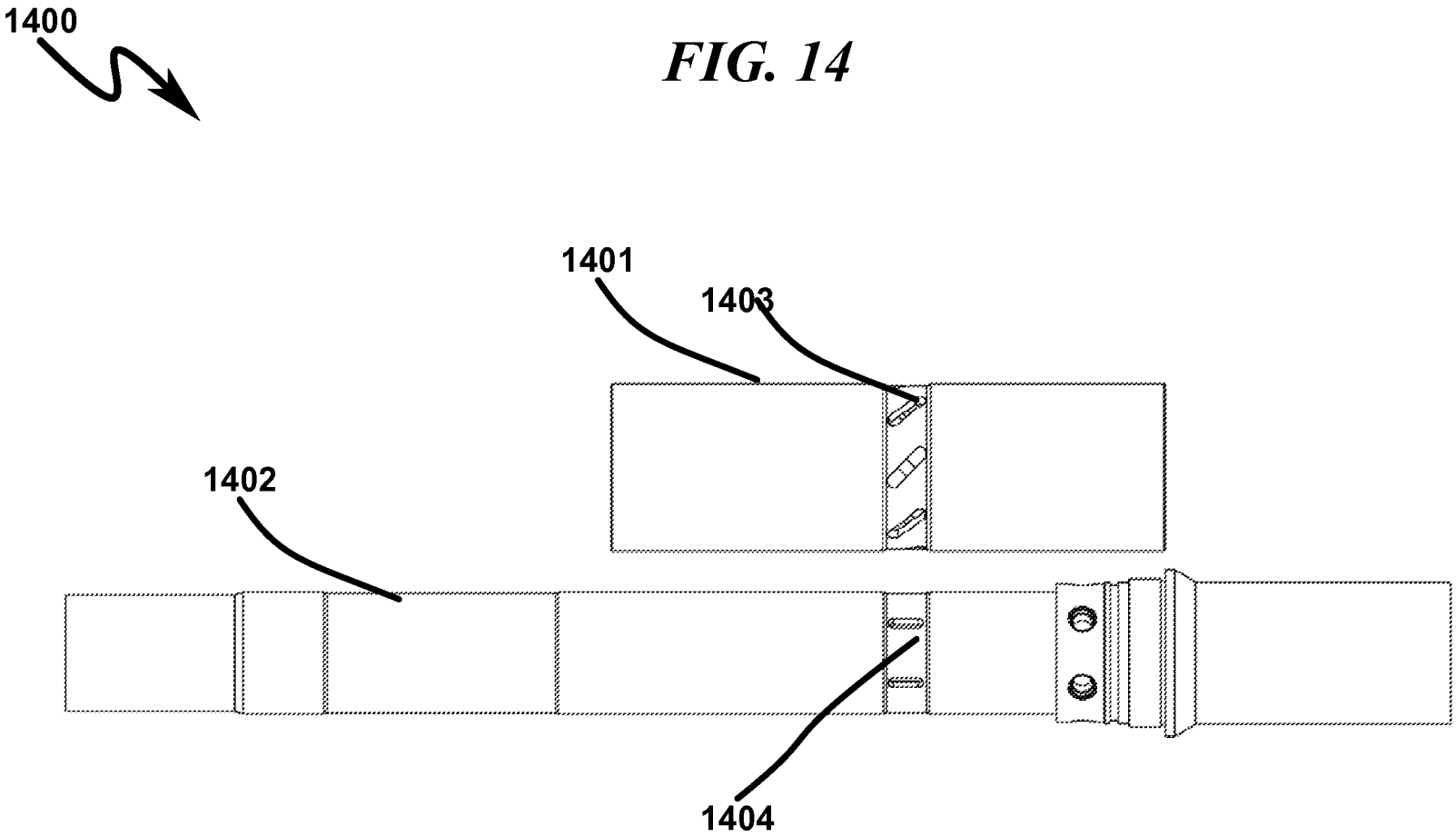
FIG. 14 illustrates an exemplary system cross section of an oval shaped housing opening and an oval shaped mandrel port in a toe valve to produce a jetting action according to a preferred embodiment of the present invention.
Figures 15A, 15B:
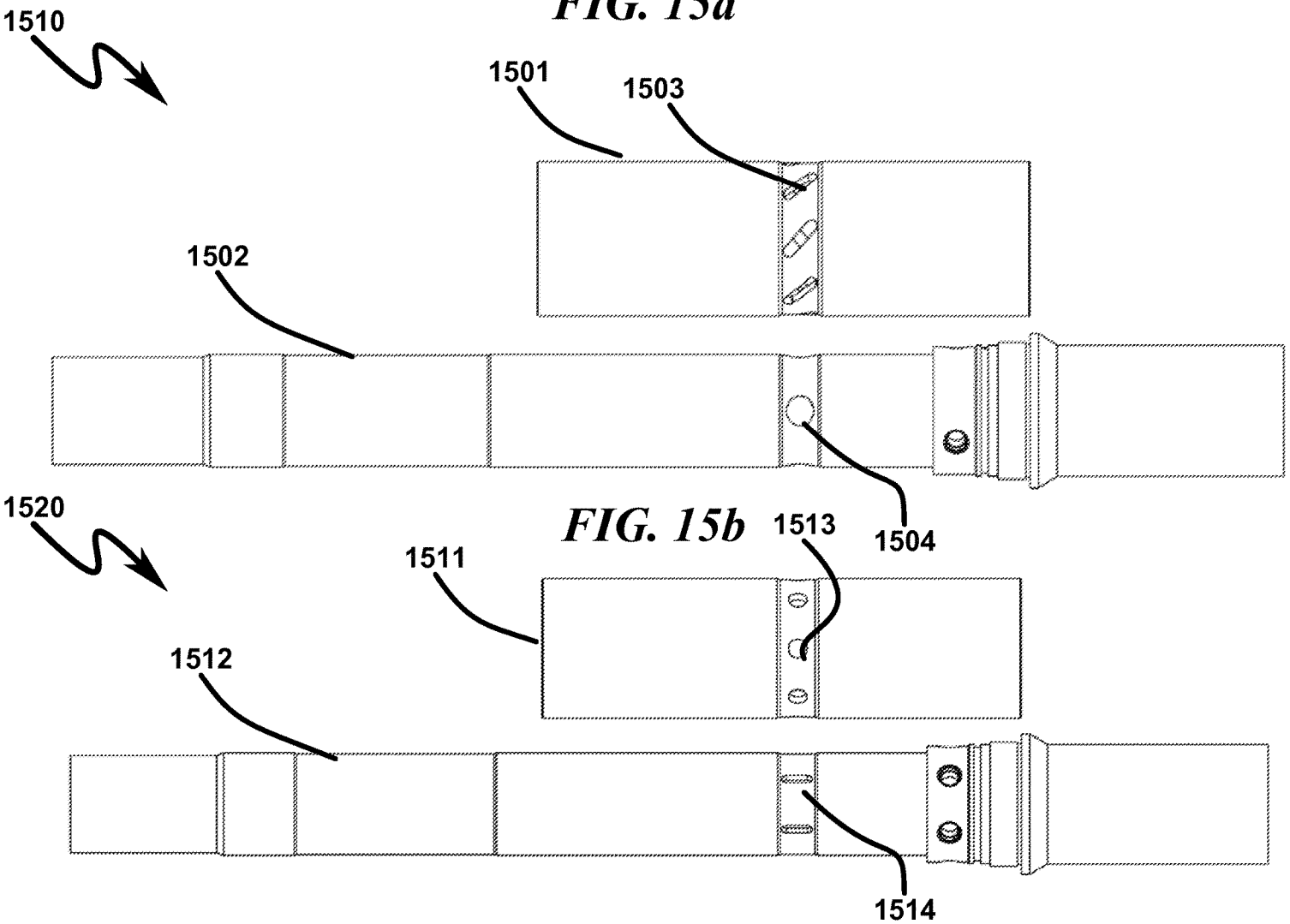
FIG. 15*a* illustrates an exemplary system cross section of an oval shaped housing opening and a circular shaped mandrel port in a toe valve to produce a jetting action according to a preferred embodiment of the present invention.
FIG. 15*b* illustrates an exemplary system cross section of a circular shaped housing opening and an oval shaped mandrel port in a toe valve to produce a jetting action according to a preferred embodiment of the present invention.

FIG. 13 (1300), FIG. 14 (1400), FIG. 15*a* (1510), and FIG. 15*b* (1520) generally illustrate a jetting action of pressurized fluid from the wellbore casing to the hydrocarbon formation. As the piston moves slowly across the openings in the housing of the toe valve uncovering the openings in the housing, the ports in the mandrel align with the openings to produce a guided hole jet effect of the pressurized fluid through the openings. The shape of the guided hole jet depends on the shape of the port in the piston and shape of the opening in the housing. The valve may open at maximum pressure and an initial restricted flow area, which increases to maximum design flow area over time as the piston moves slowly across. According to a preferred exemplary embodiment, the shape of the port in the mandrel may be selected from a group comprising a circle, oval and a square. According to another preferred exemplary embodiment, the shape of the opening in the housing may be selected from a group comprising a circle, oval and a square.

FIG. 13 (1300) illustrates a jet that may be formed with a circle shaped opening (1303) in the housing and a circle shaped port (1304) in the mandrel (1302) when a piston uncovers the openings in the housing (1301). Similarly, FIG. 14 (1400) illustrates a jet that may be formed with an oval shaped opening (1403) in the housing and an oval shaped port (1404) in the mandrel (1402) when a piston uncovers the openings in the housing (1401). Likewise, FIG. 15*a* (1510) illustrates a jet that may be formed with an oval shaped opening (1503) in the housing and a circle shaped port (1504) in the mandrel (1502) when a piston uncovers the openings in the housing (1501). Also, FIG. 15*b* (1520) illustrates a jet that may be formed with a circle shaped opening (1513) in the housing and an oval shaped port (1514) in the mandrel (1512) when a piston uncovers the openings in the housing (1511).

A constant width slot or variable width slot such as a tear drop may also be used as an opening in the housing or a port in the mandrel. Any shape that is constant width as the piston travels may be used as an opening in the housing or a port in the mandrel. Similarly, a shape such as a tear drop that may become wider or narrower as the piston moves past the openings and the ports may be used as an opening in the housing or a port in the mandrel. The flow area of the inner mandrel may be designed for limited entry applications so that flow is diverted to multiple injection points at high enough flow rate.

Preferred Exemplary Flowchart of a Controlled Time Delay Apparatus (1600)

Figure 16:
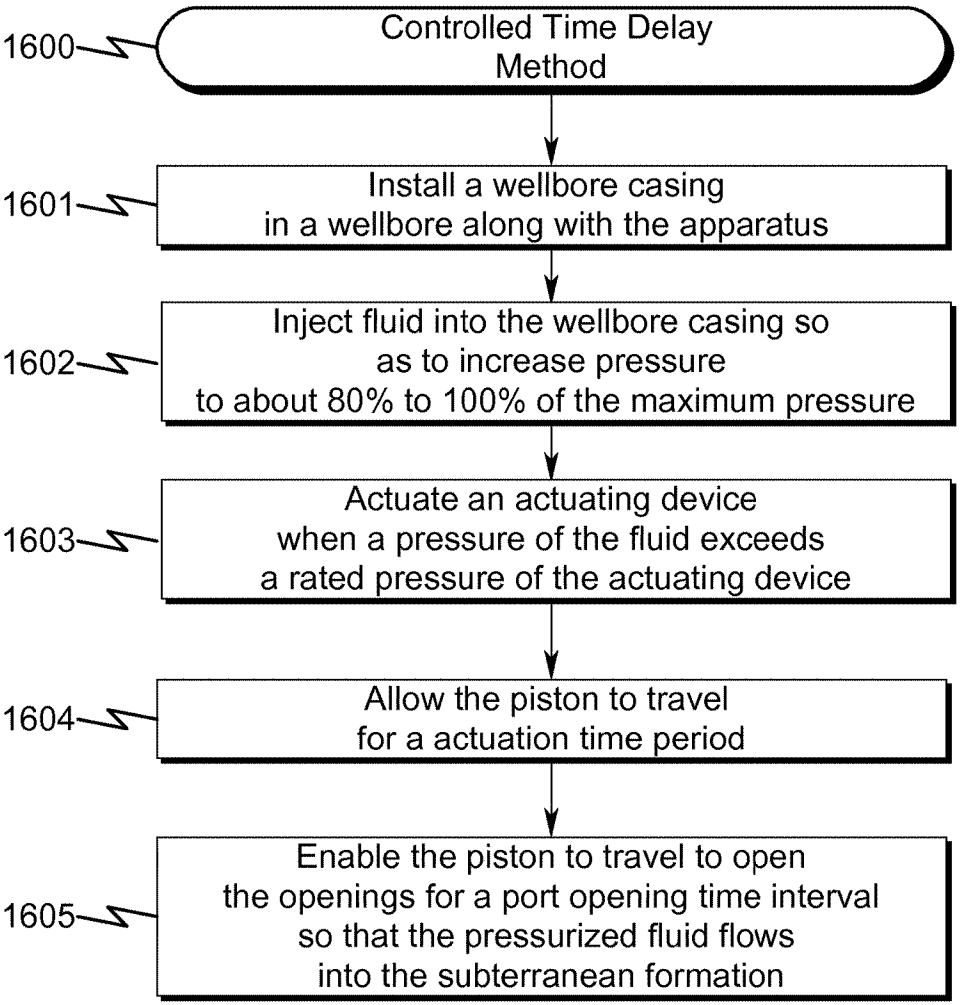
FIG. 16 is an exemplary flow chart that illustrates a controlled time delay method with a time delay toe valve apparatus according to a preferred embodiment of the present invention.

As generally seen in the flow chart of FIG. 16 (1600), a preferred exemplary controlled time delay method with a controlled time delay apparatus may be generally described in terms of the following steps:

(1) installing a wellbore casing in a wellbore along with the toe valve apparatus (1601);
(2) injecting the fluid to increase well pressure to 80 to 100% of the maximum pressure (1602);
(3) actuating the actuating device when a pressure of said fluid exceeds a rated pressure of the actuating device (1603);
(4) allowing a piston in the toe valve to travel for an actuation time period (1604); and
(5) enabling the piston to travel to open openings for the port opening time interval so that the pressurized fluid flows into the subterranean formation (1605).

Preferred Exemplary Flowchart of a Controlled Time Delay Apparatus (1610)

Figure 16A:
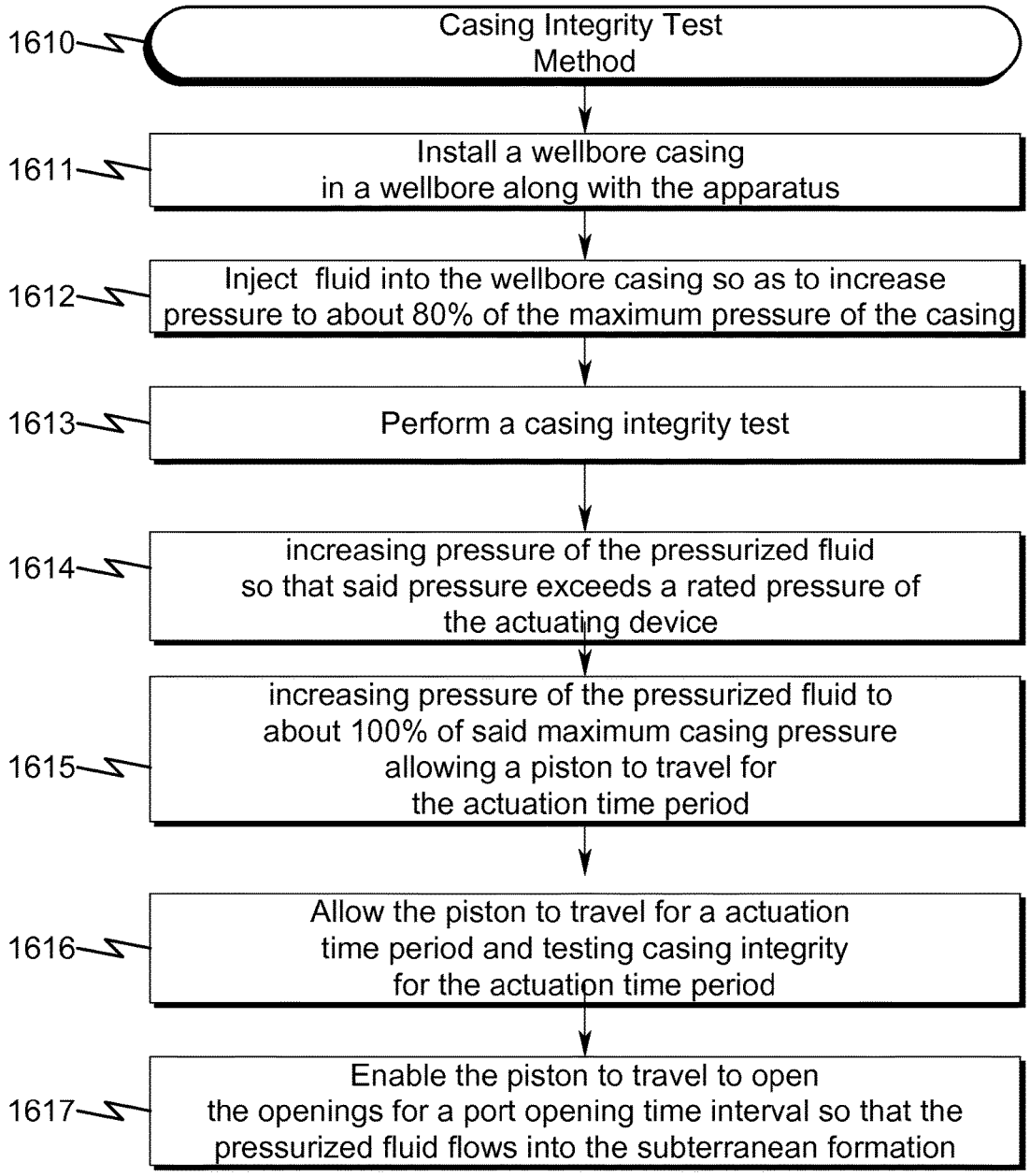
FIG. 16*a* is an exemplary flow chart that illustrates a casing integrity test method with a controlled time delay with a time delay toe valve apparatus according to a preferred embodiment of the present invention.

As generally seen in the flow chart of FIG. 16*a* (1610), a preferred exemplary controlled time delay method with a controlled time delay apparatus may be generally described in terms of the following steps:

(1) installing a wellbore casing in a wellbore along with said apparatus (1611);
(2) injecting the fluid to increase well pressure to 80 to 100% of the maximum pressure (1612);
(3) testing for casing integrity (1613);
(4) increasing pressure of said pressurized fluid so that said pressure exceeds a rated pressure of said actuating device (1614);
(5) increasing pressure of said pressurized fluid to about 100% of said maximum casing pressure allowing a piston to travel for said actuation time period (1615);
(6) testing casing integrity for said actuation time period (1616); and
(7) enabling said piston to travel to open said openings for said port opening time interval so that said pressurized fluid flows into said subterranean formation (1617).

Preferred Exemplary Dual Actuating Controlled Time Delay Apparatus (1700-1900)

Figure 17A:
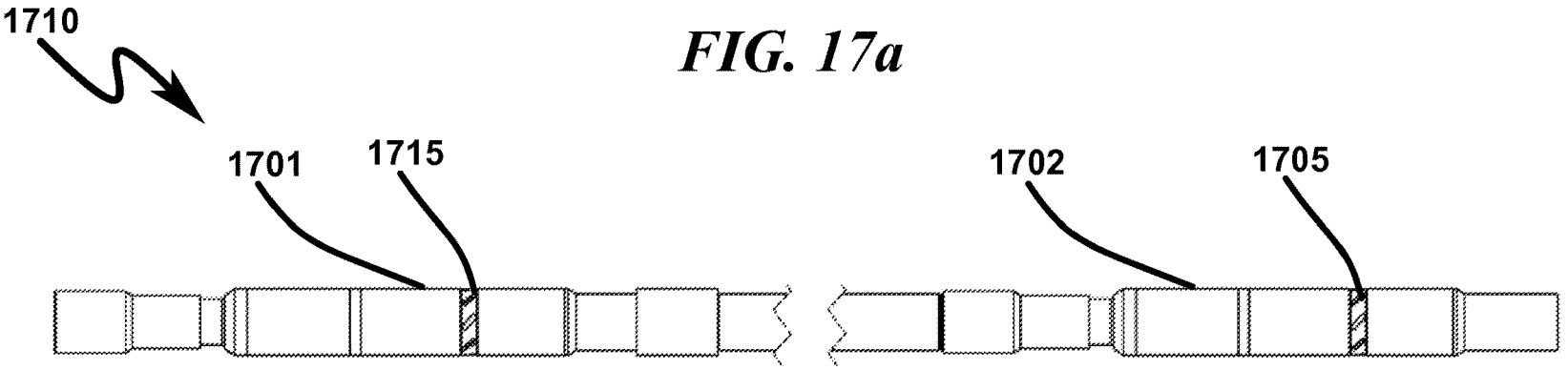
FIG. 17*a* illustrate an exemplary dual actuating controlled time delay apparatus comprising dual controlled toe valves according to a preferred embodiment of the present invention.
Figure 17B:
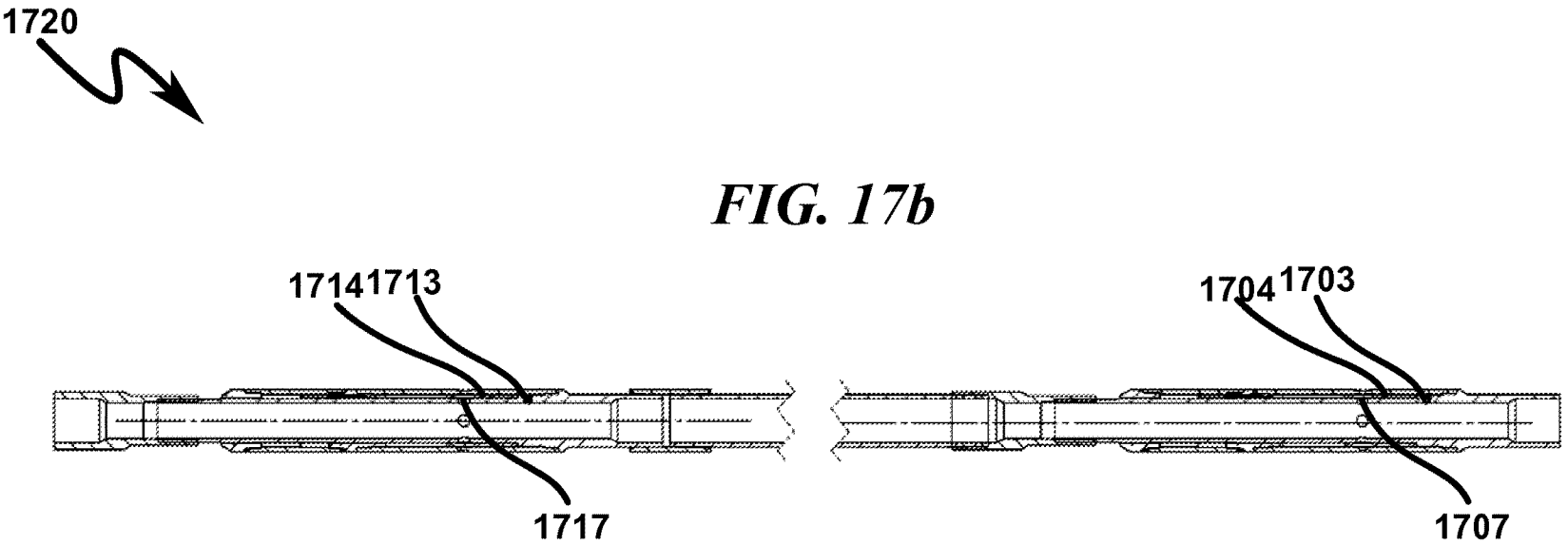
FIG. 17*b* illustrates an exemplary cross section of a dual actuating controlled time delay apparatus comprising dual controlled toe valves according to a preferred embodiment of the present invention.

As generally illustrated in FIG. 17*a* (1710) and FIG. 17*b* (1720) a dual actuating controlled time delay apparatus comprises dual controlled toe valves (1701, 1702) for use in a wellbore casing. Each of the dual toe valves (1701, 1702) is similar to the aforementioned toe valve apparatus in FIG. 1A and FIG. 1B. Toe valve (first delay tool) (1701) may comprise a first piston (1704) that moves when actuated by a first pressure actuating device (1703), first openings (1705) in the housing and first ports (1707) in the mandrel. Similarly, toe valve (second delay tool) (1702) may comprise a second piston (1714) that moves when actuated by a second pressure actuating device (1713), second openings (1715) in the housing and second ports (1717) in the mandrel. The first delay tool (1701) may be integrated into the well casing at a first location and the second delay tool (1702) may be integrated into the well casing at a second location. The first location and the second locations may be determined by an open-hole log before casing is placed in a wellbore, seismic data that may include 3 dimensional formation of interest to stay in a zone, and a mud log. According to a preferred exemplary embodiment, the dual actuating controlled time delay apparatus may further comprise a third delay tool integrated into the wellbore casing at a third location. The third tool may comprise a third housing with third openings, a third piston, and a third actuating device. It should be noted that the number of delay tools aforementioned may not be construed as a limitation. One ordinarily skilled in the art may use three or more delay tools that may be integrated into the wellbore casing to achieve staggered delay openings at various times. Other operations including pumping down tools, injecting fluid or plugging may be performed at any time while the delay tools are opening. Rate of travel of each of the pistons (1704, 1714) in the toe valves (1701, 1702) is controlled independently of each other. According to a preferred exemplary embodiment, the dual actuating controlled time delay apparatus may be manufactured from an integral one-piece design of the mandrel that carries all of the tensile, compressional and torsional loads encountered by the apparatus. The entire dual actuating controlled time delay apparatus may be piped into the casing string as an integral part of the string and positioned where perforation of the formation and fluid injection into a formation is desired. The dual actuating controlled time delay apparatus may be installed in either direction with no change in its function.

Figure 18:
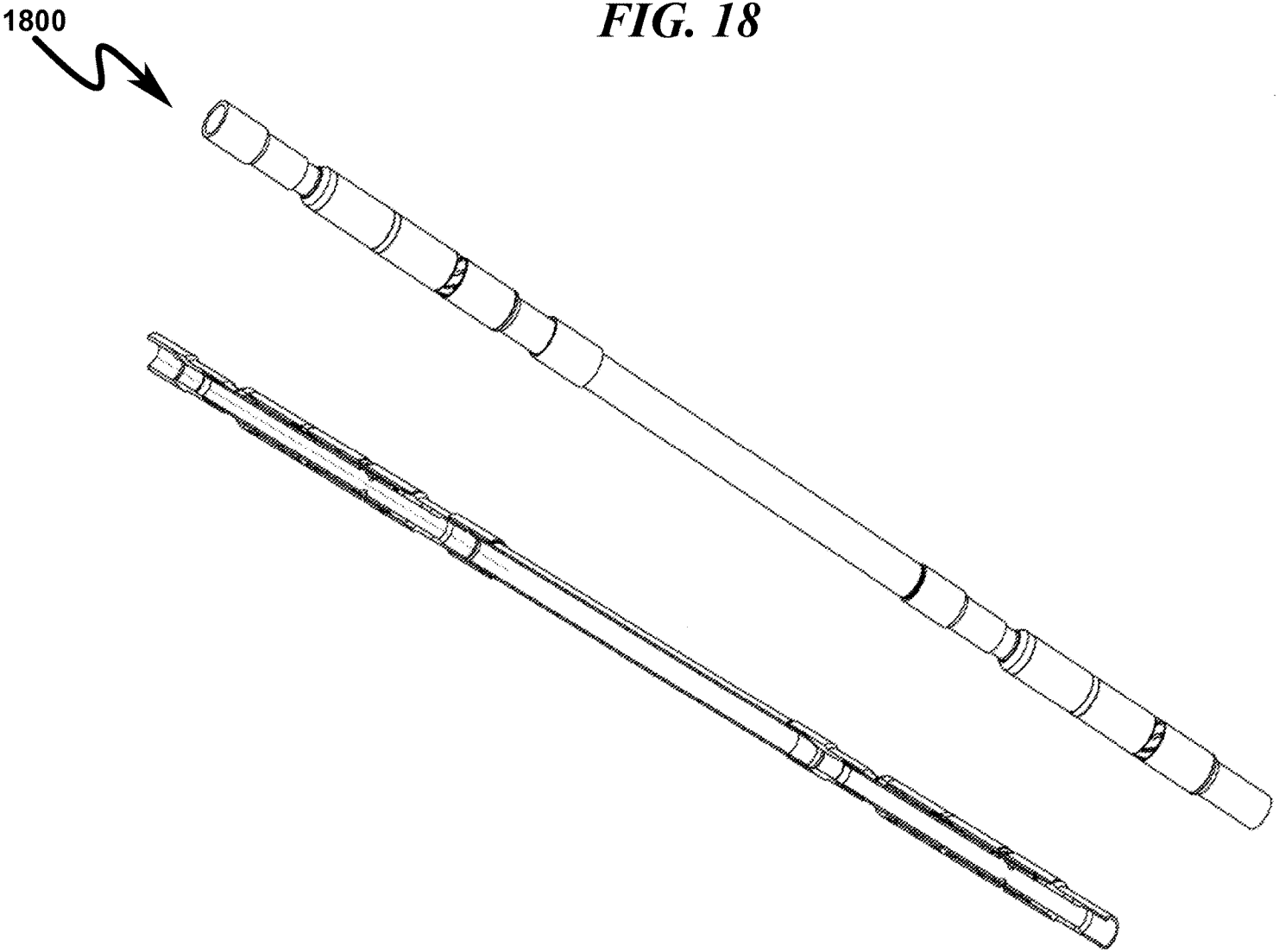
FIG. 18 illustrates an exemplary perspective view of a dual actuating controlled time delay apparatus according to a preferred embodiment of the present invention.
Figure 19:
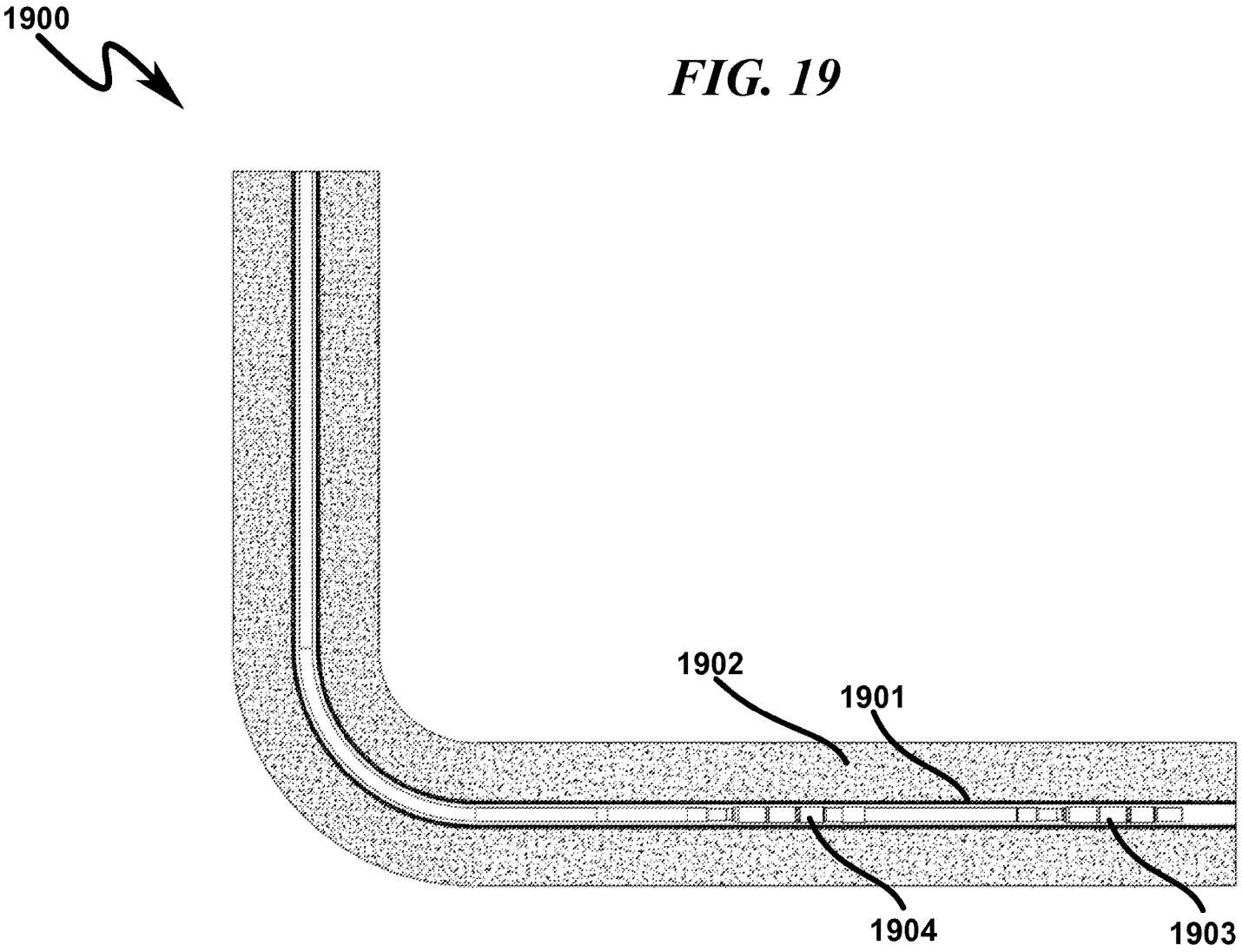
FIG. 19 illustrates an exemplary dual actuating controlled time delay apparatus integrated into a wellbore casing according to a preferred embodiment of the present invention.

Prior art systems do not provide for two or more toe valves in a single system due to the fact that the first connection to the formation releases all the pressure in the well casing, therefore making a potential second toe valve ineffective. This is caused by the tolerance in actuation pressure inherent in the actuation devices. According to a preferred exemplary embodiment, the time delays of individual toe valves are controlled independently so that multiple connection points to the formation are created. The effect of multiple connection points to the formation may result in increased connection efficiency and increased flow area to the formation. According to a preferred exemplary embodiment, the flow area may be increased by 50% to more than 1000%. According to a preferred exemplary embodiment, the time delays of the individual toe valves are the same. According to another preferred exemplary embodiment, the time delays of the individual toe valves are not equal. According to yet another preferred exemplary embodiment, a ratio of the first actuation time period and the second actuation time period ranges from 0.01 to 100. According to a further preferred exemplary embodiment, a ratio of the first port open time interval and the second port open time interval ranges from 0.01 to 100. According to yet another preferred exemplary embodiment, one valve provides a fail-safe mechanism for connection to the formation. The difference in rated pressures of the first actuating device (1713) and the second actuating device (1703) may be within 500 PSI. This is particularly important as the rated pressure of actuating devices such as rupture disks are rated within +−500 PSI. In order to account for the differences in rated pressure, two delay tools with a rated pressure difference of +−500 PSI may be used to minimize the uncertainty in the actuation pressure. In the event that one valve fails to open or function the other valve may act as a replacement or fail-safe to provide connection to the formation. FIG. 18 (1800) illustrates a perspective view of a controlled dual time delay controlled apparatus. The controlled dual time delay controlled apparatus may be integrated into a wellbore casing (1901) as illustrated in FIG. 19 (1900). The casing with the integrated dual control apparatus may be cemented with a cement (1902). The apparatus may comprise two individually controlled time delay apparatus, a first delay tool (1903) and a second delay tool (1904). According to a preferred exemplary embodiment, the controlled dual time delay controlled apparatus may be integrated at a toe end of the casing. According to another preferred exemplary embodiment, the controlled dual time delay controlled apparatus may be integrated at a heal end of the casing.

Preferred Exemplary Flowchart of a Controlled Time Delay with a Dual Actuating Toe Valve (2000)

Figure 20:
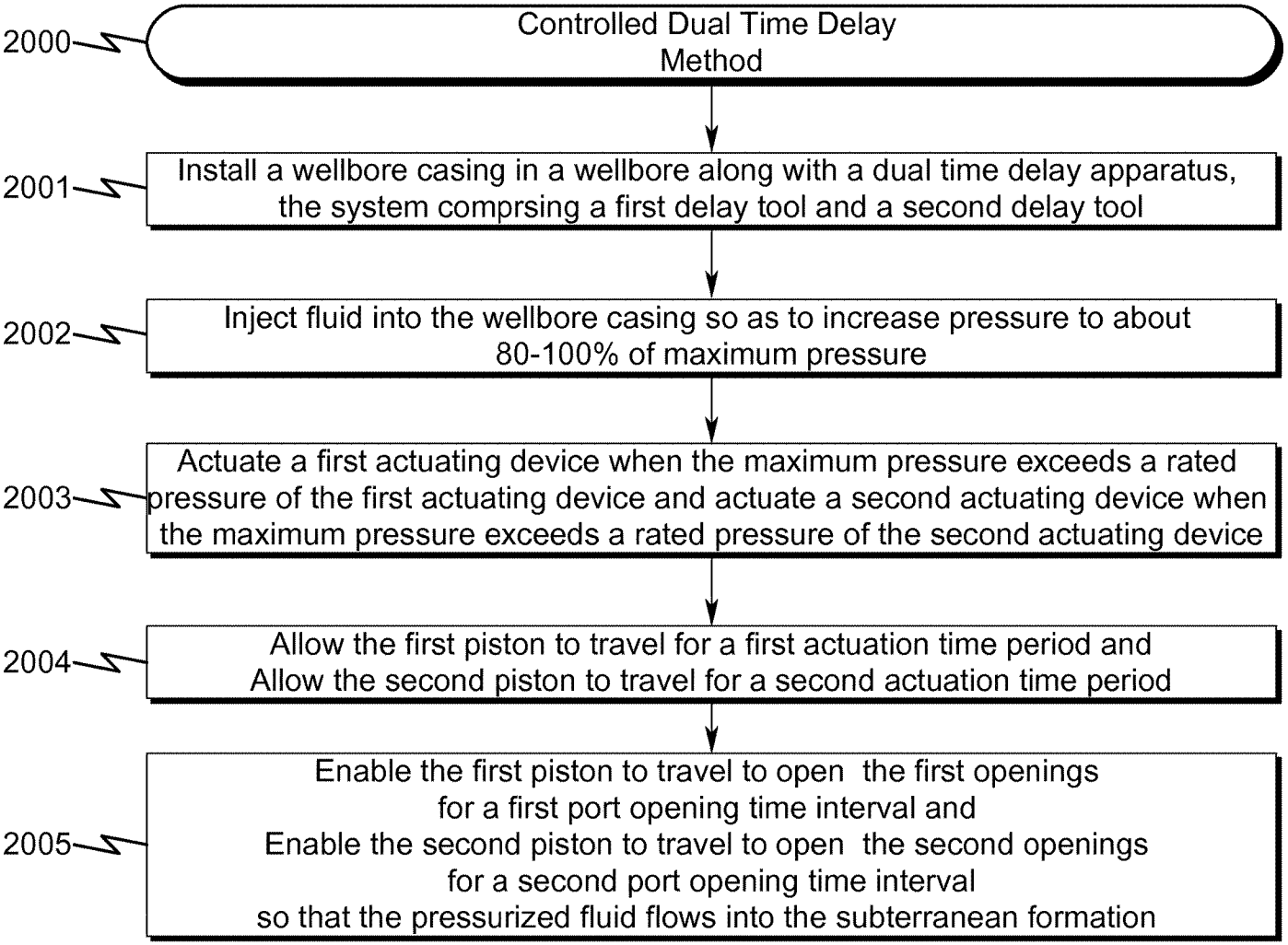
FIG. 20 is an exemplary chart that illustrates a controlled time delay method with a dual time delay toe valve apparatus according to a preferred embodiment of the present invention.

As generally seen in the flow chart of FIG. 20 (2000), a preferred exemplary controlled time delay method with a dual actuating controlled apparatus aforementioned in FIG. 17*a* (1710) may be generally described in terms of the following steps:

(1) installing a wellbore casing in a wellbore along with the dual actuating controlled apparatus (2001);

(2) injecting the fluid to increase well pressure to 80 to 100% of the maximum pressure (2002);

(3) activating a first actuating device when the maximum pressure exceeds a rated pressure of the first actuating device and activating the second actuating device when the maximum pressure exceeds a rated pressure of the second actuating device (2003);

(4) allowing a first piston to travel for a first actuation time period and allowing a second piston to travel for a second actuation time period (2004); and (5) enabling the first piston to travel to open the first openings for a first port opening time interval and enabling the second piston to travel to open the second openings for a second port opening time interval, so that the pressurized fluid flows into the subterranean formation (2005).

Preferred Exemplary Single Actuating Controlled Dual Time Delay Apparatus (2100-2200)

Figures 21A, 21B, 21C:
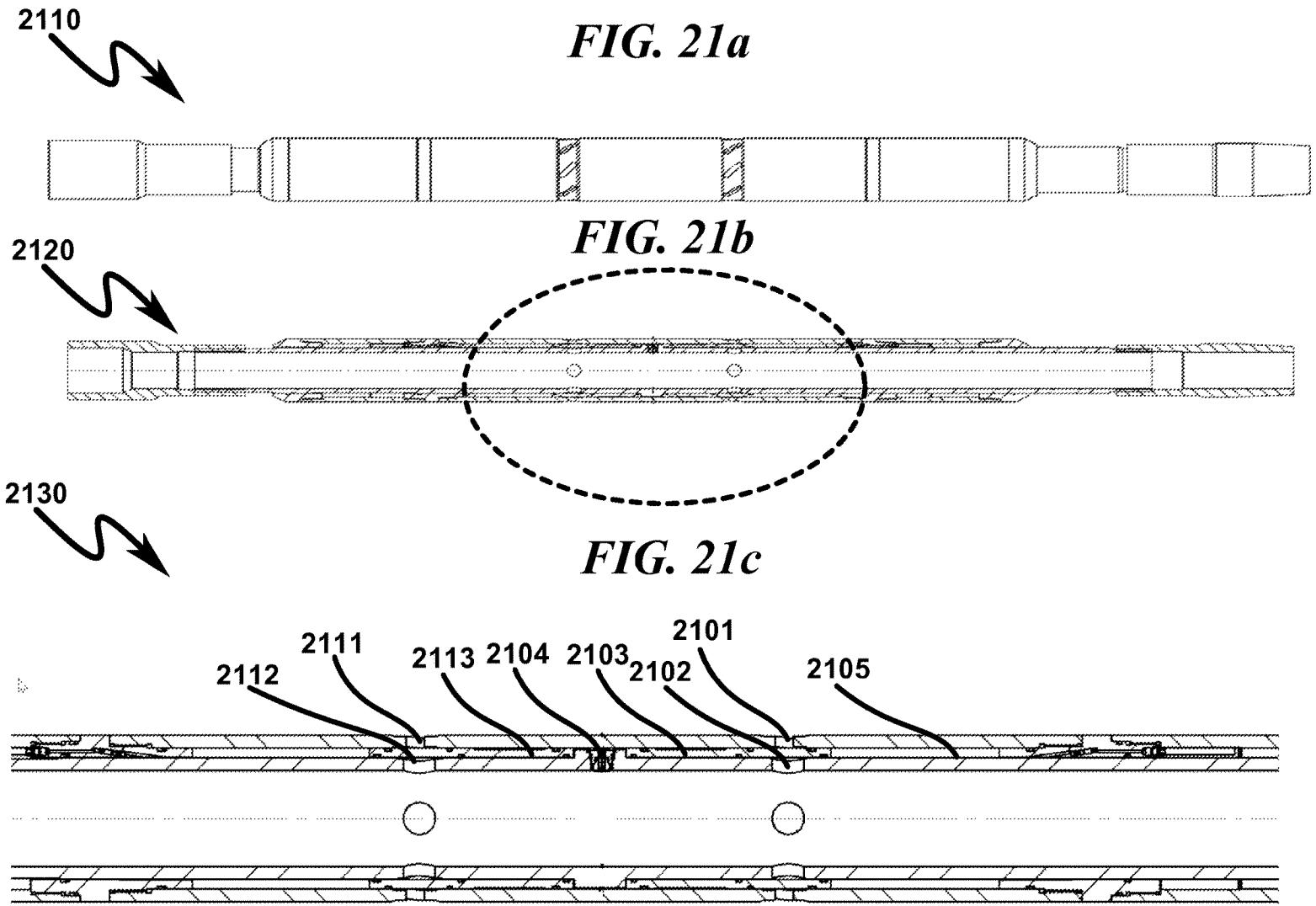
FIG. 21*a*, 21*b*, 21*c* illustrate an exemplary cross section of a single actuating controlled time delay apparatus according to a preferred embodiment of the present invention.
Figure 22:
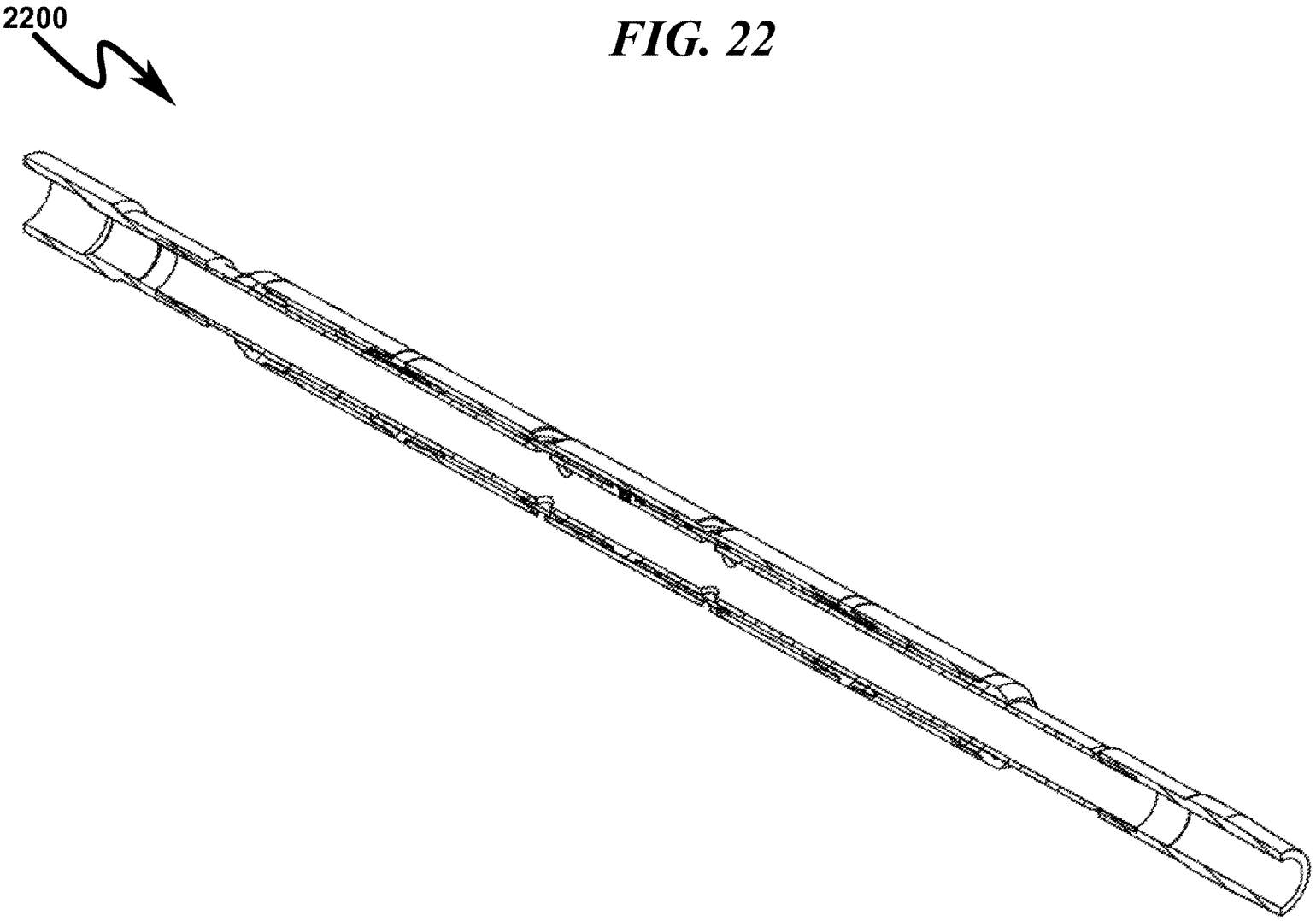
FIG. 22 illustrates an exemplary perspective view of a single actuating controlled time delay apparatus according to a preferred embodiment of the present invention.

As generally illustrated in FIG. 21*a* (2110), FIG. 21*b* (2120), and FIG. 21*c* (2130) a single-actuating controlled dual time delay apparatus comprising dual time delay valves with pistons (2103, 2113), a mandrel (2105), openings (2101, 2111) and ports (2102, 2112) for use in a wellbore casing. The single-actuating controlled dual time delay apparatus may comprise a first piston (2103) and a second piston that move in opposite directions when actuated by a pressure actuating device (2104). The first delay valve may be integrated into the well casing at a first location and the second delay valve may be integrated into the well casing at a second location. The first location and the second locations may be determined by an open-hole log before casing is placed in a wellbore, seismic data that may include 3 dimensional formation of interest to stay in a zone, and a mud log. According to a preferred exemplary embodiment, the single actuating controlled time delay apparatus may further comprise a third delay tool integrated into the wellbore casing at a third location. The third tool may comprise a third housing with third openings, a third piston, and an actuating device. It should be noted that the number of delay tools aforementioned may not be construed as a limitation. One ordinarily skilled in the art may use three or more delay tools that may be integrated into the wellbore casing to achieve staggered delay openings at various times. According to a preferred exemplary embodiment, two or more time delay valves may be actuated by a single actuating device. The rate of travel of each of the pistons (2103, 2113) in the apparatus may be controlled independently of each other. According to a preferred exemplary embodiment, the single-actuating controlled time delay apparatus may be manufactured from an integral one-piece design of the mandrel that carries all of the tensile, compressional and torsional loads encountered by the apparatus. The entire single-actuating controlled time delay apparatus may be piped into the casing string as an integral part of the string and positioned where perforation of the formation and fluid injection into a formation is desired. The single-actuating controlled time delay apparatus may be installed in either direction with no change in its function. Prior art systems do not provide for two or more toe valves in a single system due to the fact that the first connection to the formation releases all the pressure in the well casing, therefore making a potential second toe valve ineffective. According to a preferred exemplary embodiment, the time delays of individual toe valves are controlled independently so that multiple connection points to the formation are created. The effect of multiple connection points to the formation may result in increased connection efficiency and increased flow area to the formation. According to a preferred exemplary embodiment, the flow area may be increased by 50% to more than 1000%. According to a preferred exemplary embodiment, the time delays of the individual toe valves are the same. According to another preferred exemplary embodiment, the time delays of the individual toe valves are not equal. According to yet another preferred exemplary embodiment, one valve provides a fail-safe mechanism for connection to the formation. In the event that one valve fails to open or function the other valve may act as a replacement or fail-safe to provide connection to the formation. FIG. 22 (2200) illustrates a perspective view of a controlled single-actuating dual time delay controlled apparatus. The controlled single-actuating dual time delay controlled apparatus may be integrated into a wellbore casing. The single-actuating may comprise two individually controlled time delay apparatus, a first delay tool and a second delay tool. According to a preferred exemplary embodiment, the controlled dual time delay controlled apparatus may be integrated at a toe end of the casing. According to another preferred exemplary embodiment, the controlled dual time delay controlled apparatus may be integrated at a heal end of the casing.

Preferred Exemplary Flowchart of a Controlled Time Delay with a Single Actuating Toe Valve (2300)

Figure 23:
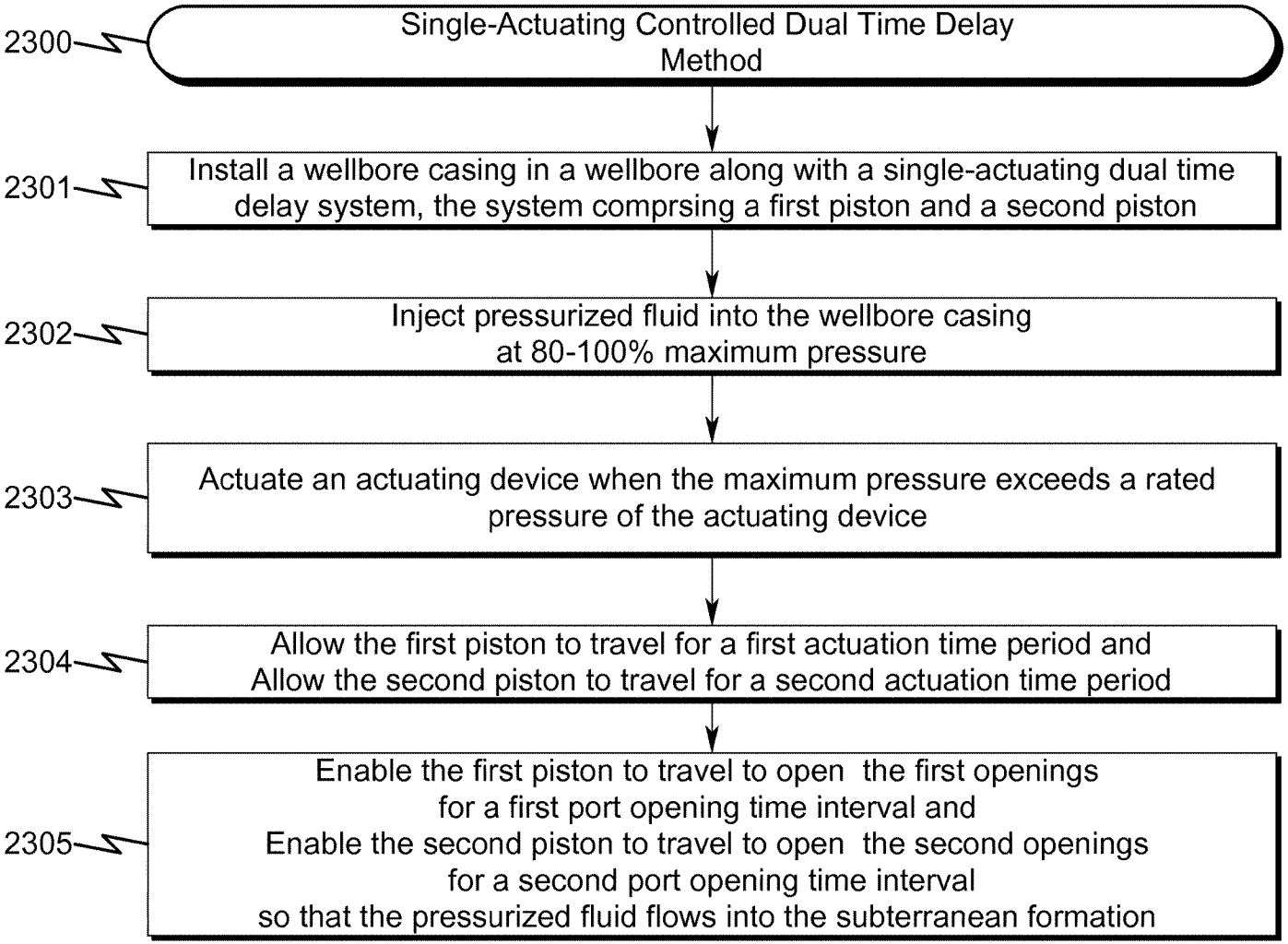
FIG. 23 is an exemplary flow chart illustrating a controlled time delay method with a single actuating dual time delay toe valve apparatus according to a preferred embodiment of the present invention.

As generally seen in the flow chart of FIG. 23 (2300), a preferred exemplary controlled time delay method with a single-actuating controlled dual time delay apparatus may be generally described in terms of the following steps:

(1) installing a wellbore casing in a wellbore along with the dual toe valve apparatus (2301);

(2) injecting the fluid to increase well pressure to 80 to 100% of the maximum pressure (2302);

(3) activating an actuating device when the maximum pressure exceeds a rated pressure of the actuating device (2303);

(4) allowing a first piston to travel for a first actuation time period and allowing a second piston to travel for a second actuation time period (2304); and (5) enabling the first piston to travel to open the first openings for a first port opening time interval and enabling the second piston to travel to open the second openings for a second port opening time interval, so that the pressurized fluid flows into the subterranean formation (2305).

Preferred Exemplary Flowchart of Perforating and Fracturing Through a Controlled Time Delay Toe Valve (2400)

Figure 24:
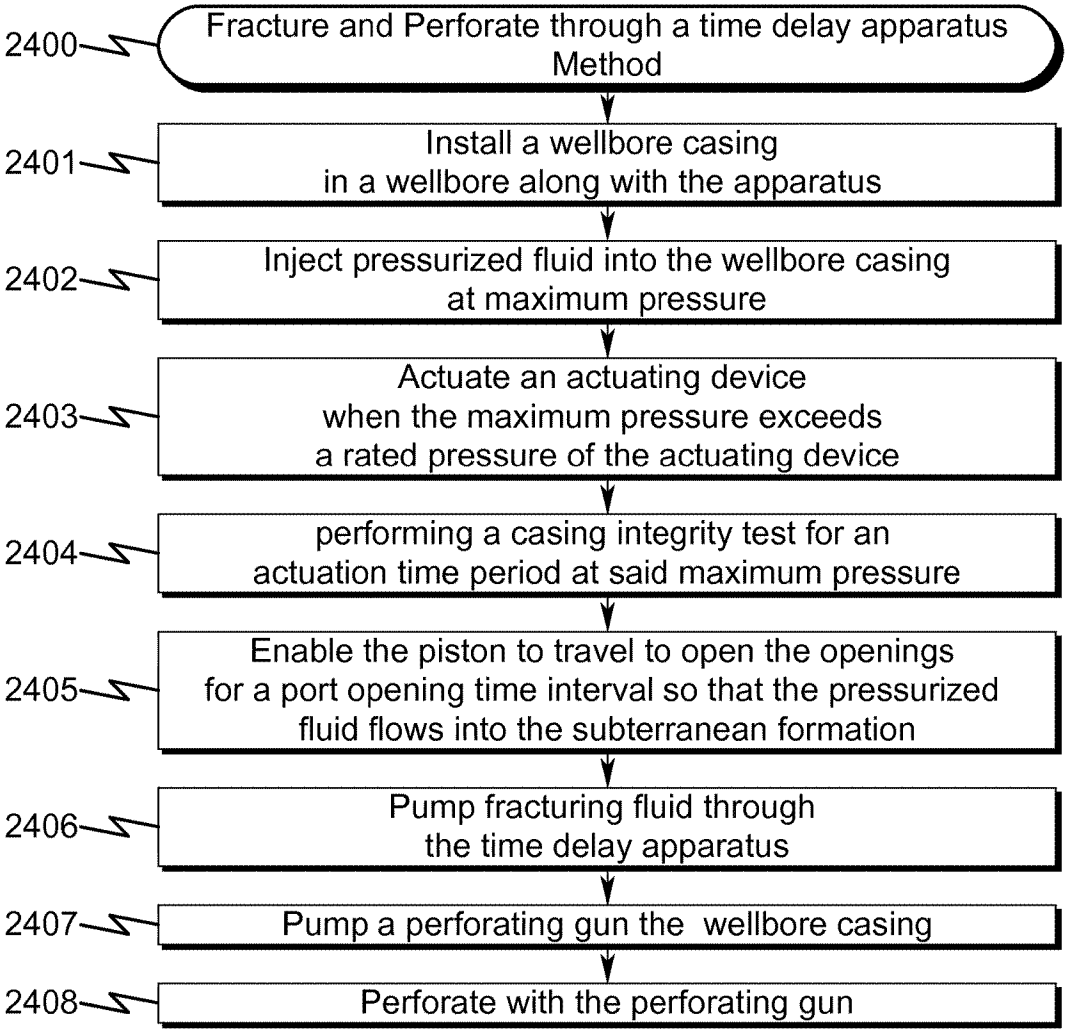
FIG. 24 is an exemplary flow chart illustrating a fracturing and perforating method through a time delay toe valve apparatus according to a preferred embodiment of the present invention.

As generally seen in the flow chart of FIG. 24 (2400), a preferred exemplary fracturing method through a controlled time delay apparatus may be generally described in terms of the following steps:

(1) installing a wellbore casing in a wellbore along with the time delay apparatus (2401);

the time delay apparatus may be configured with a seating surface so that a restriction plug element may be seated in the seating surface.

(2) pumping up wellbore pressure to a maximum pressure (2402);

(3) activating an actuating device when a maximum pressure exceeds a rated pressure of the actuating device (2403);

(4) performing a casing integrity test for an actuation time period at the maximum pressure (2404);

(5) enabling a piston to travel to open openings so that a connection is established to a subterranean formation (2405);

(6) pumping fracturing fluid through the time delay apparatus (2406);

acid stimulation with HCL may be performed prior to or during pumping fracturing fluid so that an improved connection is created to the formation and further fracturing operations are effective in creating fractures.

(7) pumping a perforating gun into the wellbore casing (2407); and

The perforating gun may be pumped along with a frac plug so that the frac plug isolates the next stage. A restriction plug element may be deployed to seat in the seating surface of the apparatus.

(8) perforating through the perforating gun (2408).

Preferred Exemplary Apparatus Ball Seat in a Controlled Time Delay Injection Valve (2500-2600)

The wiper plug designs used in today's horizontal well bores were initially developed for use in vertical well bores. The horizontal well bores present a more challenging trajectory for the equipment due to the extended casing length and concentrated friction on only one side of the wiper plug. As a consequence, the elastomeric fins of a wiper plug can become worn on one side and render incapable of sealing properly in the dimensions of the conventional shoe joint. This causes a phenomena called "wet shoe." The downfalls of having a wet shoe in a cemented wellbore casing include possible leak paths, lack of isolation, and no pressure integrity of the casing. Therefore, when a pressure casing integrity test fails, the cause of the failure is either a wet shoe or leak in the casing. According to a preferred exemplary embodiment, time delay injection valve or a toe valve with a ball seat enables detection of wet shoe when a ball or a restriction plug element dropped into the wellbore casing seats in the ball seat and seals the toe end to remediate the wet shoe. On the other hand, if the ball seated in the time delay injection valve still causes a casing integrity test to fail, then the cause of the failure is not the wet shoe which further indicates that the cause of failure is related to the casing integrity. In some instances, the casing integrity failure may be due to weaker joints or a hole in the casing. According to a preferred exemplary embodiment, the time delay injection valve is a hydraulic controlled time delay valve. For example the time delay injection valve may be a hydraulic controlled time delay valve as illustrated in FIG. 1A. An additional seat may be located below the valve, providing a means to test the toe, the valve and the well. According to another preferred exemplary embodiment, the time delay injection valve is a hydraulic controlled dual actuated time delay valve. For example the time delay injection valve may be a hydraulic controlled dual actuated time delay valve as illustrated in FIG. 17*a*. According to yet another preferred exemplary embodiment, the time delay injection valve is a hydraulic controlled single actuated time delay valve. For example the time delay injection valve may be a hydraulic controlled single actuated time delay valve as illustrated in FIG. 21*a*.

Figure 25:
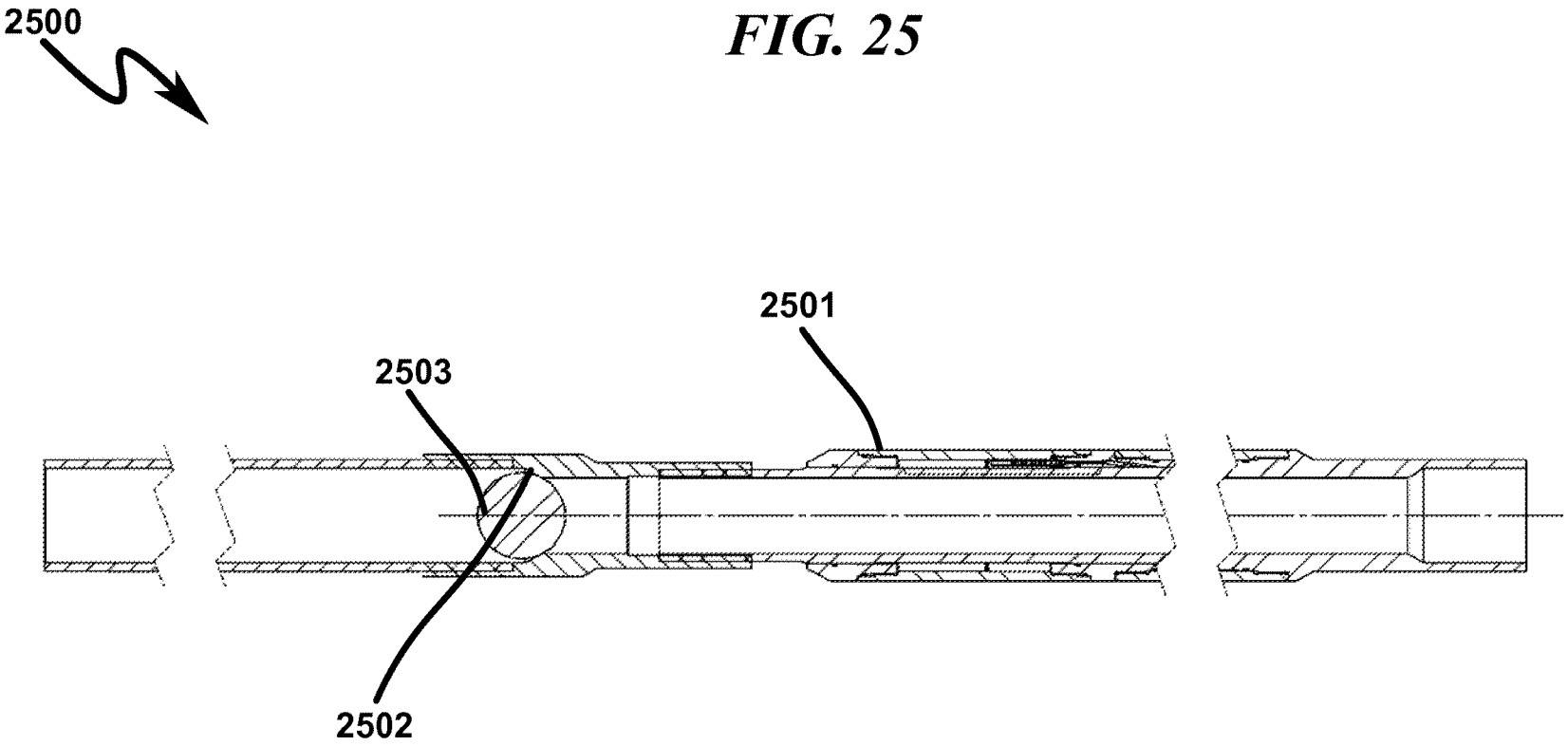
FIG. 25 illustrates an exemplary cross section of a toe valve apparatus with a ball seat according to a preferred embodiment of the present invention.
Figure 26:
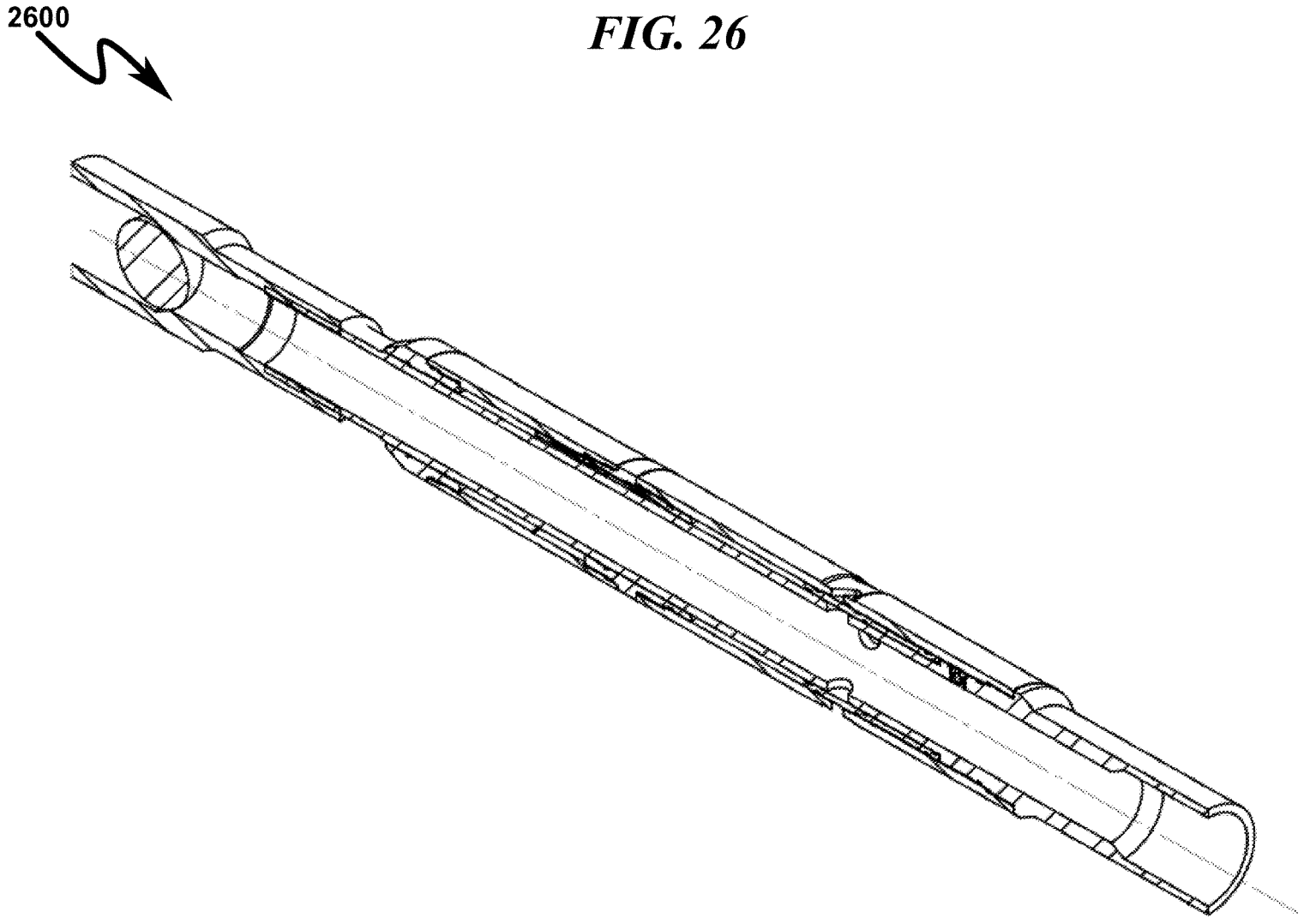
FIG. 26 illustrates an exemplary perspective view of a toe valve apparatus with a ball seat according to a preferred embodiment of the present invention.

FIG. 25 (2500) generally illustrates a restriction plug element (2503) seated in a seating surface (2502) of a controlled time delay apparatus (2501). The controlled time delay apparatus (2501) may be installed at a toe end of a wellbore casing. The restriction plug element (2503) may be a ball that may be dropped to seat in the valve (2501). The seated restriction plug element (2503) may seal any leaks past the restriction plug element (2503) in a toe ward direction, thereby enabling detection of a wet shoe in a wellbore casing. According to a preferred exemplary embodiment, a toe valve with a ball seat is used to isolate wet shoe failures from casing integrity failures. According to a preferred exemplary embodiment, a restriction plug element seated in a controlled time delay apparatus may be used to create the first stage in a perforation and fracturing operation. FIG. 26 (2600) generally illustrates a perspective view of a restriction plug element seated in a seating surface of a controlled time delay apparatus. According to a preferred exemplary embodiment, the restriction plug element is degradable in wellbore fluids.

According to another preferred exemplary embodiment, the restriction plug element is non-degradable in wellbore fluids. According to a preferred exemplary embodiment, the restriction plug element has a shape that may be selected from a group comprising a sphere, dart, oval, or cylinder.

Preferred Exemplary Flowchart of Wet Shoe Detection with a Controlled Time Delay Toe Valve (2700)

Figure 27:
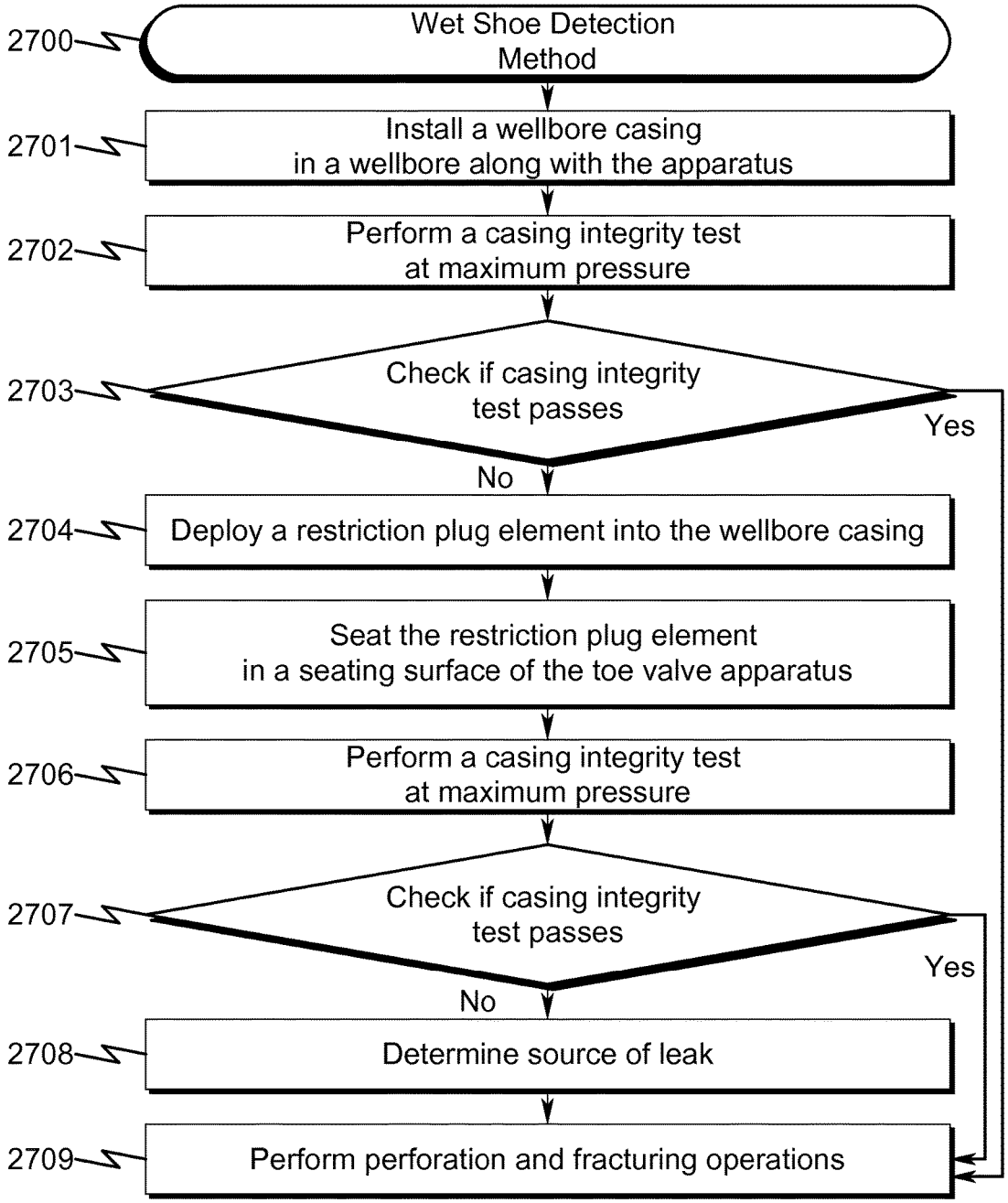
FIG. 27 is an exemplary flow chart illustrating a wet shoe detection with a time delay toe valve apparatus and a restriction plug element according to a preferred embodiment of the present invention.

As generally seen in the flow chart of FIG. 27 (2700), a preferred exemplary wet shoe detection method through a controlled time delay apparatus with a ball seat may be generally described in terms of the following steps:

(1) installing a wellbore casing in a wellbore along with the apparatus (2701);

(2) performing a casing integrity test at 80 to 100% of maximum pressure (2702);

the casing integrity test may be performed at 80% or 100% of the maximum pressure. Fluid may be injecting to increase well pressure to 80 to 100% of the maximum pressure.

(3) checking if the casing integrity test passes, if so, proceeding to step (9) (2703);

(4) deploying a restriction plug element into the wellbore casing (2704);

(5) seating the restriction plug element in a conforming seating surface of the apparatus (2705);

(6) performing a casing integrity test at maximum pressure (2706);

the casing integrity test may be performed at 80% or 100% of the maximum pressure.

(7) checking if the casing integrity test passes, if so, proceeding to step (9) (2707);

(8) fixing a source of the leak (2708); and (9) performing injection, perforation, or fracturing operations (2709).

Preferred Exemplary System of Debris Removal in a Wellbore Casing (2800)

Figures 28A, 28B, 28C:
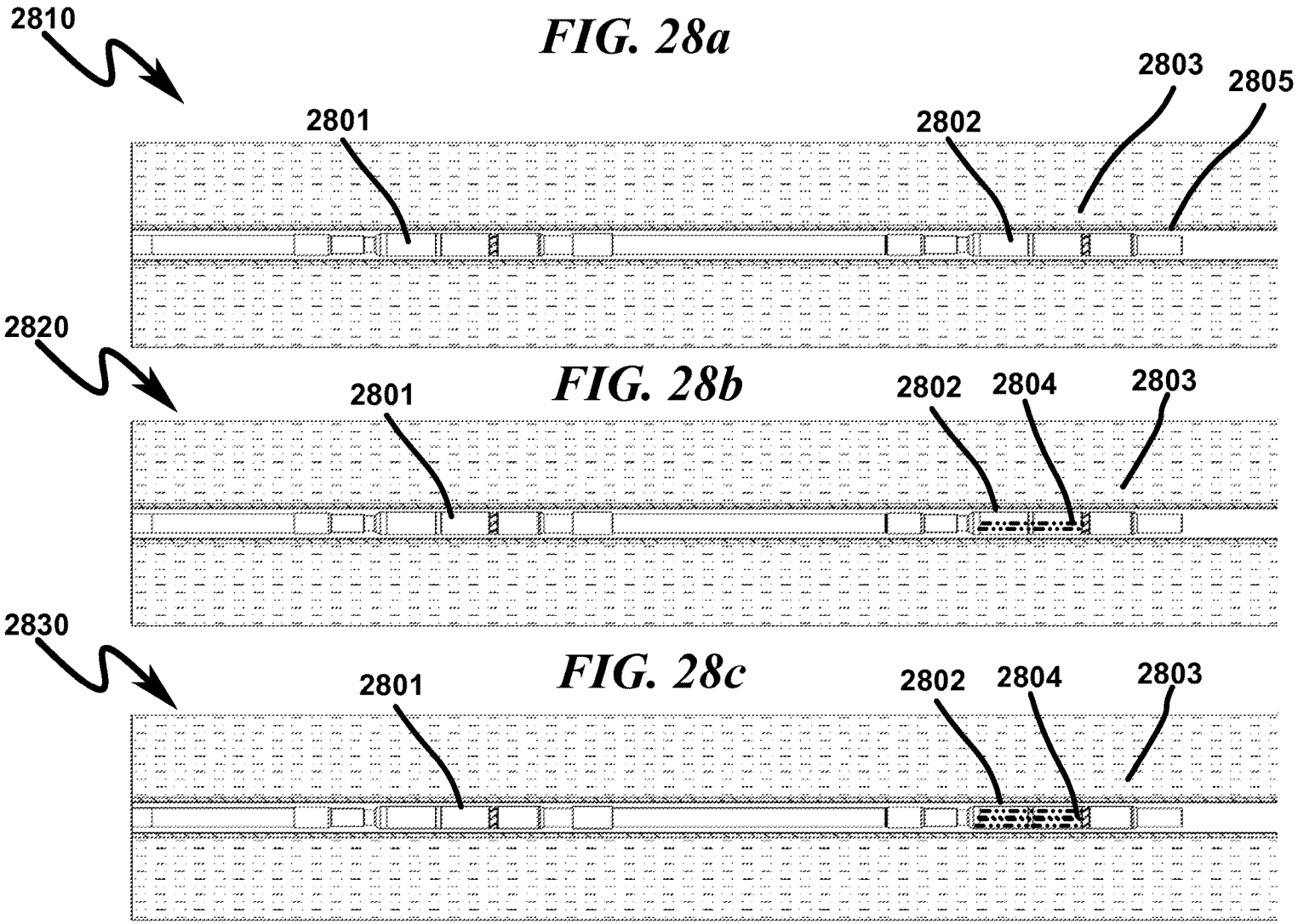
FIG. 28*a*, 28*b*, 28*c* are an exemplary dual injection apparatus illustrating a first injection point, debris collection and a second injection point according to a preferred embodiment of the present invention.

In a fracture treatment application, the well can contain residual cement or other "debris" which can block or restrict the function of perforations or casing conveyed completion valves. This blockage may occur during initial injection at low rates to pump down a tool string, or when the pumping rate increases during a fracture stimulation treatment, or after some time at the increased pumping rate. FIG. 28*a* (2810), FIG. 28*b* (2820), FIG. 28*c* (2830) illustrate a dual injection system with a time delay mechanism that may be used in a staged or sequential delay fashion with multiple injection points. As illustrated in FIG. 28*a*, a first tool (2801) and a second tool (2802) may be conveyed with a wellbore casing or deployed into a wellbore casing (2805). The wellbore casing may be lined with cement (2803) or open hole. For instance, injection point one is open as illustrated in FIG. 28*b*. (2820), and flow rate ramps up, carrying debris preferentially to clog injection point one. Injection point two then opens as illustrated in FIG. 28*c* (2830), allowing unobstructed flow to the wellbore. Staggered sequential time delayed tools (used in conjunction with already open connections or in sets by themselves) such that debris from cementing, perforation or other sources is preferentially drawn toward the tool that connects to the reservoir first, whether uphole or downhole from second tool, that opens leaving second tool to be free of debris with an improved connection to the reservoir. In the interval between the opening of the first injection point in the first tool (2801) and opening of the second injection point in the second tool (2802), fluid may be pumped into the well casing to move debris (2804) to the first injection point. According to a preferred exemplary embodiment, the second injection point may open after the first injection point plugs. For example, if the first tool is a controlled time delay valve with a 5 minute time delay and the second tool is a controlled time delay valve with a 30 minute time delay, after the first tool opens at 5 minutes after actuation, fluid may be pumped for 25 minutes to collect debris in the first tool before the second tool is opened. According to a preferred exemplary embodiment, the dual injection apparatus may be manufactured from an integral one-piece design of the mandrel that carries all of the tensile, compressional and torsional loads encountered by the apparatus. The entire dual injection apparatus may be piped into the casing string as an integral part of the string and positioned where perforation of the formation and fluid injection into a formation is desired. The dual injection apparatus may be installed in either direction with no change in its function. According to a preferred exemplary embodiment, the first tool and the second tools are controlled time delay tools. According to another preferred exemplary embodiment, the first tool is a controlled time delay tool and the second tool is a perforating gun. According to yet another preferred exemplary embodiment, the first tool is a valve that may be actuated by a ball and the second tool is a controlled time delay tool. According to a further preferred exemplary embodiment, the first tool and the second tools are valves that may be actuated by a ball. It should be noted that any combination of a controlled time delay tool, perforating gun, valve actuated by a ball may be used as the first tool and the second tool to create the first injection point and the second injection point.

In a cemented liner application, it is common practice to over displace the cement by 20-40% of cement volume to achieve a good liner lap (good cement job across the liner top for pressure integrity). When the running tool is disconnected from the liner hanger system, the over displaced cement then falls back into the liner top, which leaves behind cement stringers, and other debris. These stringers, and debris then gravitate to the heel of the well, and later will be pumped from the heel to the toe when opening the toe valves. These stringers and debris have been known to plug or lock up toe valves.

According to a preferred exemplary embodiment, two or more injections points may be used in a staggered fashion in order to collect debris before creating an obstruction free connection to the formation. This is particularly important for a liner hanger job wherein a liner hangs of the inside surface of the casing. If the casing is not substantially clean, the liner may not hang on to the inside surface.

Preferred Exemplary Flowchart of Debris Removal with a Controlled Dual Injection Apparatus (2900)

Figure 29:
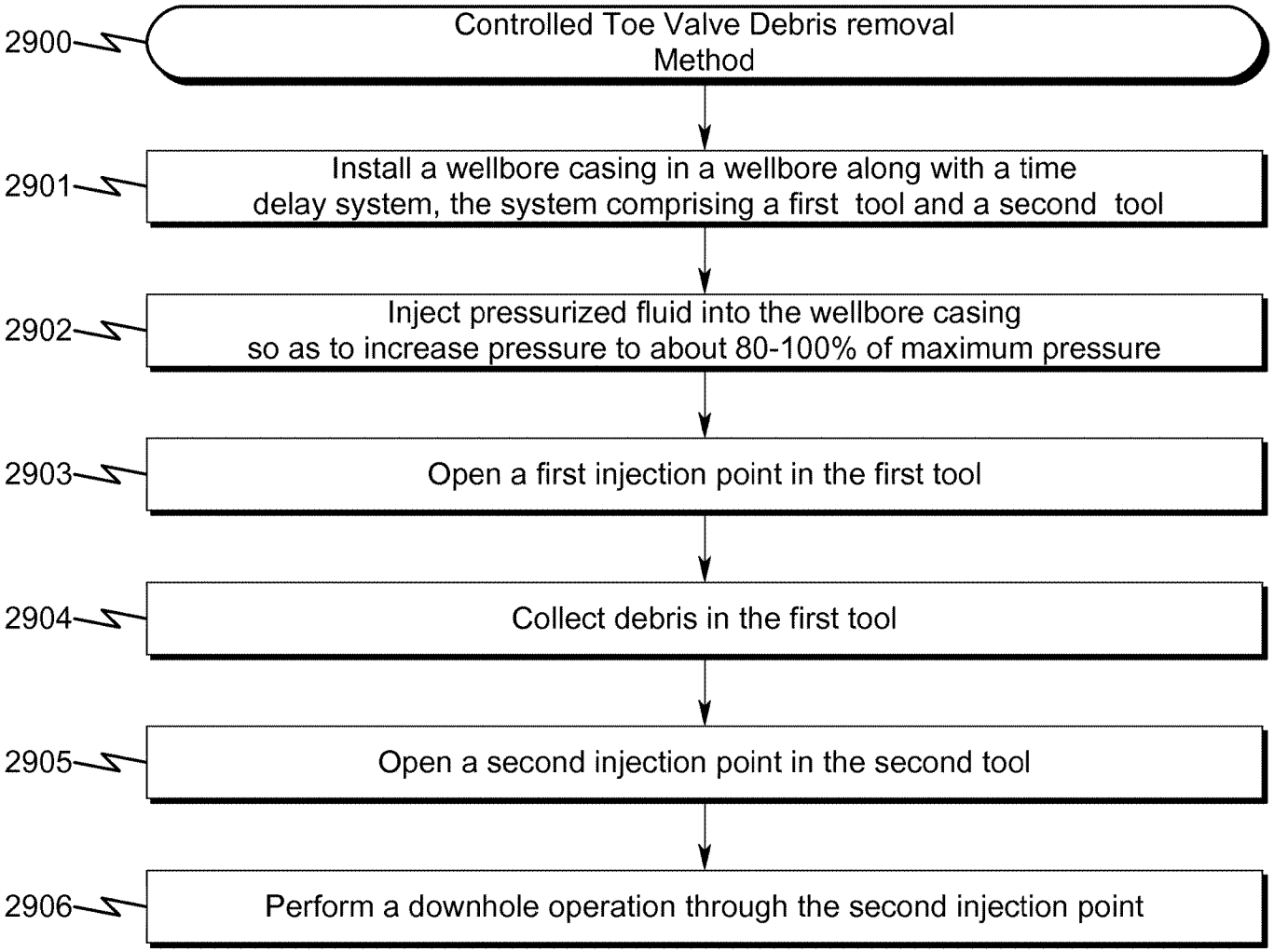
FIG. 29 is an exemplary flow chart illustrating debris removal with a controlled dual injection apparatus according to a preferred embodiment of the present invention.

As generally seen in the flow chart of FIG. 29 (2900), a preferred exemplary debris removal method with a controlled dual injection apparatus comprising a first tool and a second tool may be generally described in terms of the following steps:

(1) installing a wellbore casing in a wellbore along with the controlled dual injection apparatus (2901);
(2) injecting fluid so as to increase pressure to about 80 to 100% of the maximum pressure (2902);
(3) opening a first injection point in the first tool (2903);
(4) collecting debris in the first tool (2904);
(5) opening a second injection point in the second tool (2905); and
(6) performing a downhole operation through the second injection point (2906).

Preferred Exemplary Flowchart of Debris Removal with a Controlled Dual Time Delay Apparatus (3000)

Figure 30:
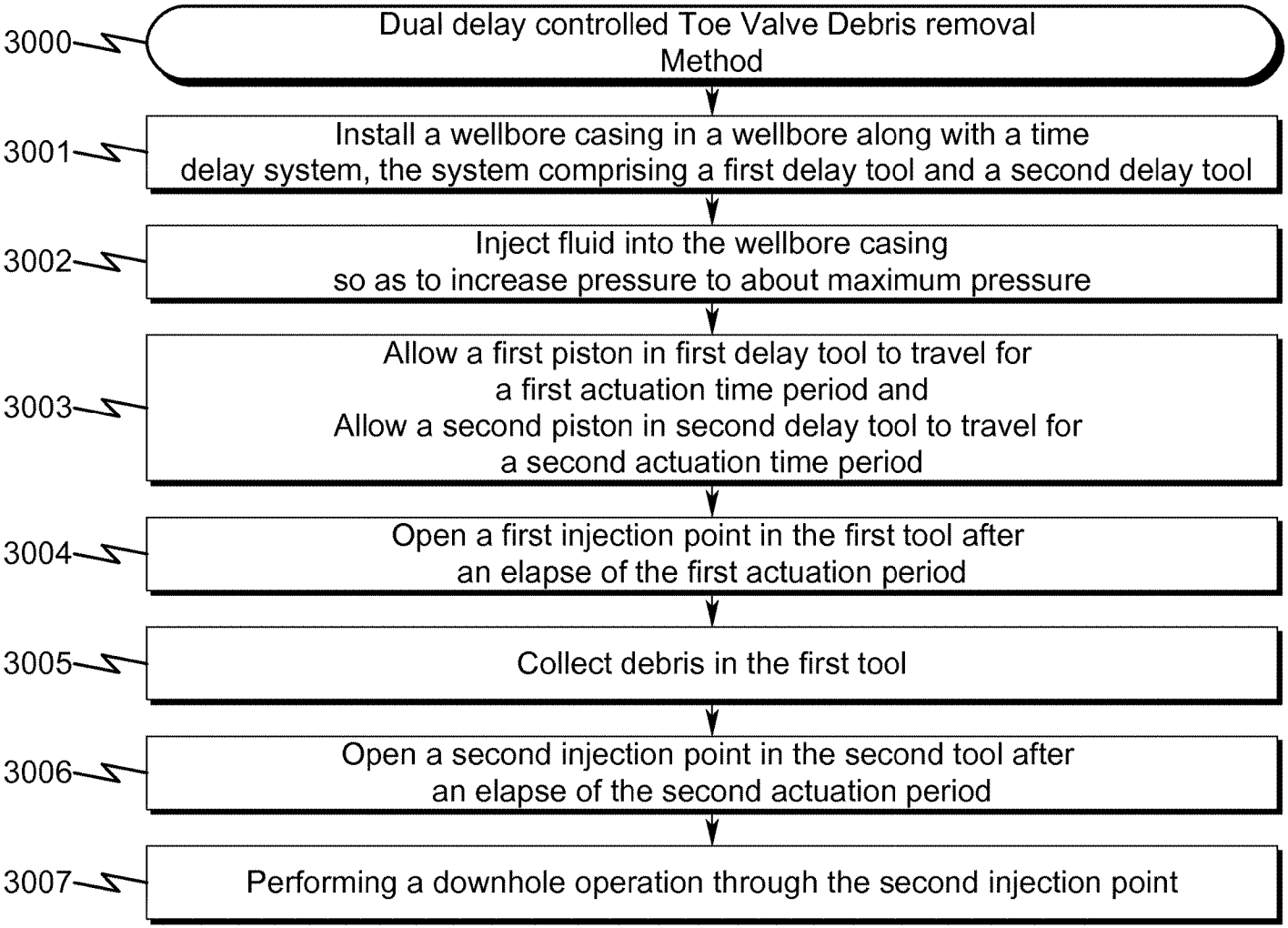
FIG. 30 is an exemplary flow chart illustrating debris removal with a controlled dual time delay apparatus according to a preferred embodiment of the present invention.

As generally seen in the flow chart of FIG. 30 (3000), a preferred exemplary debris removal method with a controlled dual injection apparatus comprising a first delay tool and a second delay tool may be generally described in terms of the following steps:

(1) installing a wellbore casing in a wellbore along with the controlled dual time delay apparatus (3001);
(2) injecting fluid so as to increase wellbore pressure to about 80 to 100% of the maximum pressure (3002);
(3) allowing a first piston in first delay tool to travel for a first actuation time period and allowing a second piston in second delay tool to travel for a second actuation time period (3003);
(4) opening a first injection point in the first delay tool after elapse of the first actuation period (3004);
(5) collecting debris in the first tool (3005);
(6) opening a second injection point in the second tool after elapse of the second actuation period (3006); and
(7) performing a downhole operation through the second injection point (3007).

Preferred Exemplary Flowchart of Debris Removal with a Controlled Time Delay Apparatus and a Perforating Gun (3100)

Figure 31:
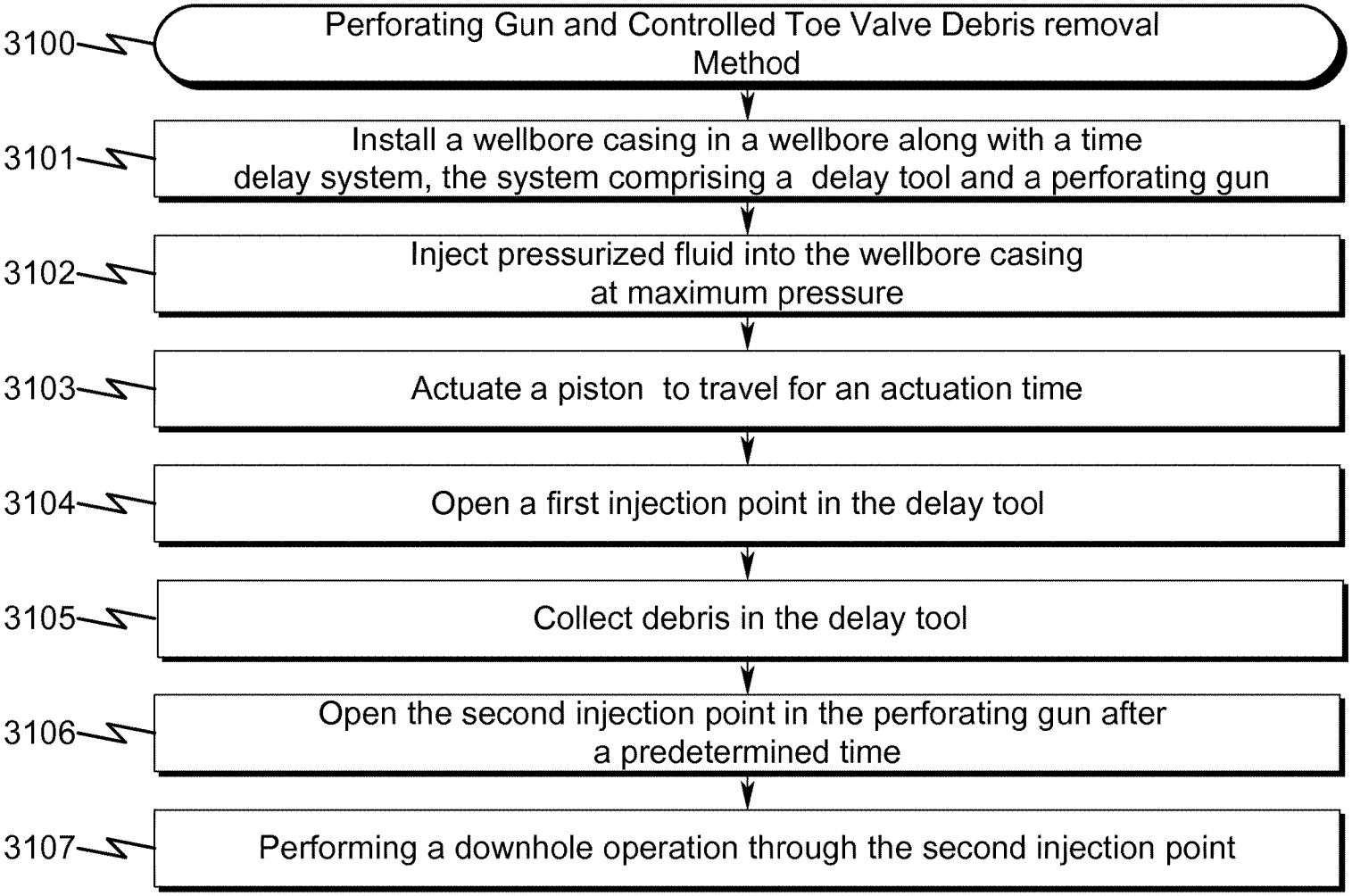
FIG. 31 is an exemplary flow chart illustrating debris removal with a controlled time delay apparatus and a perforating gun according to a preferred embodiment of the present invention.

As generally seen in the flow chart of FIG. 31 (3100), a preferred exemplary debris removal method with a controlled apparatus comprising a first delay tool and a perforating gun may be generally described in terms of the following steps:

(1) installing a wellbore casing in a wellbore along with the controlled apparatus (3101);
(2) injecting fluid so as to increase pressure to 80 to 100% of the maximum pressure (3102);
(3) allowing a piston in the delay tool to travel for a actuation time period (3103);
(4) opening a first injection point in the delay tool after elapse of the first actuation period (3104);
(5) collecting debris in the first tool (3105);
(6) opening a second injection point in the second tool after elapse a predetermined time (3106); and
(7) performing a downhole operation through the second injection point (3107).

Preferred Exemplary Flowchart of Debris Removal with a Controlled Dual Injection Apparatus (3200)

Figure 32:
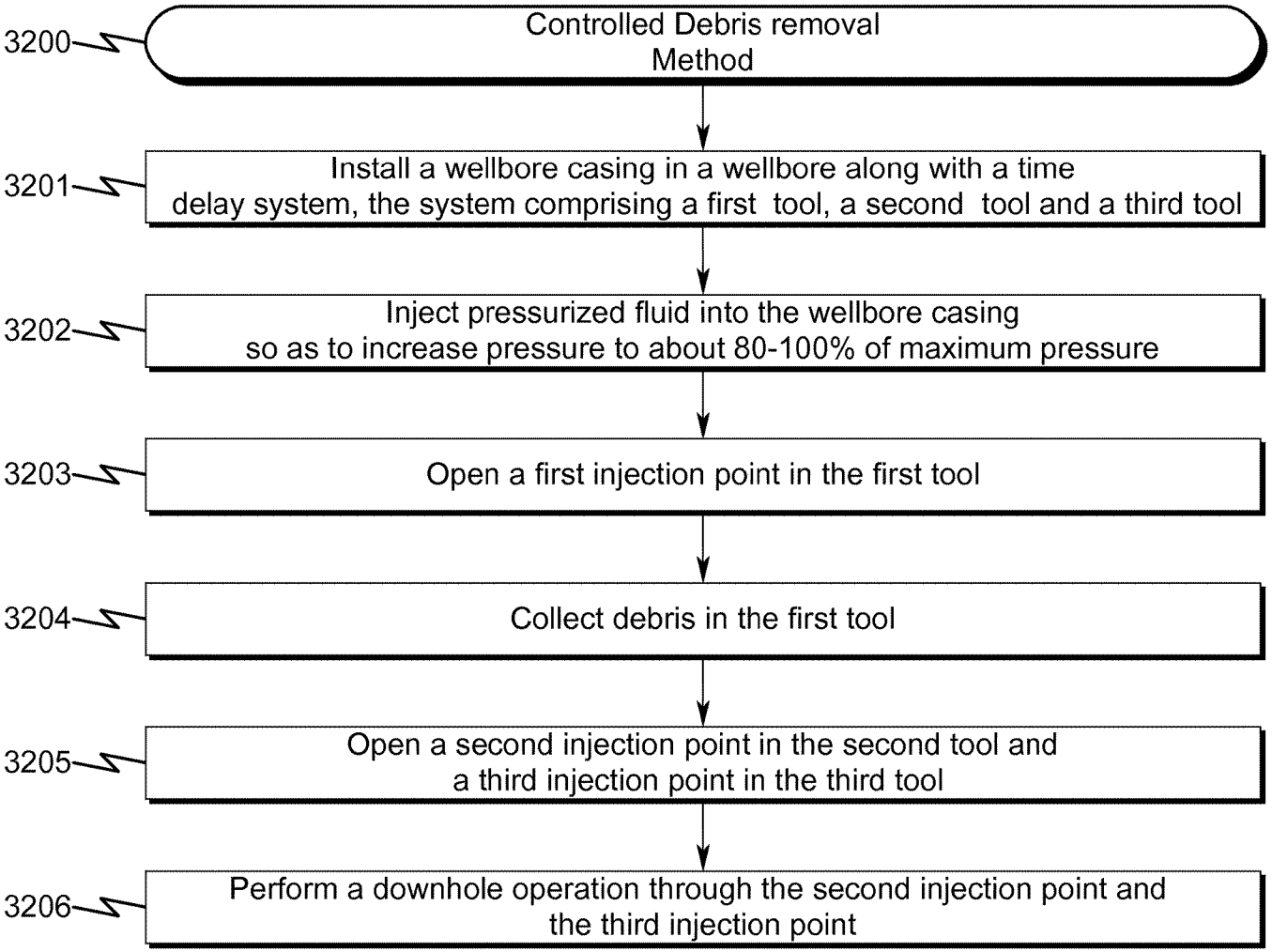
FIG. 32 is an exemplary flow chart illustrating debris removal with a controlled time delay apparatus comprising a first tool, a second tool and a third tool according to a preferred embodiment of the present invention.

As generally seen in the flow chart of FIG. 32 (3200), a preferred exemplary debris removal method with a staged time delay system comprising a first tool, a second tool and a third tool may be generally described in terms of the following steps:

(1) installing a wellbore casing in a wellbore (3201);
(2) injecting fluid into the wellbore casing so as to increase pressure to a maximum pressure (3202);
(3) opening a first injection point in the first tool (3203);
(4) collecting debris present in the wellbore casing at first injection point in the first tool for a predetermined time (3204);
(5) opening a second injection point in the second tool and a third injection point in the third tool (3205); and
(6) performing a downhole operation through the second injection point and the third injection point (3206).

According to a preferred exemplary embodiment, the first tool is plugged with debris during the predetermined time.

According to another preferred exemplary embodiment, the second tool and the third tool are controlled time delay valves.

According to a yet another preferred exemplary embodiment, the second tool and the third tool are actuated by a pressure of the pressurized fluid.

According to a further preferred exemplary embodiment, the first tool and the second tool are actuated by a first actuating device and the third tool actuated by a second actuating device.

According to a more preferred exemplary embodiment, the first tool and second tool are actuated by pressure and the third tool is actuated by a ball. The ball is deployed into the wellbore casing after the first tool collects debris from the wellbore casing.

According to a more preferred exemplary embodiment, the system may further comprises a fourth controlled time delay tool which is configured to be collects debris through a fourth injection point along with the first injection point.

Figure 33:
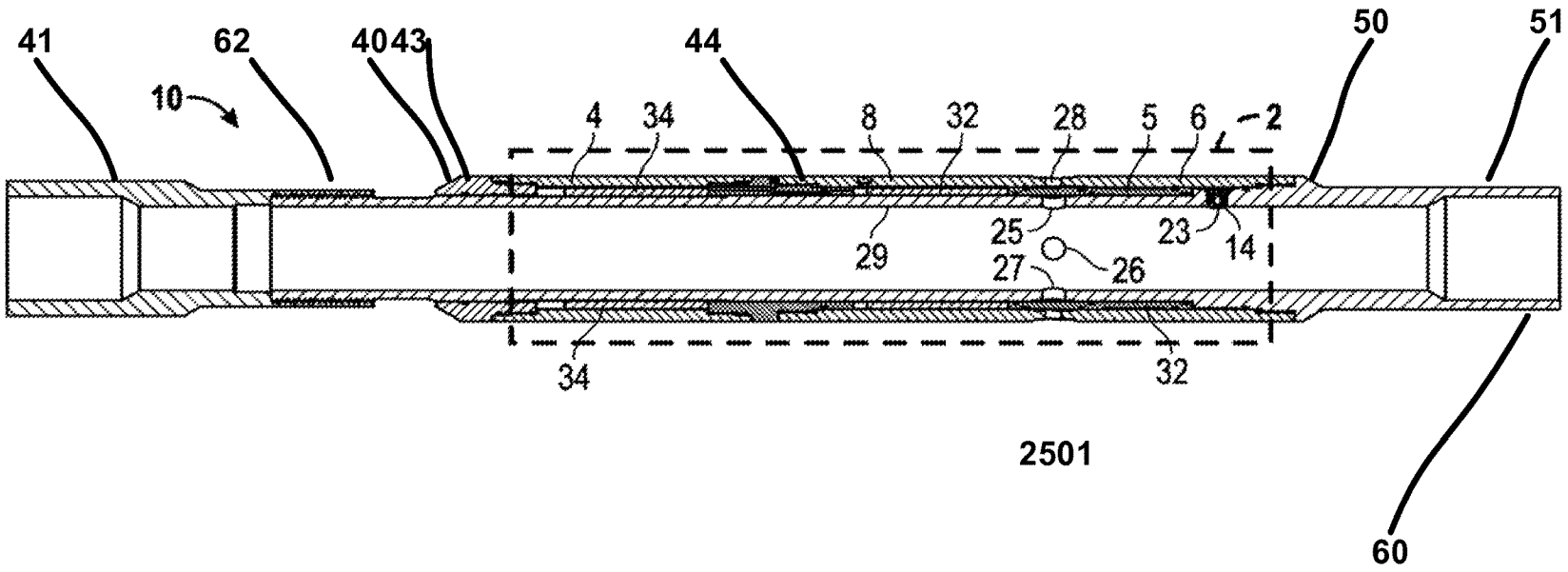
FIG. 33 is an exemplary sliding sleeve apparatus with a one piece mandrel according to a preferred embodiment of the present invention.

Preferred Exemplary Sliding Sleeve Apparatus Manufactured from a One Piece Mandrel As generally illustrated in FIG. 33, the sliding sleeve valve may be manufactured by installing a pressure actuating disk (23) such as a rupture disk or a reverse acting rupture disk onto the one piece mandrel (29). A piston (5) may be installed onto the mandrel (29) to cover openings (25) in the mandrel (29). The piston (5) may be installed from the first threaded end (41) towards the second threaded end (51) and hydraulically locking in place. A first outer housing (6) may be slid over the piston (5) from the first threaded end (41) and stopping on a first shoulder (40). A first outer housing (6) may be slid or glided over the piston (5) from the first threaded end (41) and stop on a first shoulder (50). A high pressure chamber (32) may be installed with a hydraulic fluid from the first threaded end (41) and stop adjacent to said piston (5). A restriction assembly (44) may be installed from the first threaded end (41) and stop adjacent to the high pressure chamber (32). A second outer housing (4) may be slid or glided over the mandrel adjacent to the restriction assembly (44). An end cap (43) is attached to the mandrel (29) and creating a low pressure chamber (34) adjacent to the restriction assembly (44). The wellbore casing (60) may be threaded to the mandrel (29) with the threads (62). It should be noted that even though there is one threaded end (41) illustrated in the FIG. 33 with threads (62), a second thread is made on the second threaded end (51) of the mandrel to customize the kind of thread used to thread into a wellbore casing. According to a preferred exemplary embodiment, the threads may be designed to casing torque specification.

According to a preferred exemplary embodiment, a sliding sleeve valve for use in a wellbore casing comprises a mandrel with a first threaded end and a second threaded end. The sliding sleeve valve may be conveyed with said wellbore casing. The sliding sleeve valve may be installed on a toe end of said wellbore casing. The mandrel may be a tubular annular single piece member. The mandrel may be made from materials selected from a group comprising of steel, cast iron, ceramics or, composites. The one piece integral piece enables the mandrel to carry the full torsional load 10,000 ft-lbs to 30,000 ft-lbs of a wellbore casing when the first threaded end and the second threaded end are threaded to ends of the wellbore casing. The first threaded end and the second threaded end may be designed to carry the wellbore casing (60) specification. According to a further preferred exemplary embodiment the first threaded end and the threaded end are configured with threads that are configured to conform to the wellbore casing torque specification.

According to a further preferred exemplary embodiment the sliding sleeve valve is assembled with components from one end only. For example, the rupture disk (23), the piston (5), the first outer housing (6), the high pressure chamber (32), the restriction assembly (44), the second outer housing (4) and the end cap (43) are all slid/glided or installed from the first threaded end (41) towards the direction of the second threaded end (51). According to another preferred exemplary embodiment a plurality of components are installed longitudinally from either end of the mandrel.

According to a preferred exemplary embodiment a plurality of components are installed on an outer surface of the mandrel. For example, the rupture disk (23), the piston (5), the first outer housing (6), the high pressure chamber (32), the restriction assembly (44), the second outer housing (4) and the end cap (43) are all slid/glided or installed on the outer surface of the mandrel (29). According to another preferred exemplary embodiment the plurality of components are installed on an inner surface of the mandrel. According to yet another preferred exemplary embodiment the plurality of components are installed on an inner surface of the mandrel and an outer surface of the mandrel.

According to a preferred exemplary embodiment said sliding sleeve valve is a controlled hydraulic time delay valve. According to a further preferred exemplary embodiment the controlled hydraulic time delay valve comprises dual time delay valves which are each actuated by dual actuating devices. According to a further preferred exemplary embodiment the controlled hydraulic time delay valve comprises dual time delay valves which are both actuated by a single actuating device.

Preferred Exemplary Flowchart of Assembling a Sliding Sleeve Valve with a One Piece Mandrel (3400)

Figure 34:
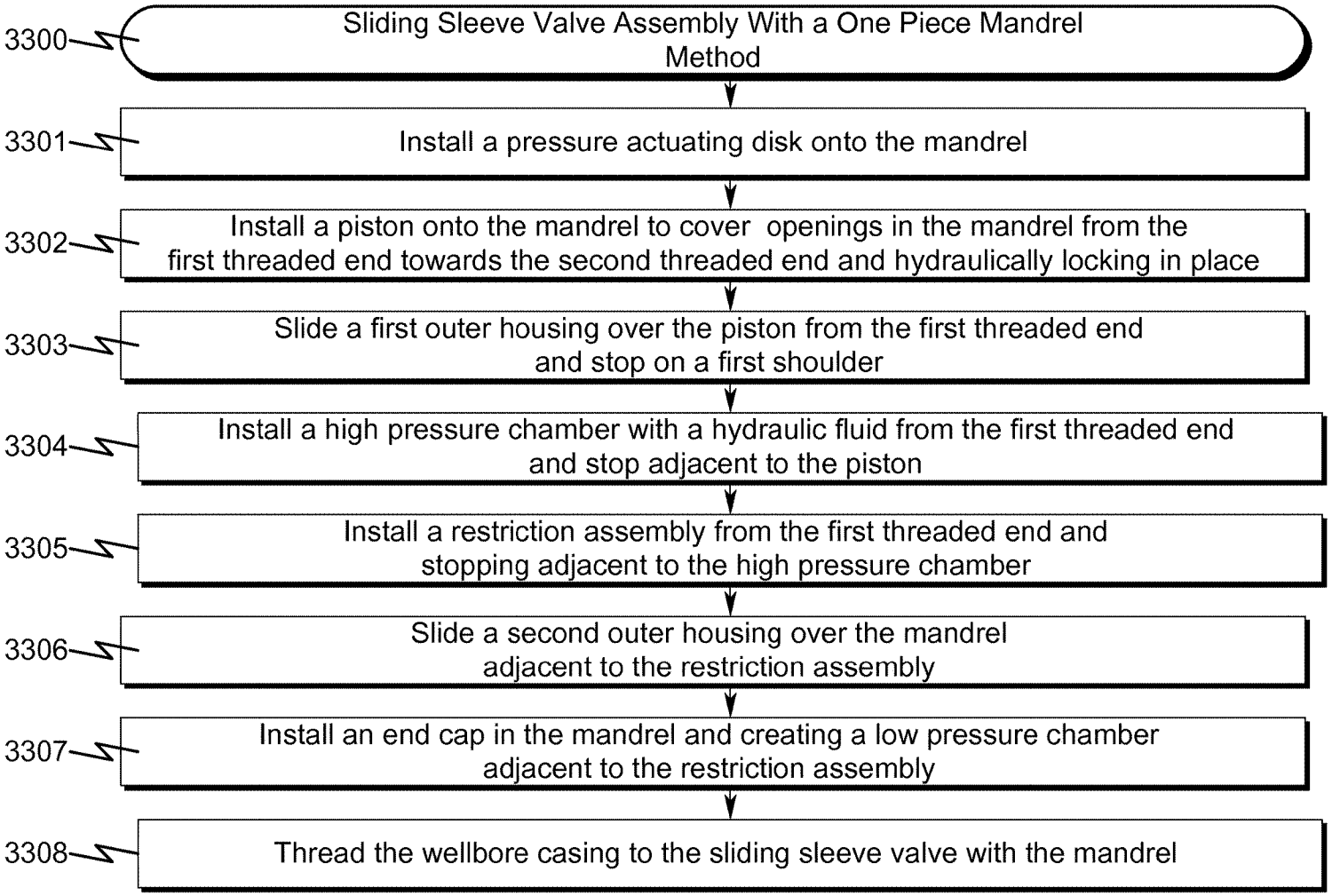
FIG. 34 is an exemplary flow chart illustrating assembly of a sliding sleeve apparatus with a one piece mandrel according to a preferred embodiment of the present invention.

As generally seen in the flow chart of FIG. 34 (3400), a preferred exemplary method of assembly of a sliding sleeve valve with a one piece mandrel is described in terms of the following steps:

(1) installing a pressure actuating disk onto said mandrel (3401);

(2) installing a piston onto said mandrel to cover a plurality of openings in said mandrel from said first threaded end towards said second threaded end and hydraulically locking in place (3402);

(3) sliding a first outer housing over said piston from said first threaded end and stopping on a first shoulder (3403);

(4) installing a high pressure chamber with the fluid from said first threaded end and stopping adjacent to said piston (3404);

(5) installing a restriction assembly from said first end and stopping adjacent to said high pressure chamber (3405);

(6) sliding a second outer housing over said mandrel adjacent to said restriction assembly (3406);

(7) installing an end cap in said mandrel and creating a low pressure chamber adjacent to said restriction assembly (3407); and (8) threading said wellbore casing to said sliding sleeve valve with said mandrel (3408).

System Summary

The present invention system anticipates a wide variety of variations in the basic theme of time delay valves, but can be generalized a controlled time delay apparatus integrated into a well casing for injection of pressurized fluid into a subterranean formation, the apparatus comprising: a housing with openings, a piston, a delay restrictor, an actuating device and a high pressure chamber with a hydraulic fluid; the delay restrictor is configured to be in pressure communication with the high pressure chamber; a rate of travel of the piston is restrained by a passage of the hydraulic fluid from the high pressure chamber into a low pressure chamber through the delay restrictor;

wherein upon actuation by the actuating device, the piston travels for an actuation time period, after elapse of the actuation time period, the piston travel allows opening of the openings so that the pressurized fluid flows through the openings for a port opening time interval.

This general system summary may be augmented by the various elements described herein to produce a wide variety of invention embodiments consistent with this overall design description.

Method Summary

The present invention method anticipates a wide variety of variations in the basic theme of implementation, but can be generalized as a controlled time delay method wherein the method is performed on a controlled time delay apparatus integrated into a well casing for injection of pressurized fluid into a subterranean formation, the apparatus comprising: a housing with openings, a piston, a delay restrictor, an actuating device and a high pressure chamber with a hydraulic fluid; the delay restrictor is configured to be in pressure communication with the high pressure chamber; a rate of travel of the piston is restrained by a passage of the hydraulic fluid from the high pressure chamber into a low pressure chamber through the delay restrictor;

wherein upon actuation by the actuating device, the piston travels for an actuation time period, after elapse of the actuation time period, the piston travel allows opening of the openings so that the pressurized fluid flows through the openings for a port opening time interval;

wherein the method comprises the steps of:

(1) installing a wellbore casing in a wellbore along with the apparatus;

(2) injecting the pressurized fluid into the wellbore casing;

(3) actuating the actuating device when the maximum pressure exceeds a rated pressure of the actuating device;
(4) allowing the piston to travel for the actuation time period; and
(5) enabling the piston to travel to open the openings for the port opening time interval so that the pressurized fluid flows into the subterranean formation.

This general method summary may be augmented by the various elements described herein to produce a wide variety of invention embodiments consistent with this overall design description.

Casing Integrity Test Method Summary

The present invention method anticipates a wide variety of variations in the basic theme of implementation, but can be generalized as a casing integrity test method wherein the method is performed with a controlled time delay apparatus the time delay apparatus comprising: a housing with openings, a piston, a restrictor, an actuating device and a high pressure chamber with a hydraulic fluid; the restrictor is configured to be in pressure communication with the high pressure chamber; a rate of travel of the piston is restrained by a passage of the hydraulic fluid from the high pressure chamber into a low pressure chamber through the restrictor;

wherein upon actuation by the actuating device, the piston travels for an actuation time period, after elapse of the actuation time period, the piston travel allows opening of the openings so that the pressurized fluid flows through the openings for a port opening time interval;

wherein the method comprises the steps of:
(1) installing a wellbore casing in a wellbore along with the apparatus;
(2) injecting the fluid to about 80% of a maximum casing pressure;
(3) testing for casing integrity;
(4) increasing pressure of the pressurized fluid so that the pressure exceeds a rated pressure of the actuating device;
(5) increasing pressure of the pressurized fluid to about 100% of the maximum casing pressure allowing the piston to travel for the actuation time period;
(6) testing casing integrity for the actuation time period; and
(7) enabling the piston to travel to open the openings for the port opening time interval so that the pressurized fluid flows into the subterranean formation.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the delay restrictor is a cartridge comprising a plurality of delay elements connected as a series chain.

An embodiment wherein the delay restrictor is a cartridge comprising a plurality of delay elements connected in a combination of series chain and a parallel chain.

An embodiment wherein the hydraulic fluid has a viscosity ranging from 3 to 10000 centistokes.

An embodiment wherein the hydraulic fluid further has plugging agents that are configured to further retard the rate of travel of the piston.

An embodiment wherein the hydraulic fluid is configured to change phase from a solid to a liquid.

An embodiment wherein the actuation time period ranges from greater than 60 minutes to less than 2 weeks.

An embodiment wherein the actuation time period is almost 0 seconds so that the openings open instantaneously.

An embodiment wherein the actuation time period ranges from 0.5 seconds to 60 minutes.

An embodiment wherein the actuation time period is ranges from 2 minutes to 3 minutes.

An embodiment wherein the port opening time interval ranges from 0.5 seconds to 20 minutes.

An embodiment wherein the port opening time interval is almost 0 seconds.

An embodiment wherein the apparatus is associated with an inner diameter and an outer diameter; the ratio of inner diameter to outer diameter ranges from 0.4 to 0.9.

An embodiment wherein the apparatus is associated with an inner tool diameter and the well bore casing is associated with an inner casing diameter ratio; the ratio of inner tool diameter to outer casing diameter ranges from 0.4 to 1.1.

An embodiment wherein the actuating device has a rating pressure that is substantially equal to a pressure of the wellbore casing.

An embodiment wherein the actuating device is a reverse acting rupture disk.

An embodiment wherein the actuating device is a rupture disk.

An embodiment wherein the mandrel further comprises ports; the ports are configured to align to the openings in the housing during the port opening time interval.

An embodiment wherein a shape of the openings in the housing is selected from a group consisting of: a circle, an oval, a triangle, and a rectangle.

An embodiment wherein a shape of the ports in the mandrel is selected from a group consisting of: a circle, an oval, a triangle or a rectangle.

An embodiment wherein a jet of the pressurized fluid is produced when the pressurized fluid injects into the subterranean formation as the ports in the mandrel travel slowly across the openings in the housing.

An embodiment wherein a shape of the jet is determined by a shape of the ports and a shape of the openings.

One skilled in the art will recognize that other embodiments are possible based on combinations of elements taught within the above invention description.

Controlled Dual Time Delay System Summary

The present invention system anticipates a wide variety of variations in the basic theme of time delay valves, but can be generalized a controlled dual time delay system for injection of pressurized fluid through a wellbore casing at a plurality of locations into a subterranean formation, the system comprising:

a first delay tool integrated into the wellbore casing at a first location; the first tool comprises a first housing with first openings, a first piston, and a first actuating device;

a second delay tool integrated into the wellbore casing at a second location; the second tool comprises a second housing with second openings, a second piston, and a second actuating device;

wherein upon actuation by the first actuating device, the first piston travels for a first actuation time period, after elapse of the first actuation time period, the first piston travel allows opening of the first openings so that the pressurized fluid flows through the first openings for a first port opening time interval; and upon actuation by the second actuating device, the second piston travels for a second actuation time period, after elapse of the second actuation time period, the second piston travel allows opening of the second openings so that the pressurized fluid flows through the second openings for a second port opening time interval.

Controlled Dual Time Delay Method Summary

The present invention method anticipates a wide variety of variations in the basic theme of implementation, but can be generalized as a controlled dual time delay method for controlled injection of pressurized fluid into a subterranean formation at a plurality of locations, the method operating in conjunction with a controlled dual time delay system, the controlled dual time delay system comprising: a first delay tool integrated into the wellbore casing at a first location; the first delay tool comprises a first housing with first openings, a first piston, and a first actuating device; a second delay tool integrated into the wellbore casing at a second location; the second delay tool comprises a second housing with second openings, a second piston, and a second actuating device;

wherein the controlled dual time delay method comprises the steps of:

(1) installing a wellbore casing in a wellbore along with the dual time delay system;

(2) injecting the pressurized fluid at about maximum pressure;

(3) activating the first actuating device when the maximum pressure exceeds a rated pressure of the first actuating device and activating the second actuating device when the maximum pressure exceeds a rated pressure of the second actuating device;

(4) allowing the first piston to travel for a first actuation time period and allowing the second piston to travel for a second actuation time period;

(5) enabling the first piston to travel to open the first openings for a first port opening time interval and enabling the second piston to travel to open said second openings for a second port opening time interval, so that the pressurized fluid flows into the subterranean formation.

This general method summary may be augmented by the various elements described herein to produce a wide variety of invention embodiments consistent with this overall design description.

Single-Actuating Controlled Time Delay System Summary

The present invention system anticipates a wide variety of variations in the basic theme of time delay valves, but can be generalized a single-actuating controlled time delay system integrated into a wellbore casing for injecting pressurized fluid through the wellbore casing into a subterranean formation, the dual toe valve comprising: a housing with first openings and second openings, a first piston, a second piston, and an actuating device;

wherein upon actuation by the actuating device, the first piston travels for a first actuation time period, after elapse of the first actuation time period, the first piston travel allows opening of the first openings so that the pressurized fluid flows through the first openings for a first port opening time interval;

upon actuation by the actuating device, the second piston travels for a second actuation time period, after elapse of the second actuation time period, the second piston travel allows opening of the second openings so that the pressurized fluid flows through the second openings for a second port opening time interval; and upon actuation by the actuating device, the first piston and the second piston travel in opposite directions.

Single-Actuating Controlled Time Delay Method Summary

The present invention method anticipates a wide variety of variations in the basic theme of implementation, but can be generalized as a single-actuating controlled time delay method for controlled injection of pressurized fluid into a subterranean formation at a plurality of locations, the method operating in conjunction with a controlled single-actuating time delay toe valve integrated into a wellbore casing for injecting pressurized fluid through the wellbore casing into a subterranean formation, the single-actuating time delay toe valve comprising: a housing with first openings and second openings, a first piston, a second piston, and an actuating device;

wherein the single-actuating time delay method comprises the steps of:

(1) installing a wellbore casing in a wellbore along with the single actuating dual toe valve;

(2) injecting the pressurized fluid at about maximum pressure;

(3) activating the actuating device when the maximum pressure exceeds a rated pressure of the actuating device;

(4) allowing the first piston to travel for a first actuation time period and allowing the second piston to travel for a second actuation time period;

(5) enabling the first piston to travel to open the first openings for a first port opening time interval and enabling the second piston to travel to open the second openings for a second port opening time interval, so that the pressurized fluid flows into the subterranean formation.

This general method summary may be augmented by the various elements described herein to produce a wide variety of invention embodiments consistent with this overall design description.

Wet Shoe Detection System Summary

The present invention system anticipates a wide variety of variations in the basic theme of time delay valves, but can be generalized an apparatus integrated into a well casing, a time delay injection valve with a seating surface built into the valve; the seating surface is configured to seat a restriction plug element; whereby, when a leak is detected in the well casing during a casing integrity test, a restriction plug element is dropped to seat in the conforming seating surface to determine if the leak is due to the wet shoe.

Wet Shoe Detection Method Summary

The present invention method anticipates a wide variety of variations in the basic theme of implementation, but can be generalized as a method for detecting a wet shoe in a wellbore casing, the method operating in conjunction with an apparatus integrated into a toe end of the well casing, the apparatus a time delay injection valve with a seating surface built into the valve; the seating surface is configured to seat a restriction plug element; whereby, when a leak is detected in the well casing during a casing integrity test, a restriction plug element is dropped to seat in the conforming seating surface to determine if the leak is due to the wet shoe;

wherein said method comprises the steps of:

(1) installing a wellbore casing in a wellbore along with the apparatus;
(2) performing a casing integrity test at maximum pressure;
(3) checking if the casing integrity test passes, if so, proceeding to step (9);
(4) deploying the restriction plug element into the wellbore casing;
(5) seating the restriction plug element in the conforming seating surface of the apparatus;
(6) performing a casing integrity test at maximum pressure;
(7) checking if the casing integrity test passes, if so, proceeding to step (9);
(8) fixing the source of the leak; and
(9) performing perforation and fracturing operations.

This general method summary may be augmented by the various elements described herein to produce a wide variety of invention embodiments consistent with this overall design description.

Fracturing Method Summary

The present invention method anticipates a wide variety of variations in the basic theme of implementation, but can be generalized as a fracturing method for pumping fracturing fluid into a subterranean formation through a controlled time delay apparatus, the controlled time delay apparatus comprising: a housing with openings, a piston, a restrictor, an actuating device and a high pressure chamber with a hydraulic fluid; the stacked delay restrictor is configured to be in pressure communication with the high pressure chamber; a rate of travel of the piston is restrained by a passage of the hydraulic fluid from the high pressure chamber into a low pressure chamber through the stacked delay restrictor;

wherein the fracturing method comprises the steps of:

(1) installing a wellbore casing in a wellbore along with the time delay apparatus;
(2) pumping up wellbore pressure to a maximum pressure;
(3) activating the actuating device when the maximum pressure exceeds a rated pressure of the actuating device;
(4) performing a casing integrity test for an actuation time period at the maximum pressure;
(5) enabling the piston to travel to open the openings so that a connection is established to the subterranean formation; and
(6) pumping fracturing fluid through the time delay apparatus.

This general method summary may be augmented by the various elements described herein to produce a wide variety of invention embodiments consistent with this overall design description.

Staged Time Delay System Summary

The present invention system anticipates a wide variety of variations in the basic theme of time delay valves, but can be generalized a staged time delay system for removal of debris in a wellbore casing, the staged time delay system comprising a first tool and a second tool; the first tool is conveyed with the wellbore casing;

wherein when pressurized fluid is injected into the wellbore casing at a maximum pressure, a first injection point in the first tool is opened; the first injection point collects debris from the wellbore casing for a predetermined time; and a second injection point in the second tool is opened after the predetermined time; the second injection point is configured to enable downhole operations after the debris is collected in the first tool leaving the second injection point free of the debris.

Staged Injection Method Summary

The present invention method anticipates a wide variety of variations in the basic theme of implementation, but can be generalized as a staged injection method for removal of debris in a wellbore casing, the method operating in conjunction with a staged time delay system, the staged time delay system comprising a first tool and a second tool;

wherein the staged injection method comprises the steps of:

(1) installing a wellbore casing in a wellbore;
(2) injecting pressurized fluid into the wellbore casing at a maximum pressure;
(3) opening a first injection point in the first tool;
(4) collecting debris present in the wellbore casing at first injection point in the first tool for a predetermined time;
(5) opening a second injection point in the second tool; and
(6) performing a downhole operation through the second injection point.

This general method summary may be augmented by the various elements described herein to produce a wide variety of invention embodiments consistent with this overall design description.

Sliding Sleeve Valve System Summary

The present invention system anticipates a wide variety of variations in the basic theme of time delay valves, but can be generalized a sliding sleeve valve for use in a wellbore casing comprising a mandrel with a first threaded end and a second threaded end; the mandrel manufactured from one integral piece such that the mandrel carries a torque rating of the wellbore casing when the mandrel is threaded to ends of the wellbore casing.

Sliding Sleeve Valve Method Summary

The present invention method anticipates a wide variety of variations in the basic theme of implementation, but can be generalized as a method of manufacturing a sliding sleeve valve for use in a wellbore casing; the sliding sleeve valve comprising a mandrel with a first threaded end and a second threaded end; the mandrel manufactured from one integral piece such that the mandrel carries a torque rating of the wellbore casing when mandrel is threaded to the wellbore casing;

wherein the method comprises the steps of:

(1) installing a pressure actuating disk onto the mandrel;

(2) installing a piston onto the mandrel to cover a plurality of openings in the mandrel from the first threaded end towards the second threaded end and hydraulically locking in place;

(3) sliding a first outer housing over the piston from the first threaded end and stopping on a first shoulder;

(4) installing a high pressure chamber with the fluid from the first threaded end and stopping adjacent to the piston;

(5) installing a restriction assembly from the first end and stopping adjacent to the high pressure chamber;

(6) sliding a second outer housing over the mandrel adjacent to the restriction assembly;

(7) installing an end cap in the mandrel and creating a low pressure chamber adjacent to the restriction assembly; and (8) threading the wellbore casing to the sliding sleeve valve with the mandrel.

This general method summary may be augmented by the various elements described herein to produce a wide variety of invention embodiments consistent with this overall design description.

CONCLUSION

An apparatus and method for providing a time delay in injection of pressured fluid into a geologic formation has been disclosed. In one aspect the invention is a toe valve activated by fluid pressure that opens ports after a predetermined time interval to allow fluid to pass from a well casing to a formation. The controlled time delay enables casing integrity testing before fluid is passed through the ports. This time delay also allows multiple valves to be used in the same well casing and provide a focused jetting action to better penetrate a concrete casing lining.

What is claimed is:

1. A time delay injection valve comprising:

a seating surface disposed within said time delay injection valve, said seating surface configured to seat a restriction plug element that seals a flowpath through said time delay injection valve; and wherein the time delay injection valve further comprises a fluid that provides a delay to control a port opening time interval; and wherein the time delay injection valve comprises dual pistons, wherein each said dual pistons are configured to be actuated by a different actuating device.

2. The time delay injection valve of claim 1 wherein the seating surface is shaped to receive said restriction plug element having a shape that is selected from a group consisting of a sphere, a dart, an ovoid, and a cylinder.

3. The time delay injection valve of claim 1 wherein said time delay injection valve is integrated into a toe end of said well casing.

4. The time delay injection valve of claim 1 wherein the restriction plug element is degradable.

5. A wellbore casing comprising:

a time delay injection valve at a toe-end of said wellbore casing, said time delay injection valve having a seating surface disposed within said time delay injection valve, wherein said seating surface is configured to seat a restriction plug element that seals a flowpath through said time delay injection valve; and wherein the time delay injection valve further comprises a fluid that provides a delay to control a port opening time interval; and wherein the time delay injection valve comprises dual pistons, wherein each of said dual pistons are configured to be actuated by a different actuating device.

6. The wellbore casing of claim 5 wherein the seating surface is shaped to receive said restriction plug element having a shape that is selected from a group consisting of a sphere, a dart, an ovoid, and a cylinder.

7. The wellbore casing of claim 5 wherein said time delay injection valve is integrated into a toe end of said well casing.

8. The wellbore casing of claim 5 wherein the restriction plug element is degradable.

9. The wellbore casing of claim 5 wherein the restriction plug element is non-degradable.

* * * * *